US010045145B2

(12) United States Patent
Chebiyyam et al.

(10) Patent No.: US 10,045,145 B2
(45) Date of Patent: Aug. 7, 2018

(54) TEMPORAL OFFSET ESTIMATION

(71) Applicant: QUALCOMM Incorporated, San Diego, CA (US)

(72) Inventors: Venkata Subrahmanyam Chandra Sekhar Chebiyyam, San Diego, CA (US); Venkatraman Atti, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/372,802

(22) Filed: Dec. 8, 2016

(65) Prior Publication Data

US 2017/0180906 A1 Jun. 22, 2017

Related U.S. Application Data

(60) Provisional application No. 62/269,796, filed on Dec. 18, 2015.

(51) Int. Cl.

| | |
|---|---|
| ***H04R 5/00*** | (2006.01) |
| ***H04S 7/00*** | (2006.01) |
| ***G10L 19/008*** | (2013.01) |

(52) U.S. Cl.

CPC ..... *H04S 7/307* (2013.01); *G10L 19/008* (2013.01); *H04S 2400/01* (2013.01); (Continued)

(58) Field of Classification Search

CPC ..... G10L 19/008; H04S 2400/01; H04S 2400/03; H04S 2400/15; H04S 2420/03; H04S 7/307

(Continued)

(56) References Cited

U.S. PATENT DOCUMENTS

2006/0029239 A1 2/2006 Smithers
2012/0033817 A1 2/2012 Francois et al.

(Continued)

OTHER PUBLICATIONS

International Search Report and Written Opinion—PCT/US2016/065869—ISA/EPO—dated Mar. 15, 2017.

(Continued)

*Primary Examiner* — Xu Mei
*Assistant Examiner* — Friedrich W Fahnert
(74) *Attorney, Agent, or Firm* — Toler Law Group, P.C.

(57) ABSTRACT

A method of non-causally shifting a channel includes estimating comparison values at an encoder. Each comparison value is indicative of an amount of temporal mismatch between a previously captured reference channel and a corresponding previously captured target channel. The method also includes smoothing the comparison values to generate smoothed comparison values based on historical comparison value data and a smoothing parameter. The method further includes estimating a tentative shift value based on the smoothed comparison values. The method also includes non-causally shifting a target channel by a non-causal shift value to generate an adjusted target channel that is temporally aligned with a reference channel. The non-causal shift value is based on the tentative shift value. The method further includes generating, based on reference channel and the adjusted target channel, at least one of a mid-band channel or a side-band channel.

34 Claims, 24 Drawing Sheets

(52) U.S. Cl.
CPC ..... *H04S 2400/03* (2013.01); *H04S 2400/15* (2013.01); *H04S 2420/03* (2013.01)

(58) Field of Classification Search
USPC ..... 381/1, 2, 17, 23, 94.2, 122; 704/E19.042, E19.005
See application file for complete search history.

(56) References Cited

U.S. PATENT DOCUMENTS

| | | | | |
|---|---|---|---|---|
| 2012/0170757 | A1* | 7/2012 | Kraemer | H04S 7/30 381/17 |
| 2013/0301835 | A1 | 11/2013 | Briand et al. | |
| 2015/0010155 | A1 | 1/2015 | Virette et al. | |
| 2016/0299738 | A1* | 10/2016 | Makinen | H04S 7/30 |

OTHER PUBLICATIONS

ITU-T, "7kHz Audio-Coding within 64 kbit/s: New Annex D with stereo embedded extension", ITU-T Draft; Study Period 2009-2012, International Telecommunication Union, Geneva; CH, vol. 10/16, May 8, 2012 (May 8, 2012), XP044050906, pp. 1-52.

Lindblom, et al., "Flexible Sum-Difference Stereo Coding based on Time-Aligned Signal Components", Applications of Signal Processing to Audio and Acoustics, New Paltz, NY, USA, Oct. 16-19, 2005 (Oct. 16, 2005), XP010854377, pp. 255-258.

* cited by examiner

TEMPORAL OFFSET ESTIMATION

I. CLAIM OF PRIORITY

The present application claims priority from U.S. Provisional Patent Application No. 62/269,796 entitled "TEMPORAL OFFSET ESTIMATION," filed Dec. 18, 2015, the contents of which are incorporated by reference herein in their entirety.

II. FIELD

The present disclosure is generally related to estimating a temporal offset of multiple channels.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include multiple microphones to receive audio signals. Generally, a sound source is closer to a first microphone than to a second microphone of the multiple microphones. Accordingly, a second audio signal received from the second microphone may be delayed relative to a first audio signal received from the first microphone. In stereo-encoding, audio signals from the microphones may be encoded to generate a mid channel and one or more side channels. The mid channel may correspond to a sum of the first audio signal and the second audio signal. A side channel may correspond to a difference between the first audio signal and the second audio signal. The first audio signal may not be temporally aligned with the second audio signal because of the delay in receiving the second audio signal relative to the first audio signal. The misalignment (or "temporal offset") of the first audio signal relative to the second audio signal may increase a magnitude of the side channel. Because of the increase in magnitude of the side channel, a greater number of bits may be needed to encode the side channel.

Additionally, different frame types may cause the computing device to generate different temporal offsets or shift estimates. For example, the computing device may determine that a voiced frame of the first audio signal is offset by a corresponding voiced frame in the second audio signal by a particular amount. However, due to a relatively high amount of noise, the computing device may determine that a transition frame (or unvoiced frame) of the first audio signal is offset by a corresponding transition frame (or corresponding unvoiced frame) of the second audio signal by a different amount. Variations in the shift estimates may cause sample repetition and artifact skipping at frame boundaries. Additionally, variation in shift estimates may result in higher side channel energies, which may reduce coding efficiency.

IV. SUMMARY

According to one implementation of the techniques disclosed herein, a method of estimating a temporal offset between audio captured at multiple microphones includes capturing a reference channel at a first microphone and capturing a target channel at a second microphone. The reference channel includes a reference frame, and the target channel includes a target frame. The method also includes estimating a delay between the reference frame and the target frame. The method further includes estimating a temporal offset between the reference channel and the target channel based on the delay and based on historical delay data.

According to another implementation of the techniques disclosed herein, an apparatus for estimating a temporal offset between audio captured at multiple microphones includes a first microphone configured to capture a reference channel and a second microphone configured to capture a target channel. The reference channel includes a reference frame, and the target channel includes a target frame. The apparatus also includes a processor and a memory storing instructions that are executable to cause the processor to estimate a delay between the reference frame and the target frame. The instructions are also executable to cause the processor to estimate a temporal offset between the reference channel and the target channel based on the delay and based on historical delay data.

According to another implementation of the techniques disclosed herein, a non-transitory computer-readable medium includes instructions for estimating a temporal offset between audio captured at multiple microphones. The instructions, when executed by a processor, cause the processor to perform operations including estimating a delay between a reference frame and a target frame. The reference frame is included in a reference channel captured at a first microphone, and the target frame is included in a target channel captured at a second microphone. The operations also include estimating a temporal offset between the reference channel and the target channel based on the delay and based on historical delay data.

According to another implementation of the techniques disclosed herein, an apparatus for estimating a temporal offset between audio captured at multiple microphones includes means for capturing a reference channel and means for capturing a target channel. The reference channel includes a reference frame, and the target channel includes a target frame. The apparatus also includes means for estimating a delay between the reference frame and the target frame. The apparatus further includes means for estimating a temporal offset between the reference channel and the target channel based on the delay and based on historical delay data.

According to another implementation of the techniques disclosed herein, a method of non-causally shifting a channel includes estimating comparison values at an encoder. Each comparison value is indicative of an amount of temporal mismatch between a previously captured reference channel and a corresponding previously captured target channel. The method also includes smoothing the comparison values to generate smoothed comparison values based on historical comparison value data and a smoothing parameter. The method further includes estimating a tentative shift value based on the smoothed comparison values. The method also includes non-causally shifting a target channel by a non-causal shift value to generate an adjusted target channel that is temporally aligned with a reference channel.

The non-causal shift value is based on the tentative shift value. The method further includes generating, based on the reference channel and the adjusted target channel, at least one of a mid-band channel or a side-band channel.

According to another implementation of the techniques disclosed herein, an apparatus for non-causally shifting a channel includes a first microphone configured to capture a reference channel and a second microphone configured to capture a target channel. The apparatus also includes an encoder configured to estimate comparison values. Each comparison value is indicative of an amount of temporal mismatch between a previously captured reference channel and a corresponding previously captured target channel. The encoder is also configured to smooth the comparison values to generate smoothed comparison values based on historical comparison value data and a smoothing parameter. The encoder is further configured to estimate a tentative shift value based on the smoothed comparison values. The encoder is also configured to non-causally shift a target channel by a non-causal shift value to generate an adjusted target channel that is temporally aligned with a reference channel. The non-causal shift value is based on the tentative shift value. The encoder is further configured to generate, based on the reference channel and the adjusted target channel, at least one of a mid-band channel or a side-band channel.

According to another implementation of the techniques disclosed herein, a non-transitory computer-readable medium includes instruction for non-causally shifting a channel. The instructions, when executed by an encoder, cause the encoder to perform operations including estimating comparison values. Each comparison value is indicative of an amount of temporal mismatch between a previously captured reference channel and a corresponding previously captured target channel. The operations also include smoothing the comparison values to generate smoothed comparison values based on historical comparison value data and a smoothing parameter. The operations also include estimating a tentative shift value based on the smoothed comparison values. The operations also include non-causally shifting a target channel by a non-causal shift value to generate an adjusted target channel that is temporally aligned with a reference channel. The non-causal shift value is based on the tentative shift value. The operations also include generating, based on the reference channel and the adjusted target channel, at least one of a mid-band channel or a side-band channel.

According to another implementation of the techniques disclosed herein, an apparatus for non-causally shifting a channel includes means for estimating comparison values. Each comparison value is indicative of an amount of temporal mismatch between a previously captured reference channel and a corresponding previously captured target channel. The apparatus also includes means for smoothing the comparison values to generate smoothed comparison values based on historical comparison value data and a smoothing parameter. The apparatus also includes means for estimating a tentative shift value based on the smoothed comparison values. The apparatus also includes means for non-causally shifting a target channel by a non-causal shift value to generate an adjusted target channel that is temporally aligned with a reference channel. The non-causal shift value is based on the tentative shift value. The apparatus also includes means for generating, based on the reference channel and the adjusted target channel, at least one of a mid-band channel or a side-band channel.

V. BRIEF DESCRIPTION OF THE DRAWINGS

VI. DETAILED DESCRIPTION

Figure 1:
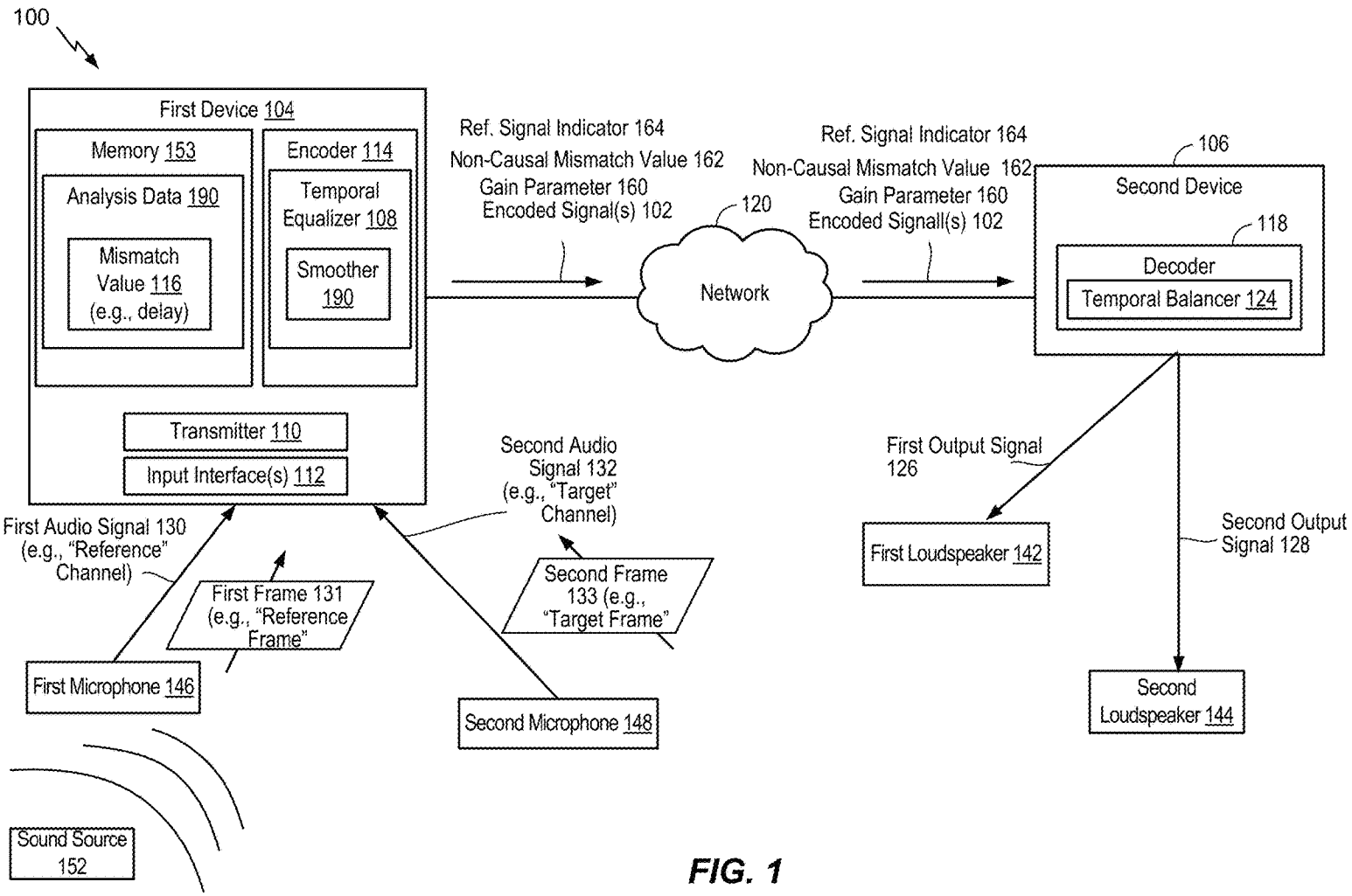
FIG. 1 is a block diagram of a particular illustrative example of a system that includes a device operable to encode multiple channels.

Systems and devices operable to encode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially)

generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded in MS coding. Relatively more bits are spent on the sum signal than on the side signal. PS coding reduces redundancy in each sub-band by transforming the L/R signals into a sum signal and a set of side parameters. The side parameters may indicate an inter-channel intensity difference (IID), an inter-channel phase difference (IPD), an inter-channel time difference (ITD), etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical.

The MS coding and the PS coding may be done in either the frequency domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2,\ S=(L-R)/2, \qquad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R),\ S=c(L-R), \qquad \text{Formula 2}$$

where c corresponds to a complex value which is frequency dependent. Generating the Mid channel and the Side channel based on Formula 1 or Formula 2 may be referred to as performing a "down-mixing" algorithm. A reverse process of generating the Left channel and the Right channel from the Mid channel and the Side channel based on Formula 1 or Formula 2 may be referred to as performing an "up-mixing" algorithm.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a temporal mismatch value indicative of a temporal shift of the first audio signal relative to the second audio signal. The mismatch value may correspond to an amount of temporal delay between receipt of the first audio signal at the first microphone and receipt of the second audio signal at the second microphone. Furthermore, the encoder may determine the mismatch value on a frame-by-frame basis, e.g., based on each 20 milliseconds (ms) speech/audio frame. For example, the mismatch value may correspond to an amount of time that a second frame of the second audio signal is delayed with respect to a first frame of the first audio signal. Alternatively, the mismatch value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal delay value may also change from one frame to another. However, in some implementations, the mismatch value may always be positive to indicate an amount of delay of the "target" channel relative to the "reference" channel. Furthermore, the mismatch value may correspond to a "non-causal shift" value by which the delayed target channel is "pulled back" in time such that the target channel is aligned (e.g., maximally aligned) with the "reference" channel. The down mix algorithm to determine the mid channel and the side channel may be performed on the reference channel and the non-causal shifted target channel.

The encoder may determine the mismatch value based on the reference audio channel and a plurality of mismatch values applied to the target audio channel. For example, a first frame of the reference audio channel, X, may be received at a first time ($m_1$). A first particular frame of the target audio channel, Y, may be received at a second time ($n_1$) corresponding to a first mismatch value, e.g., shift1=$n_1-m_1$. Further, a second frame of the reference audio channel may be received at a third time ($m_2$). A second particular frame of the target audio channel may be received at a fourth time ($n_2$) corresponding to a second mismatch value, e.g., shift2=$n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a mismatch value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally not aligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, a time of arrival of audio signals at the microphones from multiple sound sources (e.g., talkers) may vary when the multiple talkers are alternatively talking (e.g., without overlap). In such a case, the encoder may dynamically adjust a temporal mismatch value based on the talker to identify the reference channel. In some other examples, the multiple talkers may be talking at the same time, which may result in varying temporal mismatch values depending on who is the loudest talker, closest to the microphone, etc.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular mismatch value. The encoder may generate a first estimated mismatch value based on the comparison values. For example, the first estimated mismatch value may correspond to a comparison value indicating a higher temporal-similarity (or lower difference) between the first frame of the first audio signal and a corresponding first frame of the second audio signal.

The encoder may determine the final mismatch value by refining, in multiple stages, a series of estimated mismatch values. For example, the encoder may first estimate a "tentative" mismatch value based on comparison values generated from stereo pre-processed and re-sampled versions of the first audio signal and the second audio signal. The encoder may generate interpolated comparison values associated with mismatch values proximate to the estimated "tentative" mismatch value. The encoder may determine a second estimated "interpolated" mismatch value based on the interpolated comparison values. For example, the second estimated "interpolated" mismatch value may correspond to a particular interpolated comparison value that indicates a higher temporal-similarity (or lower difference) than the remaining interpolated comparison values and the first estimated "tentative" mismatch value. If the second estimated "interpolated" mismatch value of the current frame (e.g., the first frame of the first audio signal) is different than a final mismatch value of a previous frame (e.g., a frame of the first audio signal that precedes the first frame), then the "interpolated" mismatch value of the current frame is further "amended" to improve the temporal-similarity between the first audio signal and the shifted second audio signal. In particular, a third estimated "amended" mismatch value may correspond to a more accurate measure of temporal-similarity by searching around the second estimated "interpolated" mismatch value of the current frame and the final estimated mismatch value of the previous frame. The third estimated "amended" mismatch value is further conditioned to estimate the final mismatch value by limiting any spurious changes in the mismatch value between frames and further controlled to not switch from a negative mismatch value to a positive mismatch value (or vice versa) in two successive (or consecutive) frames as described herein.

In some examples, the encoder may refrain from switching between a positive mismatch value and a negative mismatch value or vice-versa in consecutive frames or in adjacent frames. For example, the encoder may set the final mismatch value to a particular value (e.g., 0) indicating no temporal-shift based on the estimated "interpolated" or "amended" mismatch value of the first frame and a corresponding estimated "interpolated" or "amended" or final mismatch value in a particular frame that precedes the first frame. To illustrate, the encoder may set the final mismatch value of the current frame (e.g., the first frame) to indicate no temporal-shift, i.e., shift1=0, in response to determining that one of the estimated "tentative" or "interpolated" or "amended" mismatch value of the current frame is positive and the other of the estimated "tentative" or "interpolated" or "amended" or "final" estimated mismatch value of the previous frame (e.g., the frame preceding the first frame) is negative. Alternatively, the encoder may also set the final mismatch value of the current frame (e.g., the first frame) to indicate no temporal-shift, i.e., shift1=0, in response to determining that one of the estimated "tentative" or "interpolated" or "amended" mismatch value of the current frame is negative and the other of the estimated "tentative" or "interpolated" or "amended" or "final" estimated mismatch value of the previous frame (e.g., the frame preceding the first frame) is positive.

The encoder may select a frame of the first audio signal or the second audio signal as a "reference" or "target" based on the mismatch value. For example, in response to determining that the final mismatch value is positive, the encoder may generate a reference channel or signal indicator having a first value (e.g., 0) indicating that the first audio signal is a "reference" signal and that the second audio signal is the "target" signal. Alternatively, in response to determining that the final mismatch value is negative, the encoder may generate the reference channel or signal indicator having a second value (e.g., 1) indicating that the second audio signal is the "reference" signal and that the first audio signal is the "target" signal.

The encoder may estimate a relative gain (e.g., a relative gain parameter) associated with the reference signal and the non-causal shifted target signal. For example, in response to determining that the final mismatch value is positive, the encoder may estimate a gain value to normalize or equalize the energy or power levels of the first audio signal relative to the second audio signal that is offset by the non-causal mismatch value (e.g., an absolute value of the final mismatch value). Alternatively, in response to determining that the final mismatch value is negative, the encoder may estimate a gain value to normalize or equalize the power levels of the non-causal shifted first audio signal relative to the second audio signal. In some examples, the encoder may estimate a gain value to normalize or equalize the energy or power levels of the "reference" signal relative to the non-causal shifted "target" signal. In other examples, the encoder may estimate the gain value (e.g., a relative gain value) based on the reference signal relative to the target signal (e.g., the un-shifted target signal).

The encoder may generate at least one encoded signal (e.g., a mid signal, a side signal, or both) based on the reference signal, the target signal, the non-causal mismatch value, and the relative gain parameter. The side signal may correspond to a difference between first samples of the first frame of the first audio signal and selected samples of a selected frame of the second audio signal. The encoder may select the selected frame based on the final mismatch value. Fewer bits may be used to encode the side channel because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal mismatch value, the relative gain parameter, the reference channel or signal indicator, or a combination thereof.

The encoder may generate at least one encoded signal (e.g., a mid signal, a side signal, or both) based on the reference signal, the target signal, the non-causal mismatch value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid signal, a side signal, or both, of the first frame. Encoding the mid signal, the side signal, or both, based on the low band parameters, the high band parameters, or a combination thereof, may improve estimates of the non-causal mismatch value and inter-channel relative gain parameter. The low band parameters, the high band parameters, or a combination thereof, may include a pitch parameter, a voicing parameter, a coder type parameter, a low-band energy parameter, a high-band energy parameter, a tilt parameter, a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal mismatch value, the relative gain parameter, the reference channel (or signal) indicator, or a combination thereof.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interfaces 112 may be coupled to a first microphone 146. A second input interface of the input interface(s) 112 may be coupled to a second microphone 148. The encoder 114 may include a temporal equalizer 108 and may be configured to down mix and encode multiple audio signals, as described herein. The first device 104 may also include a memory 153 configured to store analysis data 190. The second device 106 may include a decoder 118. The decoder 118 may include a temporal balancer 124 that is configured to up-mix and render the multiple channels. The second device 106 may be coupled to a first loudspeaker 142, a second loudspeaker 144, or both.

During operation, the first device 104 may receive a first audio signal 130 (e.g., a first channel) via the first input interface from the first microphone 146 and may receive a second audio signal 132 (e.g., a second channel) via the second input interface from the second microphone 148. As used herein, "signal" and "channel" may be used interchangeably. The first audio signal 130 may correspond to one of a right channel or a left channel. The second audio signal 132 may correspond to the other of the right channel or the left channel. In the example of FIG. 1, the first audio signal 130 is a reference channel and the second audio signal 132 is a target channel. Thus, according to the implementations described herein, the second audio signal 132 may be adjusted to temporally align with the first audio signal 130. However, as described below, in other implementations, the first audio signal 130 may be the target channel and the second audio signal 132 may be the reference channel.

A sound source 152 (e.g., a user, a speaker, ambient noise, a musical instrument, etc.) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio signal 130 and the second audio signal 132.

The temporal equalizer 108 may be configured to estimate a temporal offset between audio captured at the microphones 146, 148. The temporal offset may be estimated based on a delay between a first frame 131 (e.g., a "reference frame") of the first audio signal 130 and a second frame 133 (e.g., a "target frame") of the second audio signal 132, where the second frame 133 includes substantially similar content as the first frame 131. For example, the temporal equalizer 108 may determine a cross-correlation between the first frame 131 and the second frame 133. The cross-correlation may measure the similarity of the two frames as a function of the lag of one frame relative to the other. Based on the cross-correlation, the temporal equalizer 108 may determine the delay (e.g., lag) between the first frame 131 and the second frame 133. The temporal equalizer 108 may estimate the temporal offset between the first audio signal 130 and the second audio signal 132 based on the delay and historical delay data.

The historical data may include delays between frames captured from the first microphone 146 and corresponding frames captured from the second microphone 148. For example, the temporal equalizer 108 may determine a cross-correlation (e.g., a lag) between previous frames associated with the first audio signal 130 and corresponding frames associated with the second audio signal 132. Each lag may be represented by a "comparison value". That is, a comparison value may indicate a time shift (k) between a frame of the first audio signal 130 and a corresponding frame of the second audio signal 132. According to one implementation, the comparison values for previous frames may be stored at the memory 153. A smoother 190 of the temporal equalizer 108 may "smooth" (or average) comparison values over a long-term set of frames and use the long-term smoothed comparison values for estimating a temporal offset (e.g., "shift") between the first audio signal 130 and the second audio signal 132.

To illustrate, if $CompVal_N(k)$ represents the comparison value at a shift of k for the frame N, the frame N may have comparison values from k=T_MIN (a minimum shift) to k=T_MAX (a maximum shift). The smoothing may be performed such that a long-term comparison value $CompVal_{LT_N}(k)$ is represented by $CompVal_{LT_N}(k)=f(CompVal_N(k), CompVal_{N-1}(k), CompVal_{LT_{N-2}}(k), \ldots)$. The function fin the above equation may be a function of all (or a subset) of past comparison values at the shift (k). An alternative representation of the may be $CompVal_{LT_N}(k)=g(CompVal_N(k), CompVal_{N-1}(k), CompVal_{N-2}(k), \ldots)$. The functions for g may be simple finite impulse response (FIR) filters or infinite impulse response (IIR) filters, respectively. For example, the function g may be a single tap IIR filter such that the long-term comparison value $CompVal_{LT_N}(k)$ is represented by $CompVal_{LT_N}(k)=(1-\alpha)*CompVal_N(k), +(\alpha)*CompVal_{LT_{N-1}}(k)$, where $\alpha\in(0, 1.0)$. Thus, the long-term comparison value $CompVal_{LT_N}(k)$ may be based on a weighted mixture of the instantaneous comparison value $CompVal_N(k)$ at frame N and the long-term comparison values $CompVal_{LT_{N-1}}(k)$ for one or more previous frames. As the value of a increases, the amount of smoothing in the long-term comparison value increases. In some implementations, the comparison values may be normalized cross-correlation values. In other implementations, the comparison values may be non-normalized cross-correlation values.

The smoothing techniques described above may substantially normalize the shift estimate between voiced frames, unvoiced frames, and transition frames. Normalized shift estimates may reduce sample repetition and artifact skipping at frame boundaries. Additionally, normalized shift estimates may result in reduced side channel energies, which may improve coding efficiency.

The temporal equalizer 108 may determine a final mismatch value 116 (e.g., a non-causal mismatch value) indicative of the shift (e.g., a non-causal mismatch or a non-causal shift) of the first audio signal 130 (e.g., "reference") relative to the second audio signal 132 (e.g., "target"). The final mismatch value 116 may be based on the instantaneous comparison value $CompVal_N(k)$ and the long-term comparison $CompVal_{LT_{N-1}}(k)$. For example, the smoothing operation described above may be performed on a tentative mismatch value, on an interpolated mismatch value, on an amended mismatch value, or a combination thereof, as described with respect to FIG. 5. The first mismatch value 116 may be based on the tentative mismatch value, the interpolated mismatch value, and the amended mismatch value, as described with respect to FIG. 5. A first value (e.g., a positive value) of the final mismatch value 116 may indicate that the second audio signal 132 is delayed relative to the first audio signal 130. A second value (e.g., a negative value) of the final mismatch value 116 may indicate that the first audio signal 130 is delayed relative to the second audio signal 132. A third value (e.g., 0) of the final mismatch value 116 may indicate no delay between the first audio signal 130 and the second audio signal 132.

In some implementations, the third value (e.g., 0) of the final mismatch value 116 may indicate that delay between the first audio signal 130 and the second audio signal 132 has switched sign. For example, a first particular frame of the first audio signal 130 may precede the first frame 131. The first particular frame and a second particular frame of the second audio signal 132 may correspond to the same sound emitted by the sound source 152. The delay between the first audio signal 130 and the second audio signal 132 may switch from having the first particular frame delayed with respect to the second particular frame to having the second frame 133 delayed with respect to the first frame 131. Alternatively, the delay between the first audio signal 130 and the second audio signal 132 may switch from having the second particular frame delayed with respect to the first particular frame to having the first frame 131 delayed with respect to the second frame 133. The temporal equalizer 108 may set the final mismatch value 116 to indicate the third value (e.g., 0) in response to determining that the delay between the first audio signal 130 and the second audio signal 132 has switched sign.

The temporal equalizer 108 may generate a reference signal indicator 164 based on the final mismatch value 116. For example, the temporal equalizer 108 may, in response to determining that the final mismatch value 116 indicates a first value (e.g., a positive value), generate the reference signal indicator 164 to have a first value (e.g., 0) indicating that the first audio signal 130 is a "reference" signal. The temporal equalizer 108 may determine that the second audio signal 132 corresponds to a "target" signal in response to determining that the final mismatch value 116 indicates the first value (e.g., a positive value). Alternatively, the temporal equalizer 108 may, in response to determining that the final mismatch value 116 indicates a second value (e.g., a negative value), generate the reference signal indicator 164 to have a second value (e.g., 1) indicating that the second audio signal 132 is the "reference" signal. The temporal equalizer 108 may determine that the first audio signal 130 corresponds to the "target" signal in response to determining that the final mismatch value 116 indicates the second value (e.g., a negative value). The temporal equalizer 108 may, in response to determining that the final mismatch value 116 indicates a third value (e.g., 0), generate the reference signal indicator 164 to have a first value (e.g., 0) indicating that the first audio signal 130 is a "reference" signal. The temporal equalizer 108 may determine that the second audio signal 132 corresponds to a "target" signal in response to determining that the final mismatch value 116 indicates the third value (e.g., 0). Alternatively, the temporal equalizer 108 may, in response to determining that the final mismatch value 116 indicates the third value (e.g., 0), generate the reference signal indicator 164 to have a second value (e.g., 1) indicating that the second audio signal 132 is a "reference" signal. The temporal equalizer 108 may determine that the first audio signal 130 corresponds to a "target" signal in response to determining that the final mismatch value 116 indicates the third value (e.g., 0). In some implementations, the temporal equalizer 108 may, in response to determining that the final mismatch value 116 indicates a third value (e.g., 0), leave the reference signal indicator 164 unchanged. For example, the reference signal indicator 164 may be the same as a reference signal indicator corresponding to the first particular frame of the first audio signal 130. The temporal equalizer 108 may generate a non-causal mismatch value 162 indicating an absolute value of the final mismatch value 116.

The temporal equalizer 108 may generate a gain parameter 160 (e.g., a codec gain parameter) based on samples of the "target" signal and based on samples of the "reference" signal. For example, the temporal equalizer 108 may select samples of the second audio signal 132 based on the non-causal mismatch value 162. Alternatively, the temporal equalizer 108 may select samples of the second audio signal 132 independent of the non-causal mismatch value 162. The temporal equalizer 108 may, in response to determining that the first audio signal 130 is the reference signal, determine the gain parameter 160 of the selected samples based on the first samples of the first frame 131 of the first audio signal 130. Alternatively, the temporal equalizer 108 may, in response to determining that the second audio signal 132 is the reference signal, determine the gain parameter 160 of the first samples based on the selected samples. As an example, the gain parameter 160 may be based on one of the following Equations:

$$g_D = \frac{\sum_{n=0}^{N-N1} Ref(n)Targ(n+N_1)}{\sum_{n=0}^{N-N1} Targ^2(n+N_1)}, \quad \text{Equation 1a}$$

$$g_D = \frac{\sum_{n=0}^{N-N1} |Ref(n)|}{\sum_{n=0}^{N-N1} |Targ(n+N_1)|}, \quad \text{Equation 1b}$$

$$g_D = \frac{\sum_{n=0}^{N} Ref(n)Targ(n)}{\sum_{n=0}^{N} Targ^2(n)}, \quad \text{Equation 1c}$$

$$g_D = \frac{\sum_{n=0}^{N} |Ref(n)|}{\sum_{n=0}^{N} |Targ(n)|}, \quad \text{Equation 1d}$$

$$g_D = \frac{\sum_{n=0}^{N-N1} Ref(n)Targ(n)}{\sum_{n=0}^{N} Ref^2(n)}, \quad \text{Equation 1e}$$

-continued $$g_D = \frac{\sum_{n=0}^{N-N1} |Targ(n)|}{\sum_{n=0}^{N} |Ref(n)|}, \quad \text{Equation 1f}$$

where $g_D$ corresponds to the relative gain parameter 160 for down mix processing, Ref(n) corresponds to samples of the "reference" signal, $N_1$ corresponds to the non-causal mismatch value 162 of the first frame 131, and Targ(n+$N_1$) corresponds to samples of the "target" signal. The gain parameter 160 ($g_D$) may be modified, e.g., based on one of the Equations 1a-1f, to incorporate long term smoothing/hysteresis logic to avoid large jumps in gain between frames. When the target signal includes the first audio signal 130, the first samples may include samples of the target signal and the selected samples may include samples of the reference signal. When the target signal includes the second audio signal 132, the first samples may include samples of the reference signal, and the selected samples may include samples of the target signal.

In some implementations, the temporal equalizer 108 may generate the gain parameter 160 based on treating the first audio signal 130 as a reference signal and treating the second audio signal 132 as a target signal, irrespective of the reference signal indicator 164. For example, the temporal equalizer 108 may generate the gain parameter 160 based on one of the Equations 1a-1f where Ref(n) corresponds to samples (e.g., the first samples) of the first audio signal 130 and Targ(n+$N_1$) corresponds to samples (e.g., the selected samples) of the second audio signal 132. In alternate implementations, the temporal equalizer 108 may generate the gain parameter 160 based on treating the second audio signal 132 as a reference signal and treating the first audio signal 130 as a target signal, irrespective of the reference signal indicator 164. For example, the temporal equalizer 108 may generate the gain parameter 160 based on one of the Equations 1a-1f where Ref(n) corresponds to samples (e.g., the selected samples) of the second audio signal 132 and Targ (n+$N_1$) corresponds to samples (e.g., the first samples) of the first audio signal 130.

The temporal equalizer 108 may generate one or more encoded signals 102 (e.g., a mid channel, a side channel, or both) based on the first samples, the selected samples, and the relative gain parameter 160 for down mix processing. For example, the temporal equalizer 108 may generate the mid signal based on one of the following Equations:

$$M = \text{Ref}(n) + g_D \text{Targ}(n+N_1), \quad \text{Equation 2a}$$

$$M = \text{Ref}(n) + \text{Targ}(n+N_1), \quad \text{Equation 2b}$$

where M corresponds to the mid channel, $g_D$ corresponds to the relative gain parameter 160 for downmix processing, Ref(n) corresponds to samples of the "reference" signal, $N_1$ corresponds to the non-causal mismatch value 162 of the first frame 131, and Targ(n+$N_1$) corresponds to samples of the "target" signal.

The temporal equalizer 108 may generate the side channel based on one of the following Equations:

$$S = \text{Ref}(n) - g_D \text{Targ}(n+N_1), \quad \text{Equation 3a}$$

$$S = g_p \text{Ref}(n) - \text{Targ}(n+N_1), \quad \text{Equation 3b}$$

where S corresponds to the side channel, $g_D$ corresponds to the relative gain parameter 160 for down-mix processing, Ref(n) corresponds to samples of the "reference" signal, $N_1$ corresponds to the non-causal mismatch value 162 of the first frame 131, and Targ(n+$N_1$) corresponds to samples of the "target" signal.

The transmitter 110 may transmit the encoded signals 102 (e.g., the mid channel, the side channel, or both), the reference signal indicator 164, the non-causal mismatch value 162, the gain parameter 160, or a combination thereof, via the network 120, to the second device 106. In some implementations, the transmitter 110 may store the encoded signals 102 (e.g., the mid channel, the side channel, or both), the reference signal indicator 164, the non-causal mismatch value 162, the gain parameter 160, or a combination thereof, at a device of the network 120 or a local device for further processing or decoding later.

The decoder 118 may decode the encoded signals 102. The temporal balancer 124 may perform up-mixing to generate a first output signal 126 (e.g., corresponding to first audio signal 130), a second output signal 128 (e.g., corresponding to the second audio signal 132), or both. The second device 106 may output the first output signal 126 via the first loudspeaker 142. The second device 106 may output the second output signal 128 via the second loudspeaker 144.

The system 100 may thus enable the temporal equalizer 108 to encode the side channel using fewer bits than the mid signal. The first samples of the first frame 131 of the first audio signal 130 and selected samples of the second audio signal 132 may correspond to the same sound emitted by the sound source 152 and hence a difference between the first samples and the selected samples may be lower than between the first samples and other samples of the second audio signal 132. The side channel may correspond to the difference between the first samples and the selected samples.

Figure 2:
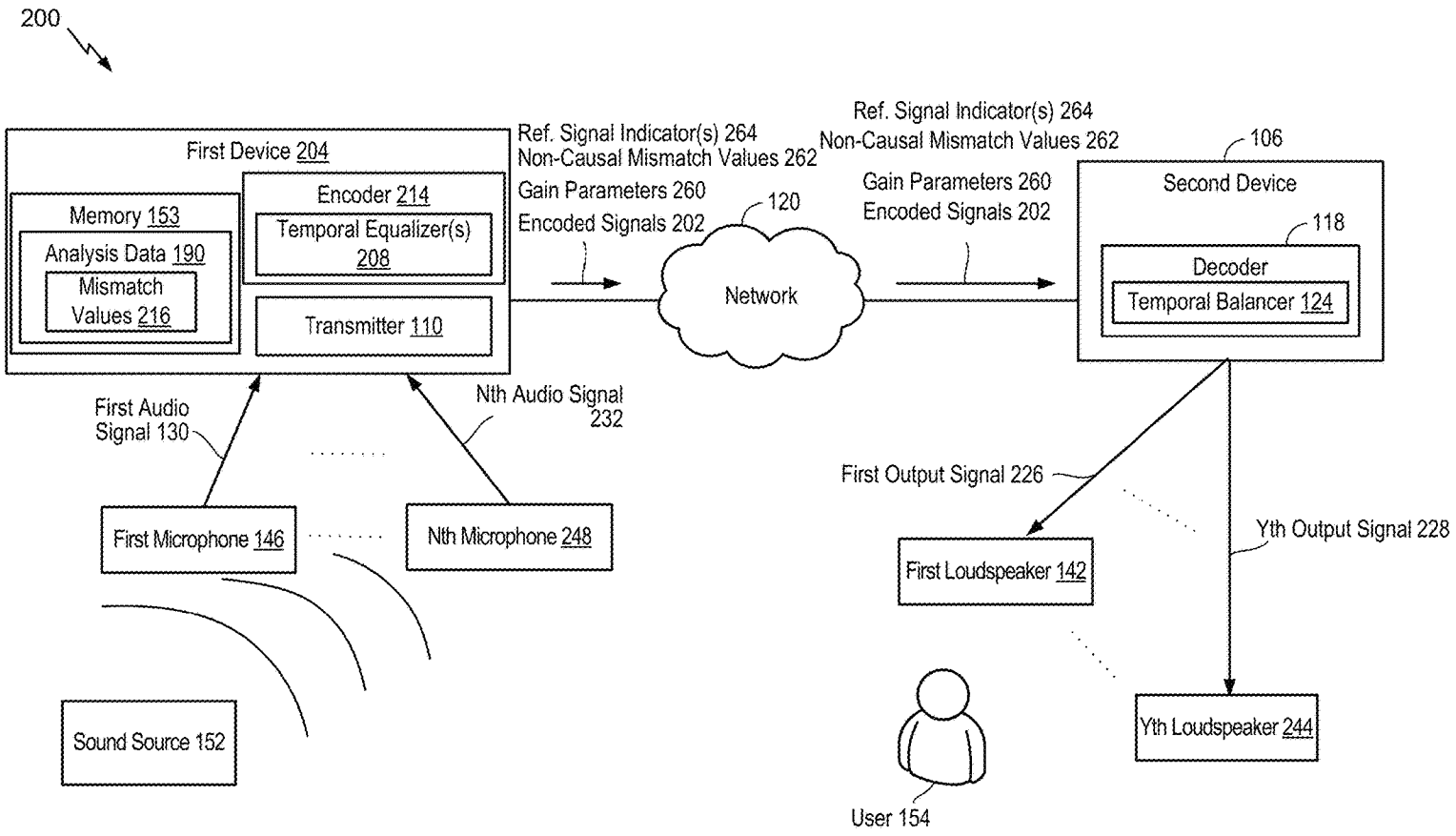
FIG. 2 is a diagram illustrating another example of a system that includes the device of FIG. 1.

Referring to FIG. 2, a particular illustrative implementation of a system is disclosed and generally designated 200. The system 200 includes a first device 204 coupled, via the network 120, to the second device 106. The first device 204 may correspond to the first device 104 of FIG. 1 The system 200 differs from the system 100 of FIG. 1 in that the first device 204 is coupled to more than two microphones. For example, the first device 204 may be coupled to the first microphone 146, an Nth microphone 248, and one or more additional microphones (e.g., the second microphone 148 of FIG. 1). The second device 106 may be coupled to the first loudspeaker 142, a Yth loudspeaker 244, one or more additional speakers (e.g., the second loudspeaker 144), or a combination thereof. The first device 204 may include an encoder 214. The encoder 214 may correspond to the encoder 114 of FIG. 1. The encoder 214 may include one or more temporal equalizers 208. For example, the temporal equalizer(s) 208 may include the temporal equalizer 108 of FIG. 1.

During operation, the first device 204 may receive more than two audio signals. For example, the first device 204 may receive the first audio signal 130 via the first microphone 146, an Nth audio signal 232 via the Nth microphone 248, and one or more additional audio signals (e.g., the second audio signal 132) via the additional microphones (e.g., the second microphone 148).

The temporal equalizer(s) 208 may generate one or more reference signal indicators 264, final mismatch values 216, non-causal mismatch values 262, gain parameters 260, encoded signals 202, or a combination thereof. For example, the temporal equalizer(s) 208 may determine that the first audio signal 130 is a reference signal and that each of the Nth audio signal 232 and the additional audio signals is a target signal. The temporal equalizer(s) 208 may generate the reference signal indicator 164, the final mismatch values 216, the non-causal mismatch values 262, the gain parameters 260, and the encoded signals 202 corresponding to the first audio signal 130 and each of the Nth audio signal 232 and the additional audio signals.

The reference signal indicators 264 may include the reference signal indicator 164. The final mismatch values 216 may include the final mismatch value 116 indicative of a shift of the second audio signal 132 relative to the first audio signal 130, a second final mismatch value indicative of a shift of the Nth audio signal 232 relative to the first audio signal 130, or both. The non-causal mismatch values 262 may include the non-causal mismatch value 162 corresponding to an absolute value of the final mismatch value 116, a second non-causal mismatch value corresponding to an absolute value of the second final mismatch value, or both. The gain parameters 260 may include the gain parameter 160 of selected samples of the second audio signal 132, a second gain parameter of selected samples of the Nth audio signal 232, or both. The encoded signals 202 may include at least one of the encoded signals 102. For example, the encoded signals 202 may include the side channel corresponding to first samples of the first audio signal 130 and selected samples of the second audio signal 132, a second side channel corresponding to the first samples and selected samples of the Nth audio signal 232, or both. The encoded signals 202 may include a mid channel corresponding to the first samples, the selected samples of the second audio signal 132, and the selected samples of the Nth audio signal 232.

In some implementations, the temporal equalizer(s) 208 may determine multiple reference signals and corresponding target signals, as described with reference to FIG. 15. For example, the reference signal indicators 264 may include a reference signal indicator corresponding to each pair of reference signal and target signal. To illustrate, the reference signal indicators 264 may include the reference signal indicator 164 corresponding to the first audio signal 130 and the second audio signal 132. The final mismatch values 216 may include a final mismatch value corresponding to each pair of reference signal and target signal. For example, the final mismatch values 216 may include the final mismatch value 116 corresponding to the first audio signal 130 and the second audio signal 132. The non-causal mismatch values 262 may include a non-causal mismatch value corresponding to each pair of reference signal and target signal. For example, the non-causal mismatch values 262 may include the non-causal mismatch value 162 corresponding to the first audio signal 130 and the second audio signal 132. The gain parameters 260 may include a gain parameter corresponding to each pair of reference signal and target signal. For example, the gain parameters 260 may include the gain parameter 160 corresponding to the first audio signal 130 and the second audio signal 132. The encoded signals 202 may include a mid channel and a side channel corresponding to each pair of reference signal and target signal. For example, the encoded signals 202 may include the encoded signals 102 corresponding to the first audio signal 130 and the second audio signal 132.

The transmitter 110 may transmit the reference signal indicators 264, the non-causal mismatch values 262, the gain parameters 260, the encoded signals 202, or a combination thereof, via the network 120, to the second device 106. The decoder 118 may generate one or more output signals based on the reference signal indicators 264, the non-causal mismatch values 262, the gain parameters 260, the encoded signals 202, or a combination thereof. For example, the decoder 118 may output a first output signal 226 via the first loudspeaker 142, a Yth output signal 228 via the Yth loudspeaker 244, one or more additional output signals (e.g., the second output signal 128) via one or more additional loudspeakers (e.g., the second loudspeaker 144), or a combination thereof.

The system 200 may thus enable the temporal equalizer(s) 208 to encode more than two audio signals. For example, the encoded signals 202 may include multiple side channels that are encoded using fewer bits than corresponding mid channels by generating the side channels based on the non-causal mismatch values 262.

Figure 3:
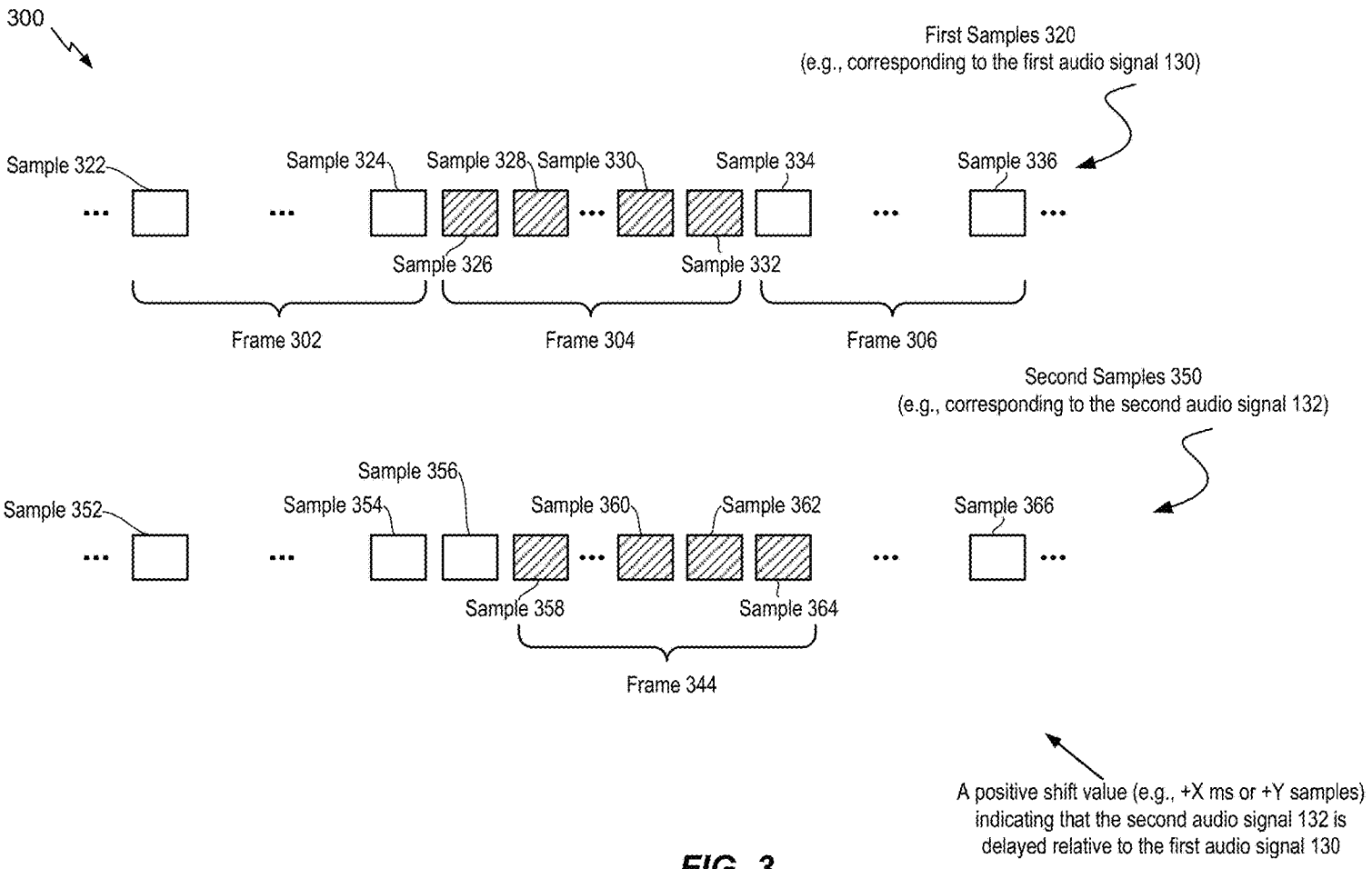
FIG. 3 is a diagram illustrating particular examples of samples that may be encoded by the device of FIG. 1.

Referring to FIG. 3, illustrative examples of samples are shown and generally designated 300. At least a subset of the samples 300 may be encoded by the first device 104, as described herein.

The samples 300 may include first samples 320 corresponding to the first audio signal 130, second samples 350 corresponding to the second audio signal 132, or both. The first samples 320 may include a sample 322, a sample 324, a sample 326, a sample 328, a sample 330, a sample 332, a sample 334, a sample 336, one or more additional samples, or a combination thereof. The second samples 350 may include a sample 352, a sample 354, a sample 356, a sample 358, a sample 360, a sample 362, a sample 364, a sample 366, one or more additional samples, or a combination thereof.

The first audio signal 130 may correspond to a plurality of frames (e.g., a frame 302, a frame 304, a frame 306, or a combination thereof). Each of the plurality of frames may correspond to a subset of samples (e.g., corresponding to 20 ms, such as 640 samples at 32 kHz or 960 samples at 48 kHz) of the first samples 320. For example, the frame 302 may correspond to the sample 322, the sample 324, one or more additional samples, or a combination thereof. The frame 304 may correspond to the sample 326, the sample 328, the sample 330, the sample 332, one or more additional samples, or a combination thereof. The frame 306 may correspond to the sample 334, the sample 336, one or more additional samples, or a combination thereof.

The sample 322 may be received at the input interface(s) 112 of FIG. 1 at approximately the same time as the sample 352. The sample 324 may be received at the input interface(s) 112 of FIG. 1 at approximately the same time as the sample 354. The sample 326 may be received at the input interface(s) 112 of FIG. 1 at approximately the same time as the sample 356. The sample 328 may be received at the input interface(s) 112 of FIG. 1 at approximately the same time as the sample 358. The sample 330 may be received at the input interface(s) 112 of FIG. 1 at approximately the same time as the sample 360. The sample 332 may be received at the input interface(s) 112 of FIG. 1 at approximately the same time as the sample 362. The sample 334 may be received at the input interface(s) 112 of FIG. 1 at approximately the same time as the sample 364. The sample 336 may be received at the input interface(s) 112 of FIG. 1 at approximately the same time as the sample 366.

A first value (e.g., a positive value) of the final mismatch value 116 may indicate that the second audio signal 132 is delayed relative to the first audio signal 130. For example, a first value (e.g., +X ms or +Y samples, where X and Y include positive real numbers) of the final mismatch value 116 may indicate that the frame 304 (e.g., the samples 326-332) correspond to the samples 358-364. The samples 326-332 and the samples 358-364 may correspond to the same sound emitted from the sound source 152. The samples 358-364 may correspond to a frame 344 of the second audio signal 132. Illustration of samples with cross-hatching in one or more of FIGS. 1-15 may indicate that the samples correspond to the same sound. For example, the samples 326-332 and the samples 358-364 are illustrated with cross-hatching in FIG. 3 to indicate that the samples 326-332 (e.g., the frame 304) and the samples 358-364 (e.g., the frame 344) correspond to the same sound emitted from the sound source 152.

It should be understood that a temporal offset of Y samples, as shown in FIG. 3, is illustrative. For example, the temporal offset may correspond to a number of samples, Y, that is greater than or equal to 0. In a first case where the temporal offset Y=0 samples, the samples 326-332 (e.g., corresponding to the frame 304) and the samples 356-362 (e.g., corresponding to the frame 344) may show high similarity without any frame offset. In a second case where the temporal offset Y=2 samples, the frame 304 and frame 344 may be offset by 2 samples. In this case, the first audio signal 130 may be received prior to the second audio signal 132 at the input interface(s) 112 by Y=2 samples or X=(2/Fs) ms, where Fs corresponds to the sample rate in kHz. In some cases, the temporal offset, Y, may include a non-integer value, e.g., Y=1.6 samples corresponding to X=0.05 ms at 32 kHz.

The temporal equalizer 108 of FIG. 1 may generate the encoded signals 102 by encoding the samples 326-332 and the samples 358-364, as described with reference to FIG. 1. The temporal equalizer 108 may determine that the first audio signal 130 corresponds to a reference signal and that the second audio signal 132 corresponds to a target signal.

Figure 4:
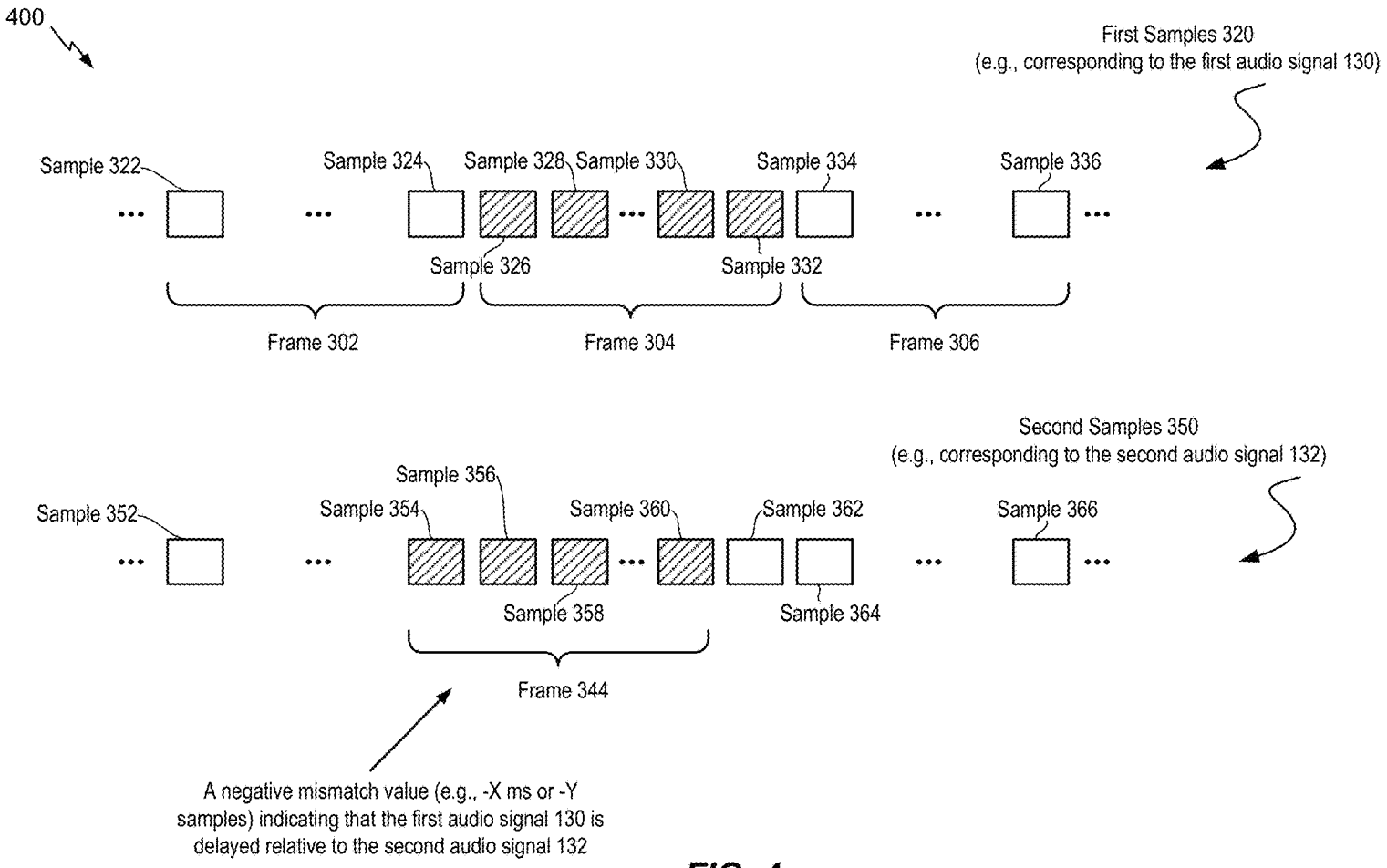
FIG. 4 is a diagram illustrating particular examples of samples that may be encoded by the device of FIG. 1.

Referring to FIG. 4, illustrative examples of samples are shown and generally designated as 400. The examples 400 differ from the examples 300 in that the first audio signal 130 is delayed relative to the second audio signal 132.

A second value (e.g., a negative value) of the final mismatch value 116 may indicate that the first audio signal 130 is delayed relative to the second audio signal 132. For example, the second value (e.g., −X ms or −Y samples, where X and Y include positive real numbers) of the final mismatch value 116 may indicate that the frame 304 (e.g., the samples 326-332) correspond to the samples 354-360. The samples 354-360 may correspond to the frame 344 of the second audio signal 132. The samples 354-360 (e.g., the frame 344) and the samples 326-332 (e.g., the frame 304) may correspond to the same sound emitted from the sound source 152.

It should be understood that a temporal offset of −Y samples, as shown in FIG. 4, is illustrative. For example, the temporal offset may correspond to a number of samples, −Y, that is less than or equal to 0. In a first case where the temporal offset Y=0 samples, the samples 326-332 (e.g., corresponding to the frame 304) and the samples 356-362 (e.g., corresponding to the frame 344) may show high similarity without any frame offset. In a second case where the temporal offset Y=−6 samples, the frame 304 and frame 344 may be offset by 6 samples. In this case, the first audio signal 130 may be received subsequent to the second audio signal 132 at the input interface(s) 112 by Y=−6 samples or X=(−6/Fs) ms, where Fs corresponds to the sample rate in kHz. In some cases, the temporal offset, Y, may include a non-integer value, e.g., Y=−3.2 samples corresponding to X=−0.1 ms at 32 kHz.

The temporal equalizer 108 of FIG. 1 may generate the encoded signals 102 by encoding the samples 354-360 and the samples 326-332, as described with reference to FIG. 1. The temporal equalizer 108 may determine that the second audio signal 132 corresponds to a reference signal and that the first audio signal 130 corresponds to a target signal. In particular, the temporal equalizer 108 may estimate the non-causal mismatch value 162 from the final mismatch value 116, as described with reference to FIG. 5. The temporal equalizer 108 may identify (e.g., designate) one of the first audio signal 130 or the second audio signal 132 as a reference signal and the other of the first audio signal 130 or the second audio signal 132 as a target signal based on a sign of the final mismatch value 116.

Figure 5:
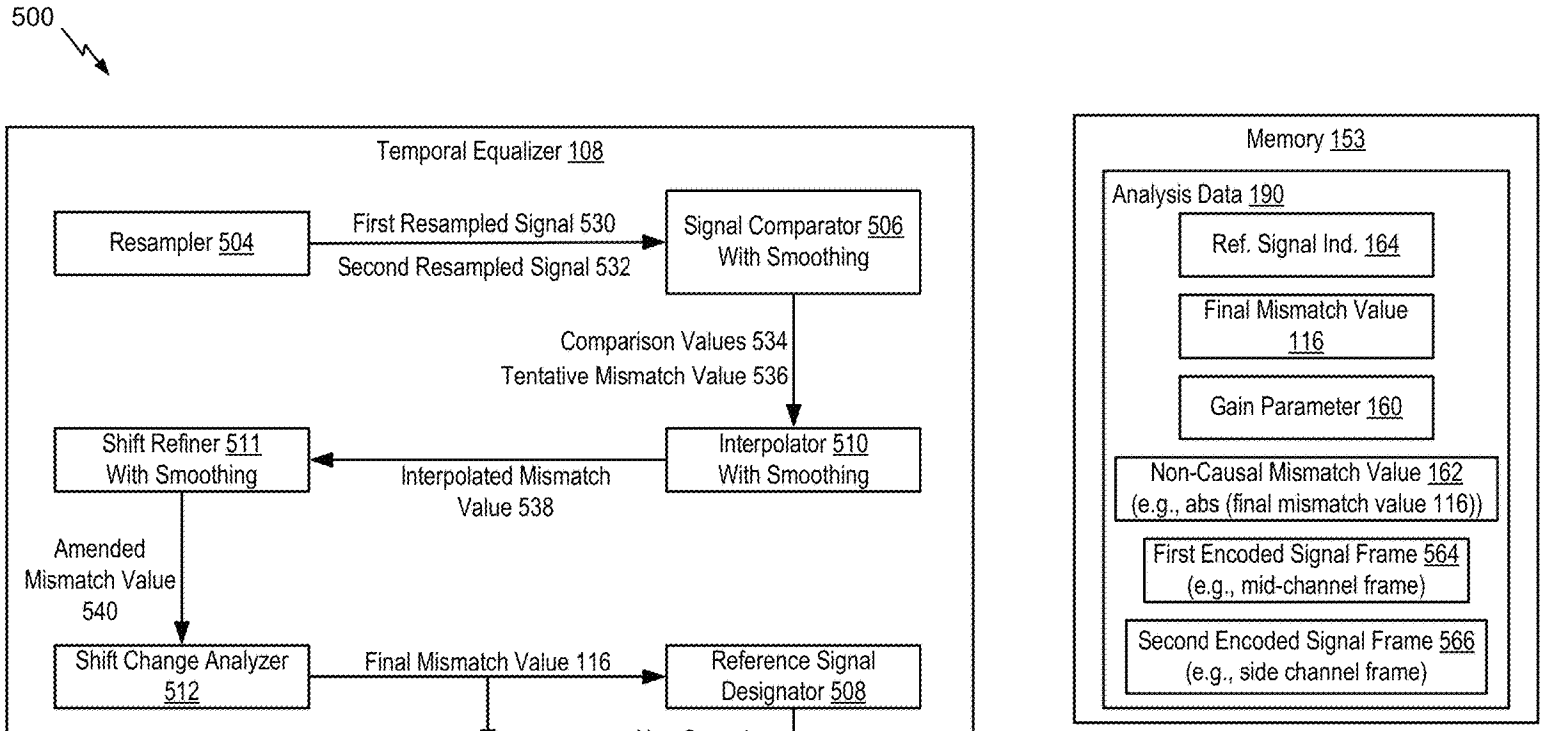
FIG. 5 is a diagram illustrating another example of a system operable to encode multiple channels.

Referring to FIG. 5, an illustrative example of a system is shown and generally designated 500. The system 500 may correspond to the system 100 of FIG. 1. For example, the system 100, the first device 104 of FIG. 1, or both, may include one or more components of the system 500. The temporal equalizer 108 may include a resampler 504, a signal comparator 506, an interpolator 510, a shift refiner 511, a shift change analyzer 512, an absolute shift generator 513, a reference signal designator 508, a gain parameter generator 514, a signal generator 516, or a combination thereof.

During operation, the resampler 504 may generate one or more resampled signals, as further described with reference to FIG. 6. For example, the resampler 504 may generate a first resampled signal 530 by resampling (e.g., down-sampling or up-sampling) the first audio signal 130 based on a resampling (e.g., down-sampling or up-sampling) factor (D) (e.g., ≥1). The resampler 504 may generate a second resampled signal 532 by resampling the second audio signal 132 based on the resampling factor (D). The resampler 504 may provide the first resampled signal 530, the second resampled signal 532, or both, to the signal comparator 506.

The signal comparator 506 may generate comparison values 534 (e.g., difference values, similarity values, coherence values, or cross-correlation values), a tentative mismatch value 536, or both, as further described with reference to FIG. 7. For example, the signal comparator 506 may generate the comparison values 534 based on the first resampled signal 530 and a plurality of mismatch values applied to the second resampled signal 532, as further described with reference to FIG. 7. The signal comparator 506 may determine the tentative mismatch value 536 based on the comparison values 534, as further described with reference to FIG. 7. According to one implementation, the signal comparator 506 may retrieve comparison values for previous frames of the resampled signals 530, 532 and may modify the comparison values 534 based on a long-term smoothing operation using the comparison values for previous frames. For example, the comparison values 534 may include the long-term comparison value $CompVal_{LT_N}(k)$ for a current frame (N) and may be represented by $CompVal_{LT_N}(k)=(1-\alpha)*CompVal_N(k), +(\alpha)*CompVal_{LT_{N-1}}(k)$, where $\alpha\in(0, 1.0)$. Thus, the long-term comparison value $CompVal_{LT_N}(k)$ may be based on a weighted mixture of the instantaneous comparison value $CompVal_N(k)$ at frame N and the long-term comparison values $CompVal_{LT_{N-1}}(k)$ for one or more previous frames. As the value of α increases, the amount of smoothing in the long-term comparison value increases. The smoothing parameters (e.g., the value of the α) may be controlled/adapted to limit the smoothing of comparison values during silence portions (or during background noise which may cause drift in the shift estimation). For example, the comparison values may be smoothed based on a higher smoothing factor (e.g., α=0.995); otherwise the smoothing can be based on α=0.9. The control of the smoothing parameters (e.g., α) may be based on whether the background energy or long-term energy is below a threshold, based on a coder type, or based on comparison value statistics.

In a particular implementation, the value of the smoothing parameters (e.g., α) may be based on the short term signal level ($E_{ST}$) and the long term signal level ($E_{LT}$) of the channels. As an example the short term signal level may be calculated for the frame (N) being processed ($E_{ST}(N)$) as the sum of the sum of the absolute values of the downsampled reference samples and the sum of the absolute values of the downsampled target samples. The long term signal level may be a smoothed version of the short term signal levels. For example, $E_{LT}(N)=0.6*E_{LT}(N-1)+0.4*E_{ST}(N)$. Further, the value of the smoothing parameters (e.g., α) may be controlled according to a pseudo-code described as follows Set α to an initial value (e.g., 0.95).

if $E_{ST}>4*E_{LT}$, modify the value of α (e.g., α=0.5)

if $E_{ST}>2*E_{LT}$ and $E_{ST}\leq 4*E_{LT}$, modify the value of α (e.g., α=0.7)

In a particular implementation, the value of the smoothing parameters (e.g., α) may be controlled based on the correlation of the short term and the long term comparison values. For example, when the comparison values of the current frame are very similar to the long term smoothed comparison values, it is an indication of a stationary talker and this could be used to control the smoothing parameters to further increase the smoothing (e.g., increase the value of α). On the other hand, when the comparison values as a function of the various shift values does not resemble the long term comparison values, the smoothing parameters can be adjusted (e.g., adapted) to reduce smoothing (e.g., decrease the value of α).

Further, the short term comparison values ($CompVal_{ST_N}(k)$) may be estimated as a smoothed version of the comparison values of the frames in vicinity of the current frame being processed. Ex:

$$CompVal_{ST_N}(k) = \frac{(CompVal_N(k) + CompVal_{N-1}(k) + CompVal_{N-2}(k))}{3}.$$

In other implementations, the short term comparison values may be the same as the comparison values generated in the frame being processed ($CompVal_{LT_{N-1}}(k)$).

Further, cross correlation of the short term and the long term comparison values ($CrossCorr_CompVal_N$) may be a single value estimated per each frame (N) which is calculated as $CrossCorr_CompVal_N=(\Sigma_k\ CompVal_{ST_N}(k)*CompVal_{LT_{N-1}}(k))/Fac$. Where Fac is a normalization factor chosen such that the $CrossCorr_CompVal_N$ is restricted between 0 and 1. As an example, Fac can be calculated as:

$$Fac = \sqrt{\left(\sum_k CompVal_{ST_N}(k) * CompVal_{ST_N}(k)\right) * \left(\sum_k CompVal_{LT_{N-1}}(k) * CompVal_{LT_{N-1}}(k)\right)}$$

The first resampled signal 530 may include fewer samples or more samples than the first audio signal 130. The second resampled signal 532 may include fewer samples or more samples than the second audio signal 132. Determining the comparison values 534 based on the fewer samples of the resampled signals (e.g., the first resampled signal 530 and the second resampled signal 532) may use fewer resources (e.g., time, number of operations, or both) than on samples of the original signals (e.g., the first audio signal 130 and the second audio signal 132). Determining the comparison values 534 based on the more samples of the resampled signals (e.g., the first resampled signal 530 and the second resampled signal 532) may increase precision than on samples of the original signals (e.g., the first audio signal 130 and the second audio signal 132). The signal comparator 506 may provide the comparison values 534, the tentative mismatch value 536, or both, to the interpolator 510.

The interpolator 510 may extend the tentative mismatch value 536. For example, the interpolator 510 may generate an interpolated mismatch value 538, as further described with reference to FIG. 8. For example, the interpolator 510 may generate interpolated comparison values corresponding to mismatch values that are proximate to the tentative mismatch value 536 by interpolating the comparison values 534. The interpolator 510 may determine the interpolated mismatch value 538 based on the interpolated comparison values and the comparison values 534. The comparison values 534 may be based on a coarser granularity of the mismatch values. For example, the comparison values 534 may be based on a first subset of a set of mismatch values so that a difference between a first mismatch value of the first subset and each second mismatch value of the first subset is greater than or equal to a threshold (e.g., ≥1). The threshold may be based on the resampling factor (D).

The interpolated comparison values may be based on a finer granularity of mismatch values that are proximate to the resampled tentative mismatch value 536. For example, the interpolated comparison values may be based on a second subset of the set of mismatch values so that a difference between a highest mismatch value of the second subset and the resampled tentative mismatch value 536 is less than the threshold (e.g., ≥1), and a difference between a lowest mismatch value of the second subset and the resampled tentative mismatch value 536 is less than the threshold. Determining the comparison values 534 based on the coarser granularity (e.g., the first subset) of the set of mismatch values may use fewer resources (e.g., time, operations, or both) than determining the comparison values 534 based on a finer granularity (e.g., all) of the set of mismatch values. Determining the interpolated comparison values corresponding to the second subset of mismatch values may extend the tentative mismatch value 536 based on a finer granularity of a smaller set of mismatch values that are proximate to the tentative mismatch value 536 without determining comparison values corresponding to each mismatch value of the set of mismatch values. Thus, determining the tentative mismatch value 536 based on the first subset of mismatch values and determining the interpolated mismatch value 538 based on the interpolated comparison values may balance resource usage and refinement of the estimated mismatch value. The interpolator 510 may provide the interpolated mismatch value 538 to the shift refiner 511.

According to one implementation, the interpolator 510 may retrieve interpolated mismatch/comparison values for previous frames and may modify the interpolated mismatch/comparison value 538 based on a long-term smoothing operation using the interpolated mismatch/comparison values for previous frames. For example, the interpolated mismatch/comparison value 538 may include a long-term interpolated mismatch/comparison value $InterVal_{LT_N}(k)$ for a current frame (N) and may be represented by $InterVal_{LT_N}(k)=(1-\alpha)*InterVal_N(k), +(\alpha)*InterVal_{LT_{N-1}}(k)$, where $\alpha\in(0, 1.0)$. Thus, the long-term interpolated mismatch/comparison value $InterVal_{LT_N}(k)$ may be based on a weighted mixture of the instantaneous interpolated mismatch/comparison value $InterVal_N(k)$ at frame N and the long-term interpolated mismatch/comparison values $InterVal_{LT_{N-1}}(k)$ for one or more previous frames. As the value of a increases, the amount of smoothing in the long-term comparison value increases.

The shift refiner 511 may generate an amended mismatch value 540 by refining the interpolated mismatch value 538, as further described with reference to FIGS. 9A-9C. For example, the shift refiner 511 may determine whether the interpolated mismatch value 538 indicates that a change in a shift between the first audio signal 130 and the second audio signal 132 is greater than a shift change threshold, as further described with reference to FIG. 9A. The change in the shift may be indicated by a difference between the interpolated mismatch value 538 and a first mismatch value associated with the frame 302 of FIG. 3. The shift refiner 511 may, in response to determining that the difference is less than or equal to the threshold, set the amended mismatch value 540 to the interpolated mismatch value 538. Alternatively, the shift refiner 511 may, in response to determining that the difference is greater than the threshold, determine a plurality of mismatch values that correspond to a difference that is less than or equal to the shift change threshold, as further described with reference to FIG. 9A. The shift refiner 511 may determine comparison values based on the first audio signal 130 and the plurality of mismatch values applied to the second audio signal 132. The shift refiner 511 may determine the amended mismatch value 540 based on the comparison values, as further described with reference to FIG. 9A. For example, the shift refiner 511 may select a mismatch value of the plurality of mismatch values based on the comparison values and the interpolated mismatch value 538, as further described with reference to FIG. 9A. The shift refiner 511 may set the amended mismatch value 540 to indicate the selected mismatch value. A non-zero difference between the first mismatch value corresponding to the frame 302 and the interpolated mismatch value 538 may indicate that some samples of the second audio signal 132 correspond to both frames (e.g., the frame 302 and the frame 304). For example, some samples of the second audio signal 132 may be duplicated during encoding. Alternatively, the non-zero difference may indicate that some samples of the second audio signal 132 correspond to neither the frame 302 nor the frame 304. For example, some samples of the second audio signal 132 may be lost during encoding. Setting the amended mismatch value 540 to one of the plurality of mismatch values may prevent a large change in shifts between consecutive (or adjacent) frames, thereby reducing an amount of sample loss or sample duplication during encoding. The shift refiner 511 may provide the amended mismatch value 540 to the shift change analyzer 512.

According to one implementation, the shift refiner may retrieve amended mismatch values for previous frames and may modify the amended mismatch value 540 based on a long-term smoothing operation using the amended mismatch values for previous frames. For example, the amended mismatch value 540 may include a long-term amended mismatch value $AmendVal_{LT_N}(k)$ for a current frame (N) and may be represented by $AmendVal_{LT_N}(k)=(1-\alpha)*AmendVal_N(k), +(\alpha)*AmendVal_{LT_{N-1}}(k)$, where $\alpha\in(0, 1.0)$. Thus, the long-term amended mismatch value $AmendVal_{LT_N}(k)$ may be based on a weighted mixture of the instantaneous amended mismatch value $AmendVal_N(k)$ at frame N and the long-term amended mismatch values $AmendVal_{LT_{N-1}}(k)$ for one or more previous frames. As the value of α increases, the amount of smoothing in the long-term comparison value increases.

In some implementations, the shift refiner 511 may adjust the interpolated mismatch value 538, as described with reference to FIG. 9B. The shift refiner 511 may determine the amended mismatch value 540 based on the adjusted interpolated mismatch value 538. In some implementations, the shift refiner 511 may determine the amended mismatch value 540 as described with reference to FIG. 9C.

The shift change analyzer 512 may determine whether the amended mismatch value 540 indicates a switch or reverse in timing between the first audio signal 130 and the second audio signal 132, as described with reference to FIG. 1. In particular, a reverse or a switch in timing may indicate that, for the frame 302, the first audio signal 130 is received at the input interface(s) 112 prior to the second audio signal 132, and, for a subsequent frame (e.g., the frame 304 or the frame 306), the second audio signal 132 is received at the input interface(s) prior to the first audio signal 130. Alternatively, a reverse or a switch in timing may indicate that, for the frame 302, the second audio signal 132 is received at the input interface(s) 112 prior to the first audio signal 130, and, for a subsequent frame (e.g., the frame 304 or the frame 306), the first audio signal 130 is received at the input interface(s) prior to the second audio signal 132. In other words, a switch or reverse in timing may be indicate that a final mismatch value corresponding to the frame 302 has a first sign that is distinct from a second sign of the amended mismatch value 540 corresponding to the frame 304 (e.g., a positive to negative transition or vice-versa). The shift change analyzer 512 may determine whether delay between the first audio signal 130 and the second audio signal 132 has switched sign based on the amended mismatch value 540 and the first mismatch value associated with the frame 302, as further described with reference to FIG. 10A. The shift change analyzer 512 may, in response to determining that the delay between the first audio signal 130 and the second audio signal 132 has switched sign, set the final mismatch value 116 to a value (e.g., 0) indicating no time shift. Alternatively, the shift change analyzer 512 may set the final mismatch value 116 to the amended mismatch value 540 in response to determining that the delay between the first audio signal 130 and the second audio signal 132 has not switched sign, as further described with reference to FIG. 10A. The shift change analyzer 512 may generate an estimated mismatch value by refining the amended mismatch value 540, as further described with reference to FIGS. 10A, 11. The shift change analyzer 512 may set the final mismatch value 116 to the estimated mismatch value. Setting the final mismatch value 116 to indicate no time shift may reduce distortion at a decoder by refraining from time shifting the first audio signal 130 and the second audio signal 132 in opposite directions for consecutive (or adjacent) frames of the first audio signal 130. The shift change analyzer 512 may provide the final mismatch value 116 to the reference signal designator 508, to the absolute shift generator 513, or both. In some implementations, the shift change analyzer 512 may determine the final mismatch value 116 as described with reference to FIG. 10B.

The absolute shift generator 513 may generate the non-causal mismatch value 162 by applying an absolute function to the final mismatch value 116. The absolute shift generator 513 may provide the mismatch value 162 to the gain parameter generator 514.

The reference signal designator 508 may generate the reference signal indicator 164, as further described with reference to FIGS. 12-13. For example, the reference signal indicator 164 may have a first value indicating that the first audio signal 130 is a reference signal or a second value indicating that the second audio signal 132 is the reference signal. The reference signal designator 508 may provide the reference signal indicator 164 to the gain parameter generator 514.

The gain parameter generator 514 may select samples of the target signal (e.g., the second audio signal 132) based on the non-causal mismatch value 162. To illustrate, the gain parameter generator 514 may select the samples 358-364 in response to determining that the non-causal mismatch value 162 has a first value (e.g., +X ms or +Y samples, where X and Y include positive real numbers). The gain parameter generator 514 may select the samples 354-360 in response to determining that the non-causal mismatch value 162 has a second value (e.g., −X ms or −Y samples). The gain parameter generator 514 may select the samples 356-362 in response to determining that the non-causal mismatch value 162 has a value (e.g., 0) indicating no time shift.

The gain parameter generator 514 may determine whether the first audio signal 130 is the reference signal or the second audio signal 132 is the reference signal based on the reference signal indicator 164. The gain parameter generator 514 may generate the gain parameter 160 based on the samples 326-332 of the frame 304 and the selected samples (e.g., the samples 354-360, the samples 356-362, or the samples 358-364) of the second audio signal 132, as described with reference to FIG. 1. For example, the gain parameter generator 514 may generate the gain parameter 160 based on one or more of Equation 1a-Equation 1f, where $g_D$ corresponds to the gain parameter 160, Ref(n) corresponds to samples of the reference signal, and Targ(n+$N_1$) corresponds to samples of the target signal. To illustrate, Ref(n) may correspond to the samples 326-332 of the frame 304 and Targ(n+$t_{N1}$) may correspond to the samples 358-364 of the frame 344 when the non-causal mismatch value 162 has a first value (e.g., +X ms or +Y samples, where X and Y include positive real numbers). In some implementations, Ref(n) may correspond to samples of the first audio signal 130 and Targ(n+$N_1$) may correspond to samples of the second audio signal 132, as described with reference to FIG. 1. In alternate implementations, Ref(n) may correspond to samples of the second audio signal 132 and Targ(n+$N_1$) may correspond to samples of the first audio signal 130, as described with reference to FIG. 1.

The gain parameter generator 514 may provide the gain parameter 160, the reference signal indicator 164, the non-causal mismatch value 162, or a combination thereof, to the signal generator 516. The signal generator 516 may generate the encoded signals 102, as described with reference to FIG. 1. For examples, the encoded signals 102 may include a first encoded signal frame 564 (e.g., a mid channel frame), a second encoded signal frame 566 (e.g., a side channel frame), or both. The signal generator 516 may generate the first encoded signal frame 564 based on Equation 2a or Equation 2b, where M corresponds to the first encoded signal frame 564, $g_D$ corresponds to the gain parameter 160, Ref(n) corresponds to samples of the reference signal, and Targ(n+$N_1$) corresponds to samples of the target signal. The signal generator 516 may generate the second encoded signal frame 566 based on Equation 3a or Equation 3b, where S corresponds to the second encoded signal frame 566, $g_D$ corresponds to the gain parameter 160, Ref(n) corresponds to samples of the reference signal, and Targ(n+$N_1$) corresponds to samples of the target signal.

The temporal equalizer 108 may store the first resampled signal 530, the second resampled signal 532, the comparison values 534, the tentative mismatch value 536, the interpolated mismatch value 538, the amended mismatch value 540, the non-causal mismatch value 162, the reference signal indicator 164, the final mismatch value 116, the gain parameter 160, the first encoded signal frame 564, the second encoded signal frame 566, or a combination thereof, in the memory 153. For example, the analysis data 190 may include the first resampled signal 530, the second resampled signal 532, the comparison values 534, the tentative mismatch value 536, the interpolated mismatch value 538, the amended mismatch value 540, the non-causal mismatch value 162, the reference signal indicator 164, the final mismatch value 116, the gain parameter 160, the first encoded signal frame 564, the second encoded signal frame 566, or a combination thereof.

The smoothing techniques described above may substantially normalize the shift estimate between voiced frames, unvoiced frames, and transition frames. Normalized shift estimates may reduce sample repetition and artifact skipping at frame boundaries. Additionally, normalized shift estimates may result in reduced side channel energies, which may improve coding efficiency.

Figure 6:
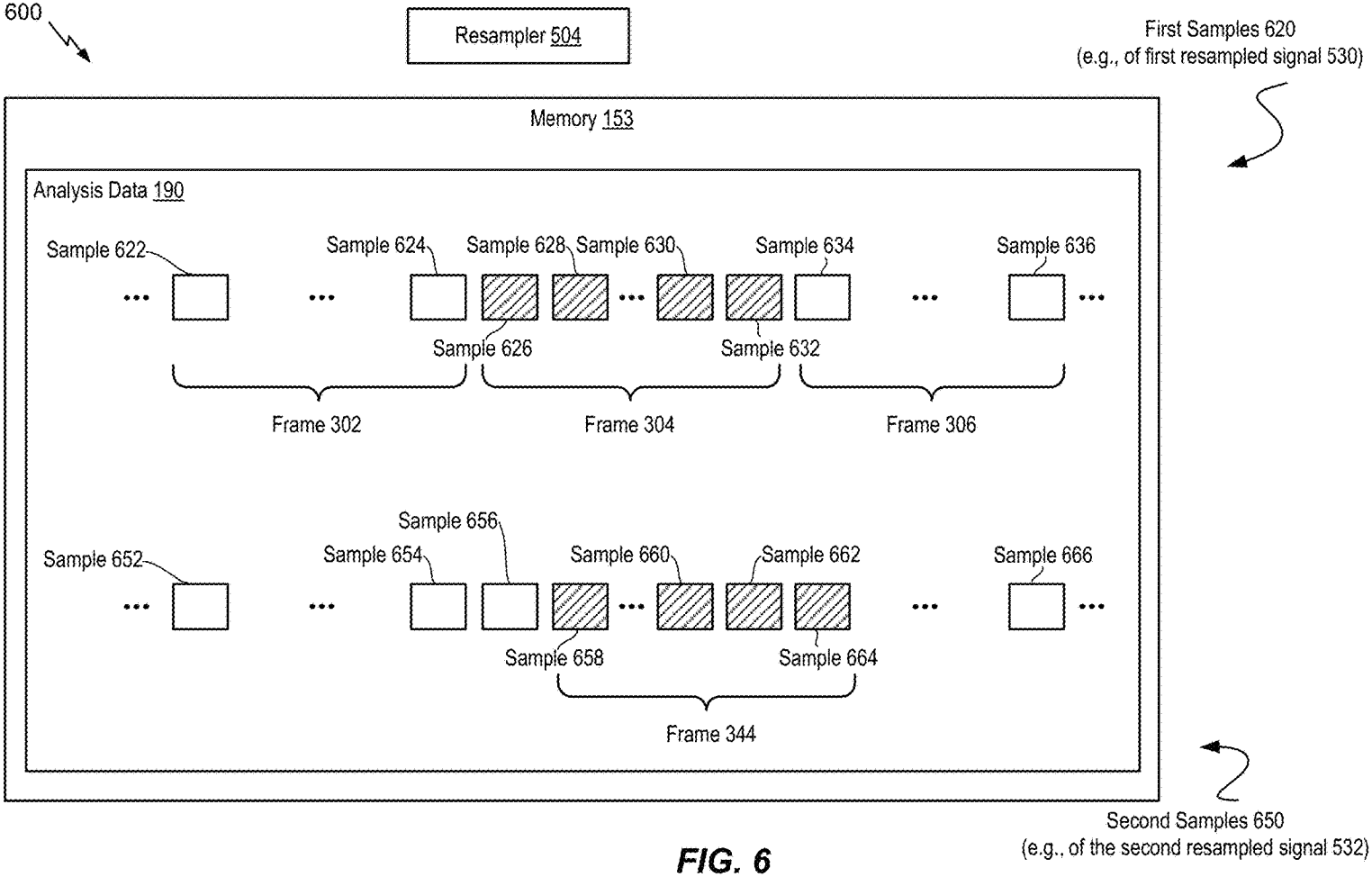
FIG. 6 is a diagram illustrating another example of a system operable to encode multiple channels.

Referring to FIG. 6, an illustrative example of a system is shown and generally designated 600. The system 600 may correspond to the system 100 of FIG. 1. For example, the system 100, the first device 104 of FIG. 1, or both, may include one or more components of the system 600.

The resampler 504 may generate first samples 620 of the first resampled signal 530 by resampling (e.g., down-sampling or up-sampling) the first audio signal 130 of FIG. 1. The resampler 504 may generate second samples 650 of the second resampled signal 532 by resampling (e.g., down-sampling or up-sampling) the second audio signal 132 of FIG. 1.

The first audio signal 130 may be sampled at a first sample rate (Fs) to generate the samples 320 of FIG. 3. The first sample rate (Fs) may correspond to a first rate (e.g., 16 kilohertz (kHz)) associated with wideband (WB) bandwidth, a second rate (e.g., 32 kHz) associated with super wideband (SWB) bandwidth, a third rate (e.g., 48 kHz) associated with full band (FB) bandwidth, or another rate. The second audio signal 132 may be sampled at the first sample rate (Fs) to generate the second samples 350 of FIG. 3.

In some implementations, the resampler 504 may pre-process the first audio signal 130 (or the second audio signal 132) prior to resampling the first audio signal 130 (or the second audio signal 132). The resampler 504 may pre-process the first audio signal 130 (or the second audio signal 132) by filtering the first audio signal 130 (or the second audio signal 132) based on an infinite impulse response (IIR) filter (e.g., a first order IIR filter). The IIR filter may be based on the following Equation:

$$H_{pre}(z)=1/(1-\alpha z^{-1}), \qquad \text{Equation 4}$$

where $\alpha$ is positive, such as 0.68 or 0.72. Performing the de-emphasis prior to resampling may reduce effects, such as aliasing, signal conditioning, or both. The first audio signal 130 (e.g., the pre-processed first audio signal 130) and the second audio signal 132 (e.g., the pre-processed second audio signal 132) may be resampled based on a resampling factor (D). The resampling factor (D) may be based on the first sample rate (Fs) (e.g., D=Fs/8, D=2 Fs, etc.).

In alternate implementations, the first audio signal 130 and the second audio signal 132 may be low-pass filtered or decimated using an anti-aliasing filter prior to resampling. The decimation filter may be based on the resampling factor (D). In a particular example, the resampler 504 may select a decimation filter with a first cut-off frequency (e.g., $\pi$/D or $\pi$/4) in response to determining that the first sample rate (Fs) corresponds to a particular rate (e.g., 32 kHz). Reducing aliasing by de-emphasizing multiple signals (e.g., the first audio signal 130 and the second audio signal 132) may be computationally less expensive than applying a decimation filter to the multiple signals.

The first samples 620 may include a sample 622, a sample 624, a sample 626, a sample 628, a sample 630, a sample 632, a sample 634, a sample 636, one or more additional samples, or a combination thereof. The first samples 620 may include a subset (e.g., ⅛th) of the first samples 320 of FIG. 3. The sample 622, the sample 624, one or more additional samples, or a combination thereof, may correspond to the frame 302. The sample 626, the sample 628, the sample 630, the sample 632, one or more additional samples, or a combination thereof, may correspond to the frame 304. The sample 634, the sample 636, one or more additional samples, or a combination thereof, may correspond to the frame 306.

The second samples 650 may include a sample 652, a sample 654, a sample 656, a sample 658, a sample 660, a sample 662, a sample 664, a sample 666, one or more additional samples, or a combination thereof. The second samples 650 may include a subset (e.g., ⅛th) of the second samples 350 of FIG. 3. The samples 654-660 may correspond to the samples 354-360. For example, the samples 654-660 may include a subset (e.g., ⅛th) of the samples 354-360. The samples 656-662 may correspond to the samples 356-362. For example, the samples 656-662 may include a subset (e.g., ⅛th) of the samples 356-362. The samples 658-664 may correspond to the samples 358-364. For example, the samples 658-664 may include a subset (e.g., ⅛th) of the samples 358-364. In some implementations, the resampling factor may correspond to a first value (e.g., 1) where samples 622-636 and samples 652-666 of FIG. 6 may be similar to samples 322-336 and samples 352-366 of FIG. 3, respectively.

The resampler 504 may store the first samples 620, the second samples 650, or both, in the memory 153. For example, the analysis data 190 may include the first samples 620, the second samples 650, or both.

Figure 7:
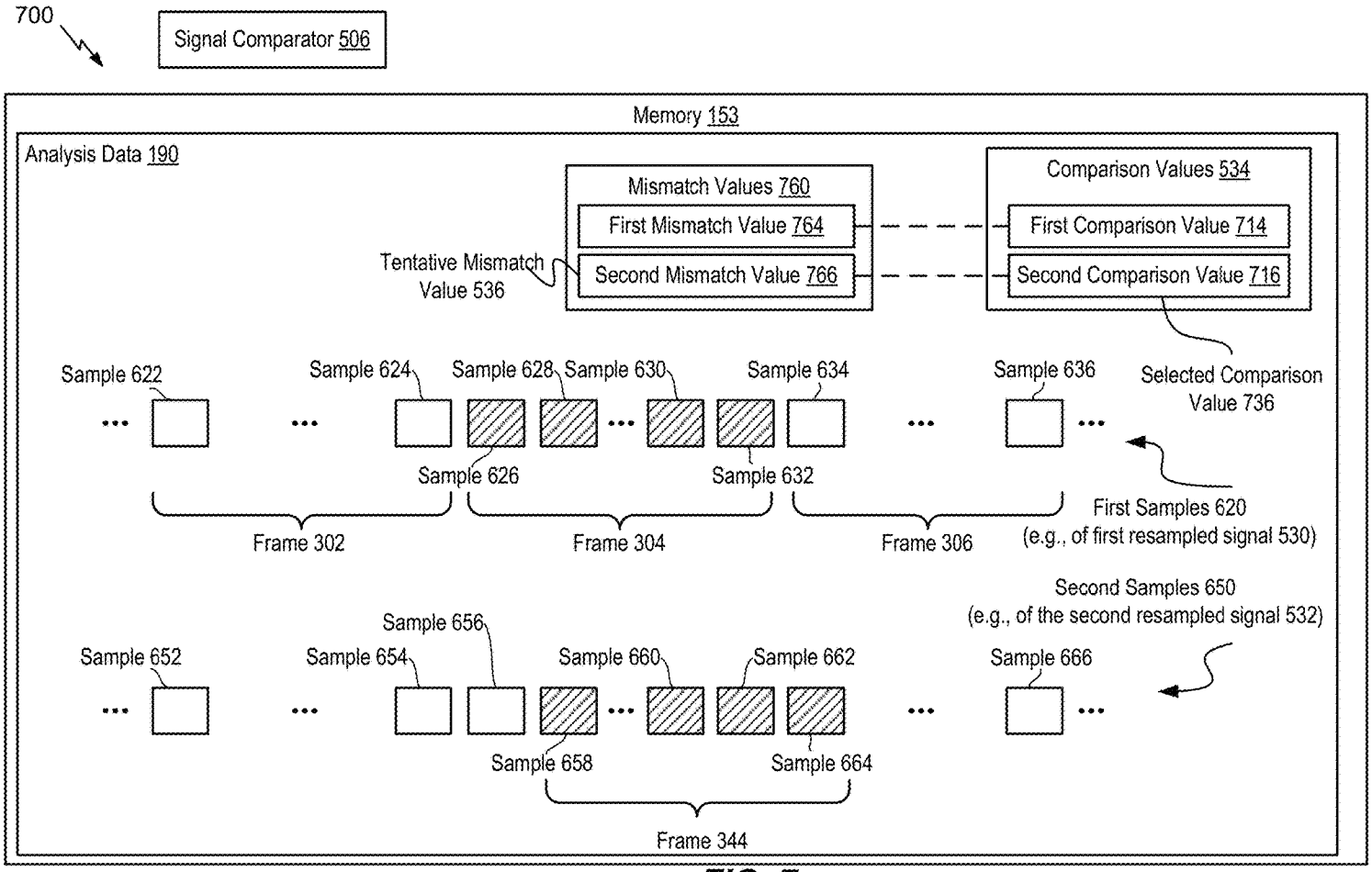
FIG. 7 is a diagram illustrating another example of a system operable to encode multiple channels.

Referring to FIG. 7, an illustrative example of a system is shown and generally designated 700. The system 700 may correspond to the system 100 of FIG. 1. For example, the system 100, the first device 104 of FIG. 1, or both, may include one or more components of the system 700.

The memory 153 may store a plurality of mismatch values 760. The mismatch values 760 may include a first mismatch value 764 (e.g., −X ms or −Y samples, where X and Y include positive real numbers), a second mismatch value 766 (e.g., +X ms or +Y samples, where X and Y include positive real numbers), or both. The mismatch values 760 may range from a lower mismatch value (e.g., a minimum mismatch value, T_MIN) to a higher mismatch value (e.g., a maximum mismatch value, T_MAX). The mismatch values 760 may indicate an expected temporal shift (e.g., a maximum expected temporal shift) between the first audio signal 130 and the second audio signal 132.

During operation, the signal comparator 506 may determine the comparison values 534 based on the first samples 620 and the mismatch values 760 applied to the second samples 650. For example, the samples 626-632 may correspond to a first time (t). To illustrate, the input interface(s) 112 of FIG. 1 may receive the samples 626-632 corresponding to the frame 304 at approximately the first time (t). The first mismatch value 764 (e.g., −X ms or −Y samples, where X and Y include positive real numbers) may correspond to a second time (t−1).

The samples 654-660 may correspond to the second time (t−1). For example, the input interface(s) 112 may receive the samples 654-660 at approximately the second time (t−1). The signal comparator 506 may determine a first comparison value 714 (e.g., a difference value or a cross-correlation value) corresponding to the first mismatch value 764 based on the samples 626-632 and the samples 654-660. For example, the first comparison value 714 may correspond to an absolute value of cross-correlation of the samples 626-632 and the samples 654-660. As another example, the first comparison value 714 may indicate a difference between the samples 626-632 and the samples 654-660.

The second mismatch value 766 (e.g., +X ms or +Y samples, where X and Y include positive real numbers) may correspond to a third time (t+1). The samples 658-664 may correspond to the third time (t+1). For example, the input interface(s) 112 may receive the samples 658-664 at approximately the third time (t+1). The signal comparator 506 may determine a second comparison value 716 (e.g., a difference value or a cross-correlation value) corresponding to the second mismatch value 766 based on the samples 626-632 and the samples 658-664. For example, the second comparison value 716 may correspond to an absolute value of cross-correlation of the samples 626-632 and the samples 658-664. As another example, the second comparison value 716 may indicate a difference between the samples 626-632 and the samples 658-664. The signal comparator 506 may store the comparison values 534 in the memory 153. For example, the analysis data 190 may include the comparison values 534.

The signal comparator 506 may identify a selected comparison value 736 of the comparison values 534 that has a higher (or lower) value than other values of the comparison values 534. For example, the signal comparator 506 may select the second comparison value 716 as the selected comparison value 736 in response to determining that the second comparison value 716 is greater than or equal to the first comparison value 714. In some implementations, the comparison values 534 may correspond to cross-correlation values. The signal comparator 506 may, in response to determining that the second comparison value 716 is greater than the first comparison value 714, determine that the samples 626-632 have a higher correlation with the samples 658-664 than with the samples 654-660. The signal comparator 506 may select the second comparison value 716 that indicates the higher correlation as the selected comparison value 736. In other implementations, the comparison values 534 may correspond to difference values. The signal comparator 506 may, in response to determining that the second comparison value 716 is lower than the first comparison value 714, determine that the samples 626-632 have a greater similarity with (e.g., a lower difference to) the samples 658-664 than the samples 654-660. The signal comparator 506 may select the second comparison value 716 that indicates a lower difference as the selected comparison value 736.

The selected comparison value 736 may indicate a higher correlation (or a lower difference) than the other values of the comparison values 534. The signal comparator 506 may identify the tentative mismatch value 536 of the mismatch values 760 that corresponds to the selected comparison value 736. For example, the signal comparator 506 may identify the second mismatch value 766 as the tentative mismatch value 536 in response to determining that the second mismatch value 766 corresponds to the selected comparison value 736 (e.g., the second comparison value 716).

The signal comparator 506 may determine the selected comparison value 736 based on the following Equation:

$$\max XCorr=\max(|\Sigma_{k=-K}^{K} w(n)l'(n)*w(n+k)r'(n+k)|), \qquad \text{Equation 5}$$

where maxXCorr corresponds to the selected comparison value 736 and k corresponds to a mismatch value. w(n)*l' corresponds to de-emphasized, resampled, and windowed first audio signal 130, and w(n)*r' corresponds to de-emphasized, resampled, and windowed second audio signal 132. For example, w(n)*l' may correspond to the samples 626-632, w(n−1)*r' may correspond to the samples 654-660, w(n)*r' may correspond to the samples 656-662, and w(n+1)*r' may correspond to the samples 658-664. −K may correspond to a lower mismatch value (e.g., a minimum mismatch value) of the mismatch values 760, and K may correspond to a higher mismatch value (e.g., a maximum mismatch value) of the mismatch values 760. In Equation 5, w(n)*l' corresponds to the first audio signal 130 independently of whether the first audio signal 130 corresponds to a right (r) channel or a left (l) channel. In Equation 5, w(n)*r' corresponds to the second audio signal 132 independently of whether the second audio signal 132 corresponds to the right (r) channel or the left (l) channel.

The signal comparator 506 may determine the tentative mismatch value 536 based on the following Equation:

$$T=^{argmax}{}_{k}(|\Sigma_{k=-K}^{K} w(n)l'(n)*w(n+k)r'(n+k)|), \qquad \text{Equation 6}$$

where T corresponds to the tentative mismatch value 536.

The signal comparator 506 may map the tentative mismatch value 536 from the resampled samples to the original samples based on the resampling factor (D) of FIG. 6. For example, the signal comparator 506 may update the tentative mismatch value 536 based on the resampling factor (D). To illustrate, the signal comparator 506 may set the tentative mismatch value 536 to a product (e.g., 12) of the tentative mismatch value 536 (e.g., 3) and the resampling factor (D) (e.g., 4).

Figure 8:
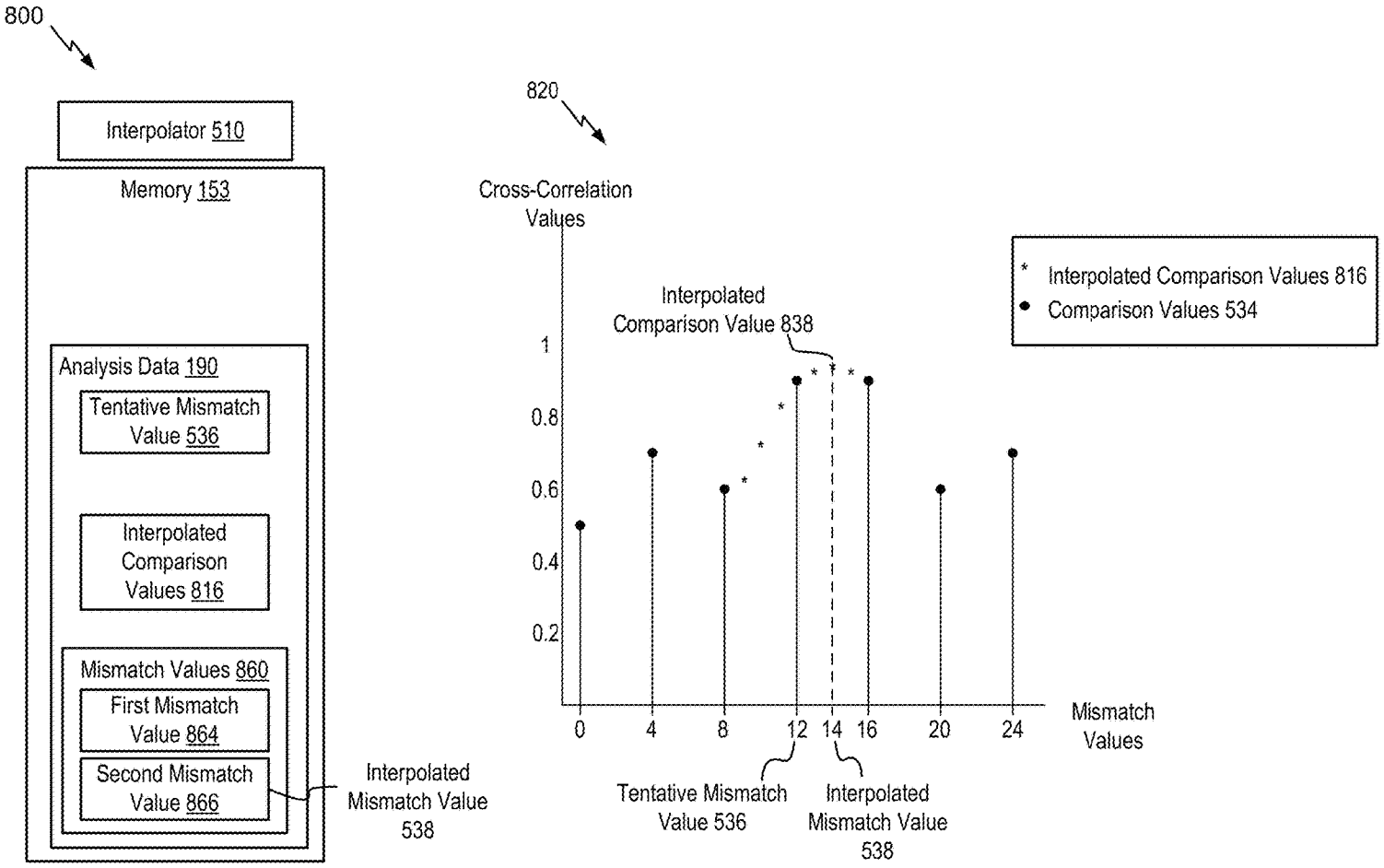
FIG. 8 is a diagram illustrating another example of a system operable to encode multiple channels.

Referring to FIG. 8, an illustrative example of a system is shown and generally designated 800. The system 800 may correspond to the system 100 of FIG. 1. For example, the system 100, the first device 104 of FIG. 1, or both, may include one or more components of the system 800. The memory 153 may be configured to store mismatch values 860. The mismatch values 860 may include a first mismatch value 864, a second mismatch value 866, or both.

During operation, the interpolator 510 may generate the mismatch values 860 proximate to the tentative mismatch value 536 (e.g., 12), as described herein. Mapped mismatch values may correspond to the mismatch values 760 mapped from the resampled samples to the original samples based on the resampling factor (D). For example, a first mapped mismatch value of the mapped mismatch values may correspond to a product of the first mismatch value 764 and the resampling factor (D). A difference between a first mapped mismatch value of the mapped mismatch values and each second mapped mismatch value of the mapped mismatch values may be greater than or equal to a threshold value (e.g., the resampling factor (D), such as 4). The mismatch values 860 may have finer granularity than the mismatch values 760. For example, a difference between a lower value (e.g., a minimum value) of the mismatch values 860 and the tentative mismatch value 536 may be less than the threshold value (e.g., 4). The threshold value may correspond to the resampling factor (D) of FIG. 6. The mismatch values 860 may range from a first value (e.g., the tentative mismatch value 536−(the threshold value−1)) to a second value (e.g., the tentative mismatch value 536+(threshold value−1)).

The interpolator 510 may generate interpolated comparison values 816 corresponding to the mismatch values 860 by performing interpolation on the comparison values 534, as described herein. Comparison values corresponding to one or more of the mismatch values 860 may be excluded from the comparison values 534 because of the lower granularity of the comparison values 534. Using the interpolated comparison values 816 may enable searching of interpolated comparison values corresponding to the one or more of the mismatch values 860 to determine whether an interpolated comparison value corresponding to a particular mismatch value proximate to the tentative mismatch value 536 indicates a higher correlation (or lower difference) than the second comparison value 716 of FIG. 7.

FIG. 8 includes a graph 820 illustrating examples of the interpolated comparison values 816 and the comparison values 534 (e.g., cross-correlation values). The interpolator 510 may perform the interpolation based on a hanning windowed sinc interpolation, IIR filter based interpolation, spline interpolation, another form of signal interpolation, or a combination thereof. For example, the interpolator 510 may perform the hanning windowed sinc interpolation based on the following Equation:

$$R(k)_{32\ kHz}=\Sigma_{i=-4}^{4}R(\hat{t}_{N2}-i)_{8\ kHz}*b(3i+t), \qquad \text{Equation 7}$$

where $t=k-\hat{t}_{N2}$, b corresponds to a windowed sinc function, $\hat{t}_{N2}$ corresponds to the tentative mismatch value 536. $R(\hat{t}_{N2}-i)_{8\ kHz}$ may correspond to a particular comparison value of the comparison values 534. For example, $R(\hat{t}_{N2}-i)_{8\ kHz}$ may indicate a first comparison value of the comparison values 534 that corresponds to a first mismatch value (e.g., 8) when i corresponds to 4. $R(\hat{t}_{N2}-i)_{8\ kHz}$ may indicate the second comparison value 716 that corresponds to the tentative mismatch value 536 (e.g., 12) when i corresponds to 0. $R(\hat{t}_{N2}-i)_{8\ kHz}$ may indicate a third comparison value of the comparison values 534 that corresponds to a third mismatch value (e.g., 16) when i corresponds to −4.

$R(k)_{32\ kHz}$ may correspond to a particular interpolated value of the interpolated comparison values 816. Each interpolated value of the interpolated comparison values 816 may correspond to a sum of a product of the windowed sinc function (b) and each of the first comparison value, the second comparison value 716, and the third comparison value. For example, the interpolator 510 may determine a first product of the windowed sinc function (b) and the first comparison value, a second product of the windowed sinc function (b) and the second comparison value 716, and a third product of the windowed sinc function (b) and the third comparison value. The interpolator 510 may determine a particular interpolated value based on a sum of the first product, the second product, and the third product. A first interpolated value of the interpolated comparison values 816 may correspond to a first mismatch value (e.g., 9). The windowed sinc function (b) may have a first value corresponding to the first mismatch value. A second interpolated value of the interpolated comparison values 816 may correspond to a second mismatch value (e.g., 10). The windowed sinc function (b) may have a second value corresponding to the second mismatch value. The first value of the windowed sinc function (b) may be distinct from the second value. The first interpolated value may thus be distinct from the second interpolated value.

In Equation 7, 8 kHz may correspond to a first rate of the comparison values 534. For example, the first rate may indicate a number (e.g., 8) of comparison values corresponding to a frame (e.g., the frame 304 of FIG. 3) that are included in the comparison values 534. 32 kHz may correspond to a second rate of the interpolated comparison values 816. For example, the second rate may indicate a number (e.g., 32) of interpolated comparison values corresponding to a frame (e.g., the frame 304 of FIG. 3) that are included in the interpolated comparison values 816.

The interpolator 510 may select an interpolated comparison value 838 (e.g., a maximum value or a minimum value) of the interpolated comparison values 816. The interpolator 510 may select a mismatch value (e.g., 14) of the mismatch values 860 that corresponds to the interpolated comparison value 838. The interpolator 510 may generate the interpolated mismatch value 538 indicating the selected mismatch value (e.g., the second mismatch value 866).

Using a coarse approach to determine the tentative mismatch value 536 and searching around the tentative mismatch value 536 to determine the interpolated mismatch value 538 may reduce search complexity without compromising search efficiency or accuracy.

Figure 9A:
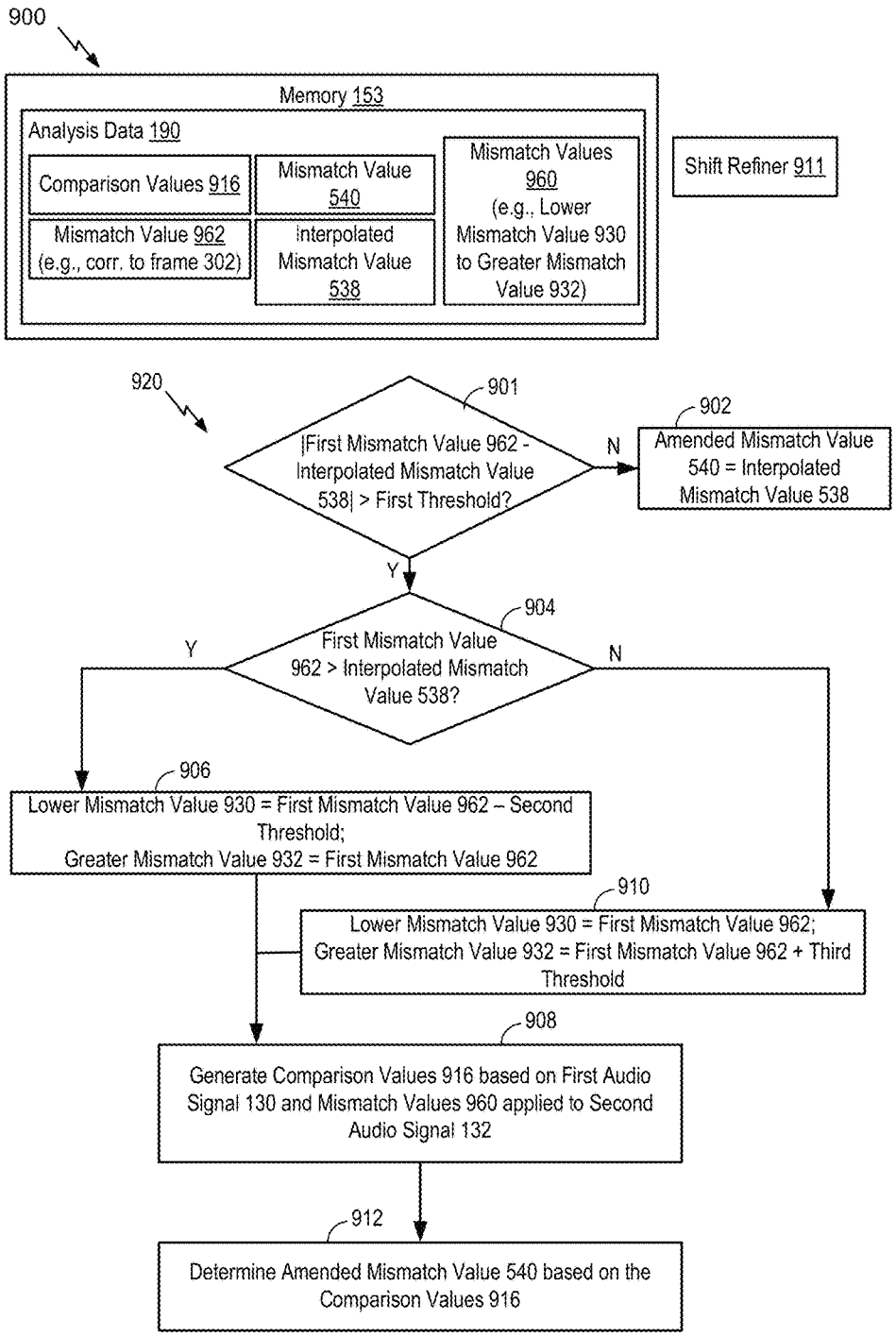
FIG. 9A is a diagram illustrating another example of a system operable to encode multiple channels.

Referring to FIG. 9A, an illustrative example of a system is shown and generally designated 900. The system 900 may correspond to the system 100 of FIG. 1. For example, the system 100, the first device 104 of FIG. 1, or both, may include one or more components of the system 900. The system 900 may include the memory 153, a shift refiner 911, or both. The memory 153 may be configured to store a first mismatch value 962 corresponding to the frame 302. For example, the analysis data 190 may include the first mismatch value 962. The first mismatch value 962 may correspond to a tentative mismatch value, an interpolated mismatch value, an amended mismatch value, a final mismatch value, or a non-causal mismatch value associated with the frame 302. The frame 302 may precede the frame 304 in the first audio signal 130. The shift refiner 911 may correspond to the shift refiner 511 of FIG. 1.

FIG. 9A also includes a flow chart of an illustrative method of operation generally designated 920. The method 920 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911, or a combination thereof.

The method 920 includes determining whether an absolute value of a difference between the first mismatch value 962 and the interpolated mismatch value 538 is greater than a first threshold, at 901. For example, the shift refiner 911 may determine whether an absolute value of a difference between the first mismatch value 962 and the interpolated mismatch value 538 is greater than a first threshold (e.g., a shift change threshold).

The method 920 also includes, in response to determining that the absolute value is less than or equal to the first threshold, at 901, setting the amended mismatch value 540 to indicate the interpolated mismatch value 538, at 902. For example, the shift refiner 911 may, in response to determining that the absolute value is less than or equal to the shift change threshold, set the amended mismatch value 540 to indicate the interpolated mismatch value 538. In some implementations, the shift change threshold may have a first value (e.g., 0) indicating that the amended mismatch value 540 is to be set to the interpolated mismatch value 538 when the first mismatch value 962 is equal to the interpolated mismatch value 538. In alternate implementations, the shift change threshold may have a second value (e.g., ≥1) indicating that the amended mismatch value 540 is to be set to the interpolated mismatch value 538, at 902, with a greater degree of freedom. For example, the amended mismatch value 540 may be set to the interpolated mismatch value 538 for a range of differences between the first mismatch value 962 and the interpolated mismatch value 538. To illustrate, the amended mismatch value 540 may be set to the interpolated mismatch value 538 when an absolute value of a difference (e.g., −2, −1, 0, 1, 2) between the first mismatch value 962 and the interpolated mismatch value 538 is less than or equal to the shift change threshold (e.g., 2).

The method 920 further includes, in response to determining that the absolute value is greater than the first threshold, at 901, determining whether the first mismatch value 962 is greater than the interpolated mismatch value 538, at 904. For example, the shift refiner 911 may, in response to determining that the absolute value is greater than the shift change threshold, determine whether the first mismatch value 962 is greater than the interpolated mismatch value 538.

The method 920 also includes, in response to determining that the first mismatch value 962 is greater than the interpolated mismatch value 538, at 904, setting a lower mismatch value 930 to a difference between the first mismatch value 962 and a second threshold, and setting a greater mismatch value 932 to the first mismatch value 962, at 906. For example, the shift refiner 911 may, in response to determining that the first mismatch value 962 (e.g., 20) is greater than the interpolated mismatch value 538 (e.g., 14), set the lower mismatch value 930 (e.g., 17) to a difference between the first mismatch value 962 (e.g., 20) and a second threshold (e.g., 3). Additionally, or in the alternative, the shift refiner 911 may, in response to determining that the first mismatch value 962 is greater than the interpolated mismatch value 538, set the greater mismatch value 932 (e.g., 20) to the first mismatch value 962. The second threshold may be based on the difference between the first mismatch value 962 and the interpolated mismatch value 538. In some implementations, the lower mismatch value 930 may be set to a difference between the interpolated mismatch value 538 offset and a threshold (e.g., the second threshold) and the greater mismatch value 932 may be set to a difference between the first mismatch value 962 and a threshold (e.g., the second threshold).

The method 920 further includes, in response to determining that the first mismatch value 962 is less than or equal to the interpolated mismatch value 538, at 904, setting the lower mismatch value 930 to the first mismatch value 962, and setting a greater mismatch value 932 to a sum of the first mismatch value 962 and a third threshold, at 910. For example, the shift refiner 911 may, in response to determining that the first mismatch value 962 (e.g., 10) is less than or equal to the interpolated mismatch value 538 (e.g., 14), set the lower mismatch value 930 to the first mismatch value 962 (e.g., 10). Additionally, or in the alternative, the shift refiner 911 may, in response to determining that the first mismatch value 962 is less than or equal to the interpolated mismatch value 538, set the greater mismatch value 932 (e.g., 13) to a sum of the first mismatch value 962 (e.g., 10) and a third threshold (e.g., 3). The third threshold may be based on the difference between the first mismatch value 962 and the interpolated mismatch value 538. In some implementations, the lower mismatch value 930 may be set to a difference between the first mismatch value 962 offset and a threshold (e.g., the third threshold) and the greater mismatch value 932 may be set to a difference between the interpolated mismatch value 538 and a threshold (e.g., the third threshold).

The method 920 also includes determining comparison values 916 based on the first audio signal 130 and mismatch values 960 applied to the second audio signal 132, at 908. For example, the shift refiner 911 (or the signal comparator 506) may generate the comparison values 916, as described with reference to FIG. 7, based on the first audio signal 130 and the mismatch values 960 applied to the second audio signal 132. To illustrate, the mismatch values 960 may range from the lower mismatch value 930 (e.g., 17) to the greater mismatch value 932 (e.g., 20). The shift refiner 911 (or the signal comparator 506) may generate a particular comparison value of the comparison values 916 based on the samples 326-332 and a particular subset of the second samples 350. The particular subset of the second samples 350 may correspond to a particular mismatch value (e.g., 17) of the mismatch values 960. The particular comparison value may indicate a difference (or a correlation) between the samples 326-332 and the particular subset of the second samples 350.

The method 920 further includes determining the amended mismatch value 540 based on the comparison values 916 generated based on the first audio signal 130 and the second audio signal 132, at 912. For example, the shift refiner 911 may determine the amended mismatch value 540 based on the comparison values 916. To illustrate, in a first case, when the comparison values 916 correspond to cross-correlation values, the shift refiner 911 may determine that the interpolated comparison value 838 of FIG. 8 corresponding to the interpolated mismatch value 538 is greater than or equal to a highest comparison value of the comparison values 916. Alternatively, when the comparison values 916 correspond to difference values, the shift refiner 911 may determine that the interpolated comparison value 838 is less than or equal to a lowest comparison value of the comparison values 916. In this case, the shift refiner 911 may, in response to determining that the first mismatch value 962 (e.g., 20) is greater than the interpolated mismatch value 538 (e.g., 14), set the amended mismatch value 540 to the lower mismatch value 930 (e.g., 17). Alternatively, the shift refiner 911 may, in response to determining that the first mismatch value 962 (e.g., 10) is less than or equal to the interpolated mismatch value 538 (e.g., 14), set the amended mismatch value 540 to the greater mismatch value 932 (e.g., 13).

In a second case, when the comparison values 916 correspond to cross-correlation values, the shift refiner 911 may determine that the interpolated comparison value 838 is less than the highest comparison value of the comparison values 916 and may set the amended mismatch value 540 to a particular mismatch value (e.g., 18) of the mismatch values 960 that corresponds to the highest comparison value. Alternatively, when the comparison values 916 correspond to difference values, the shift refiner 911 may determine that the interpolated comparison value 838 is greater than the lowest comparison value of the comparison values 916 and may set the amended mismatch value 540 to a particular mismatch value (e.g., 18) of the mismatch values 960 that corresponds to the lowest comparison value.

The comparison values 916 may be generated based on the first audio signal 130, the second audio signal 132, and the mismatch values 960. The amended mismatch value 540 may be generated based on comparison values 916 using a similar procedure as performed by the signal comparator 506, as described with reference to FIG. 7.

The method 920 may thus enable the shift refiner 911 to limit a change in a mismatch value associated with consecutive (or adjacent) frames. The reduced change in the mismatch value may reduce sample loss or sample duplication during encoding.

Figure 9B:
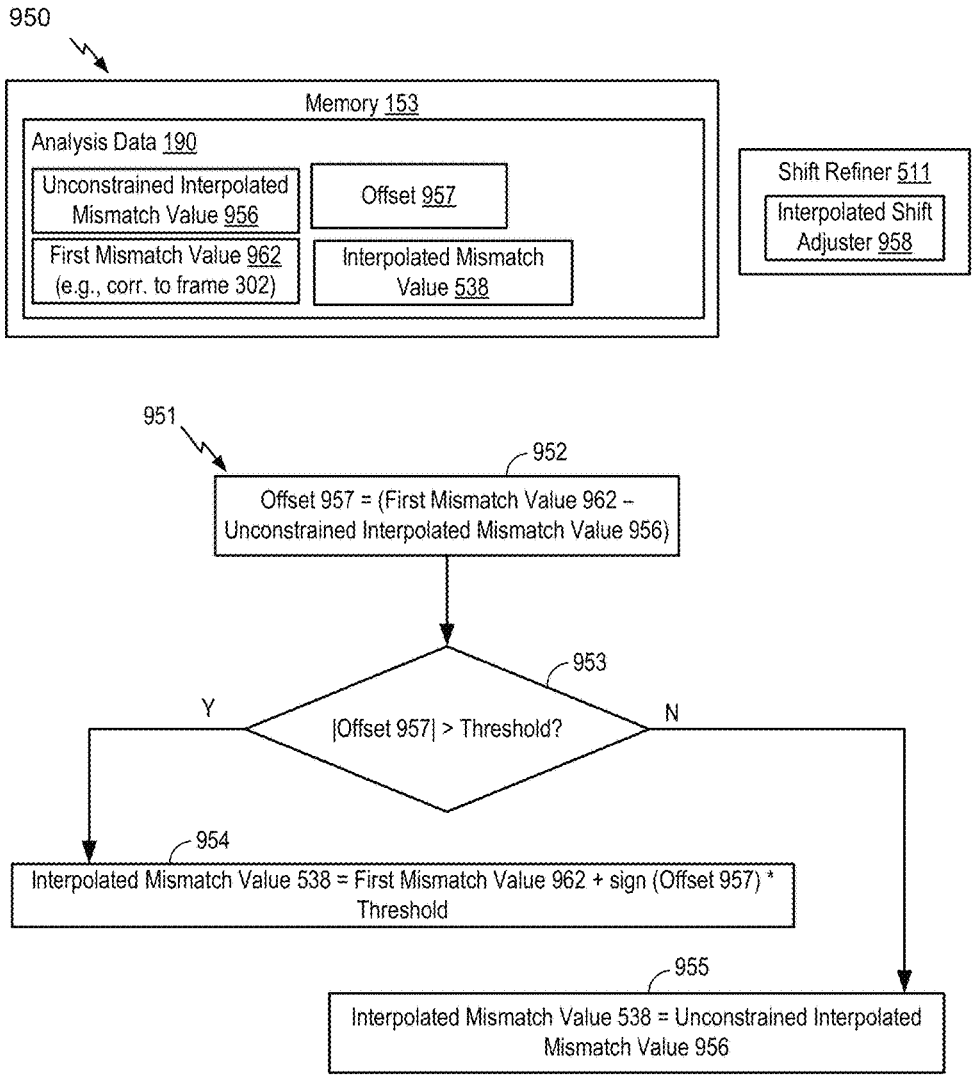
FIG. 9B is a diagram illustrating another example of a system operable to encode multiple channels.

Referring to FIG. 9B, an illustrative example of a system is shown and generally designated 950. The system 950 may correspond to the system 100 of FIG. 1. For example, the system 100, the first device 104 of FIG. 1, or both, may include one or more components of the system 950. The system 950 may include the memory 153, the shift refiner 511, or both. The shift refiner 511 may include an interpolated shift adjuster 958. The interpolated shift adjuster 958 may be configured to selectively adjust the interpolated mismatch value 538 based on the first mismatch value 962, as described herein. The shift refiner 511 may determine the amended mismatch value 540 based on the interpolated mismatch value 538 (e.g., the adjusted interpolated mismatch value 538), as described with reference to FIGS. 9A, 9C.

FIG. 9B also includes a flow chart of an illustrative method of operation generally designated 951. The method 951 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911 of FIG. 9A, the interpolated shift adjuster 958, or a combination thereof.

The method 951 includes generating an offset 957 based on a difference between the first mismatch value 962 and an unconstrained interpolated mismatch value 956, at 952. For example, the interpolated shift adjuster 958 may generate the offset 957 based on a difference between the first mismatch value 962 and an unconstrained interpolated mismatch value 956. The unconstrained interpolated mismatch value 956 may correspond to the interpolated mismatch value 538 (e.g., prior to adjustment by the interpolated shift adjuster 958). The interpolated shift adjuster 958 may store the unconstrained interpolated mismatch value 956 in the memory 153. For example, the analysis data 190 may include the unconstrained interpolated mismatch value 956.

The method 951 also includes determining whether an absolute value of the offset 957 is greater than a threshold, at 953. For example, the interpolated shift adjuster 958 may determine whether an absolute value of the offset 957 satisfies a threshold. The threshold may correspond to an interpolated shift limitation MAX_SHIFT_CHANGE (e.g., 4).

The method 951 includes, in response to determining that the absolute value of the offset 957 is greater than the threshold, at 953, setting the interpolated mismatch value 538 based on the first mismatch value 962, a sign of the offset 957, and the threshold, at 954. For example, the interpolated shift adjuster 958 may in response to determining that the absolute value of the offset 957 fails to satisfy (e.g., is greater than) the threshold, constrain the interpolated mismatch value 538. To illustrate, the interpolated shift adjuster 958 may adjust the interpolated mismatch value 538 based on the first mismatch value 962, a sign (e.g., +1 or −1) of the offset 957, and the threshold (e.g., the interpolated mismatch value 538=the first mismatch value 962+sign (the offset 957)*Threshold).

The method 951 includes, in response to determining that the absolute value of the offset 957 is less than or equal to the threshold, at 953, set the interpolated mismatch value 538 to the unconstrained interpolated mismatch value 956, at 955. For example, the interpolated shift adjuster 958 may in response to determining that the absolute value of the offset 957 satisfies (e.g., is less than or equal to) the threshold, refrain from changing the interpolated mismatch value 538.

The method 951 may thus enable constraining the interpolated mismatch value 538 such that a change in the interpolated mismatch value 538 relative to the first mismatch value 962 satisfies an interpolation shift limitation.

Figure 9C:
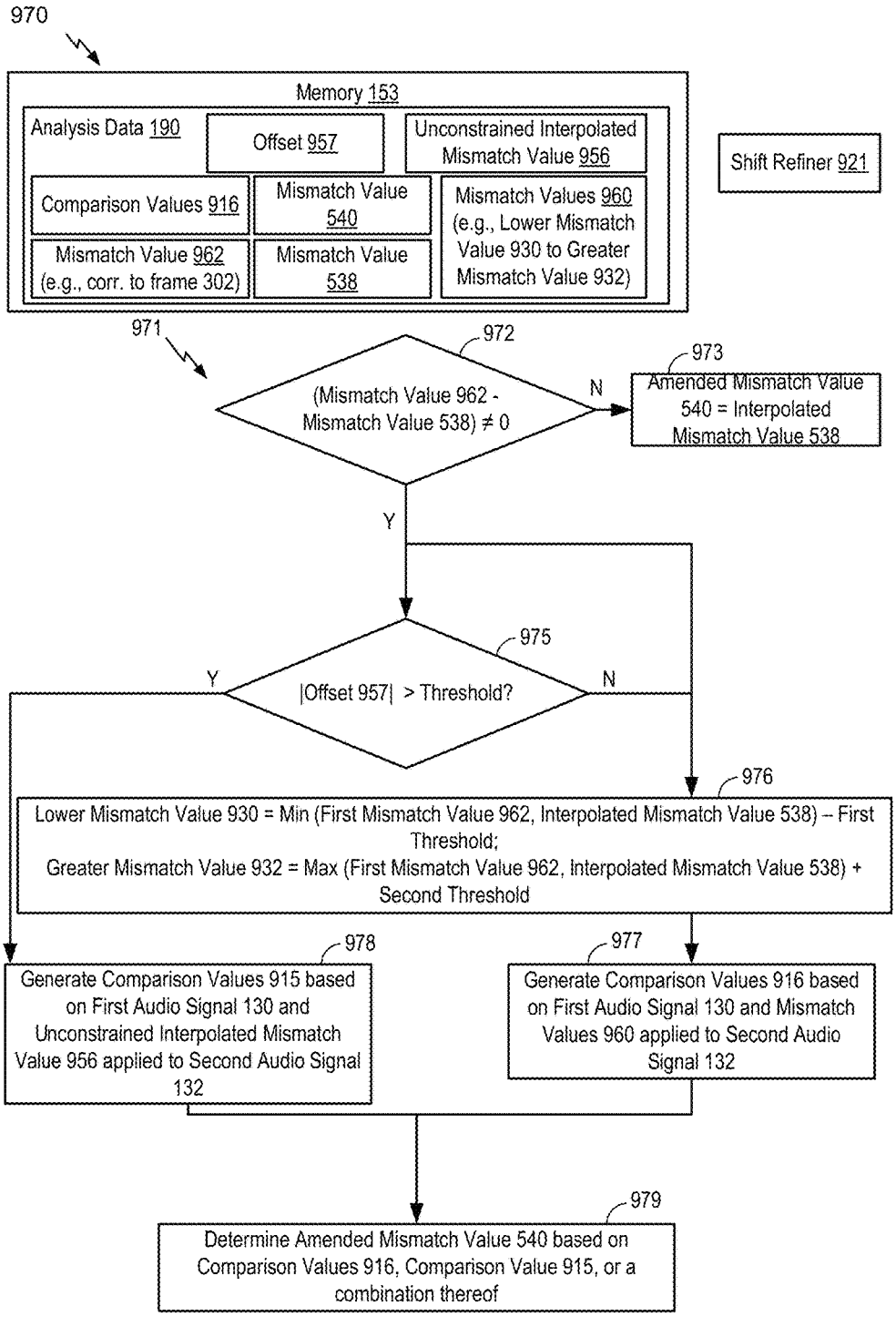
FIG. 9C is a diagram illustrating another example of a system operable to encode multiple channels.

Referring to FIG. 9C, an illustrative example of a system is shown and generally designated 970. The system 970 may correspond to the system 100 of FIG. 1. For example, the system 100, the first device 104 of FIG. 1, or both, may include one or more components of the system 970. The system 970 may include the memory 153, a shift refiner 921, or both. The shift refiner 921 may correspond to the shift refiner 511 of FIG. 5.

FIG. 9C also includes a flow chart of an illustrative method of operation generally designated 971. The method 971 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911 of FIG. 9A, the shift refiner 921, or a combination thereof.

The method 971 includes determining whether a difference between the first mismatch value 962 and the interpolated mismatch value 538 is non-zero, at 972. For example, the shift refiner 921 may determine whether a difference between the first mismatch value 962 and the interpolated mismatch value 538 is non-zero.

The method 971 includes, in response to determining that the difference between the first mismatch value 962 and the interpolated mismatch value 538 is zero, at 972, setting the amended mismatch value 540 to the interpolated mismatch value 538, at 973. For example, the shift refiner 921 may, in response to determining that the difference between the first mismatch value 962 and the interpolated mismatch value 538 is zero, determine the amended mismatch value 540 based on the interpolated mismatch value 538 (e.g., the amended mismatch value 540=the interpolated mismatch value 538).

The method 971 includes, in response to determining that the difference between the first mismatch value 962 and the interpolated mismatch value 538 is non-zero, at 972, determining whether an absolute value of the offset 957 is greater than a threshold, at 975. For example, the shift refiner 921 may, in response to determining that the difference between the first mismatch value 962 and the interpolated mismatch value 538 is non-zero, determine whether an absolute value of the offset 957 is greater than a threshold. The offset 957 may correspond to a difference between the first mismatch value 962 and the unconstrained interpolated mismatch value 956, as described with reference to FIG. 9B. The threshold may correspond to an interpolated shift limitation MAX_SHIFT_CHANGE (e.g., 4).

The method 971 includes, in response to determining that a difference between the first mismatch value 962 and the interpolated mismatch value 538 is non-zero, at 972, or determining that the absolute value of the offset 957 is less than or equal to the threshold, at 975, setting the lower mismatch value 930 to a difference between a first threshold and a minimum of the first mismatch value 962 and the interpolated mismatch value 538, and setting the greater mismatch value 932 to a sum of a second threshold and a maximum of the first mismatch value 962 and the interpolated mismatch value 538, at 976. For example, the shift refiner 921 may, in response to determining that the absolute value of the offset 957 is less than or equal to the threshold, determine the lower mismatch value 930 based on a difference between a first threshold and a minimum of the first mismatch value 962 and the interpolated mismatch value 538. The shift refiner 921 may also determine the greater mismatch value 932 based on a sum of a second threshold and a maximum of the first mismatch value 962 and the interpolated mismatch value 538.

The method 971 also includes generating the comparison values 916 based on the first audio signal 130 and the mismatch values 960 applied to the second audio signal 132, at 977. For example, the shift refiner 921 (or the signal comparator 506) may generate the comparison values 916, as described with reference to FIG. 7, based on the first audio signal 130 and the mismatch values 960 applied to the second audio signal 132. The mismatch values 960 may range from the lower mismatch value 930 to the greater mismatch value 932. The method 971 may proceed to 979.

The method 971 includes, in response to determining that the absolute value of the offset 957 is greater than the threshold, at 975, generating a comparison value 915 based on the first audio signal 130 and the unconstrained interpolated mismatch value 956 applied to the second audio signal 132, at 978. For example, the shift refiner 921 (or the signal comparator 506) may generate the comparison value 915, as described with reference to FIG. 7, based on the first audio signal 130 and the unconstrained interpolated mismatch value 956 applied to the second audio signal 132.

The method 971 also includes determining the amended mismatch value 540 based on the comparison values 916, the comparison value 915, or a combination thereof, at 979. For example, the shift refiner 921 may determine the amended mismatch value 540 based on the comparison values 916, the comparison value 915, or a combination thereof, as described with reference to FIG. 9A. In some implementations, the shift refiner 921 may determine the amended mismatch value 540 based on a comparison of the comparison value 915 and the comparison values 916 to avoid local maxima due to shift variation.

In some cases, an inherent pitch of the first audio signal 130, the first resampled signal 530, the second audio signal 132, the second resampled signal 532, or a combination thereof, may interfere with the shift estimation process. In such cases, pitch de-emphasis or pitch filtering may be performed to reduce the interference due to pitch and to improve reliability of shift estimation between multiple channels. In some cases, background noise may be present in the first audio signal 130, the first resampled signal 530, the second audio signal 132, the second resampled signal 532, or a combination thereof, that may interfere with the shift estimation process. In such cases, noise suppression or noise cancellation may be used to improve reliability of shift estimation between multiple channels.

Figure 10A:
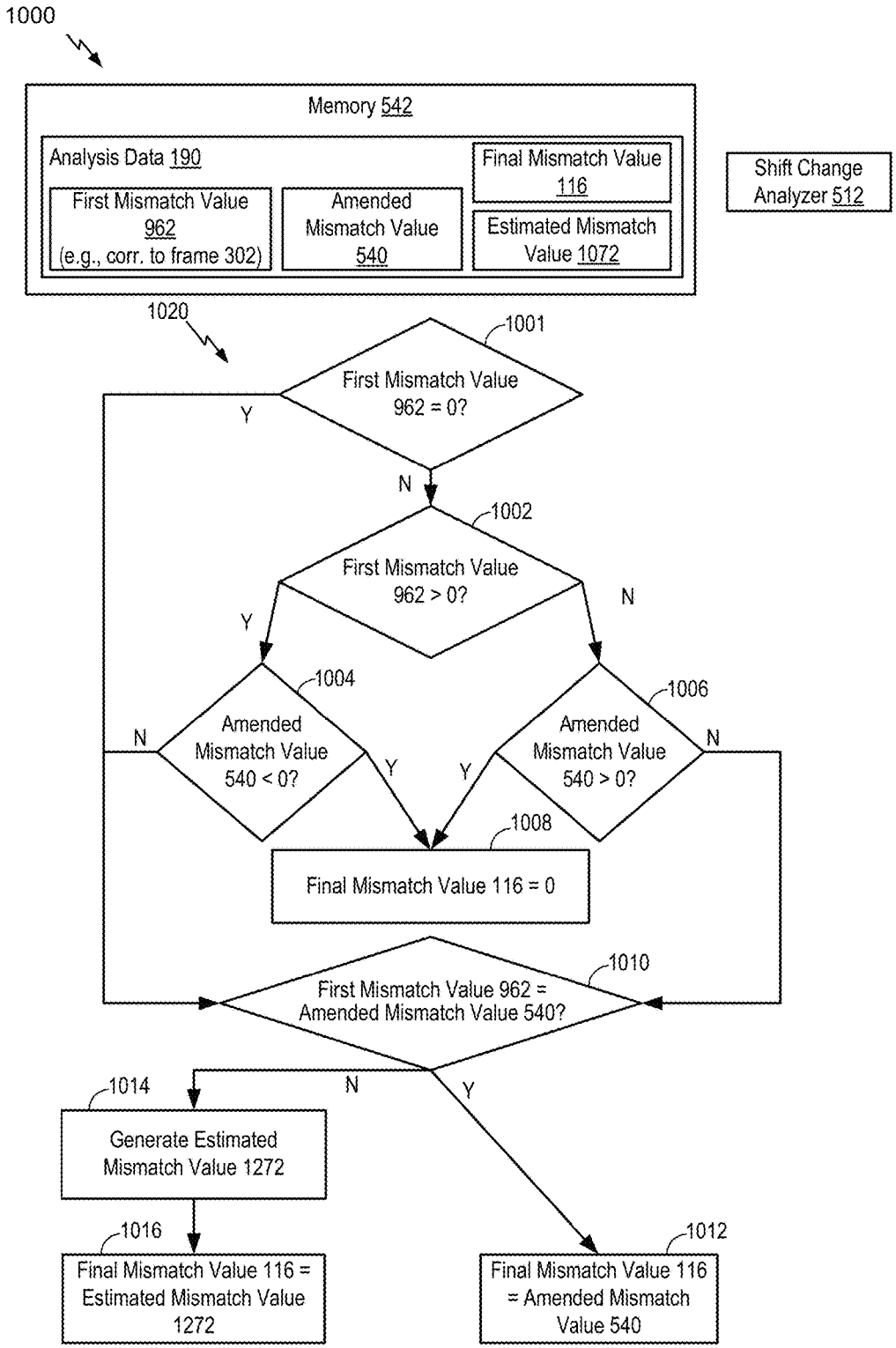
FIG. 10A is a diagram illustrating another example of a system operable to encode multiple channels.

Referring to FIG. 10A, an illustrative example of a system is shown and generally designated 1000. The system 1000 may correspond to the system 100 of FIG. 1. For example, the system 100, the first device 104 of FIG. 1, or both, may include one or more components of the system 1000.

FIG. 10A also includes a flow chart of an illustrative method of operation generally designated 1020. The method 1020 may be performed by the shift change analyzer 512, the temporal equalizer 108, the encoder 114, the first device 104, or a combination thereof.

The method 1020 includes determining whether the first mismatch value 962 is equal to 0, at 1001. For example, the shift change analyzer 512 may determine whether the first mismatch value 962 corresponding to the frame 302 has a first value (e.g., 0) indicating no time shift. The method 1020 includes, in response to determining that the first mismatch value 962 is equal to 0, at 1001, proceeding to 1010.

The method 1020 includes, in response to determining that the first mismatch value 962 is non-zero, at 1001, determining whether the first mismatch value 962 is greater than 0, at 1002. For example, the shift change analyzer 512 may determine whether the first mismatch value 962 corresponding to the frame 302 has a first value (e.g., a positive value) indicating that the second audio signal 132 is delayed in time relative to the first audio signal 130.

The method 1020 includes, in response to determining that the first mismatch value 962 is greater than 0, at 1002, determining whether the amended mismatch value 540 is less than 0, at 1004. For example, the shift change analyzer 512 may, in response to determining that the first mismatch value 962 has the first value (e.g., a positive value), determine whether the amended mismatch value 540 has a second value (e.g., a negative value) indicating that the first audio signal 130 is delayed in time relative to the second audio signal 132. The method 1020 includes, in response to determining that the amended mismatch value 540 is less than 0, at 1004, proceeding to 1008. The method 1020 includes, in response to determining that the amended mismatch value 540 is greater than or equal to 0, at 1004, proceeding to 1010.

The method 1020 includes, in response to determining that the first mismatch value 962 is less than 0, at 1002, determining whether the amended mismatch value 540 is greater than 0, at 1006. For example, the shift change analyzer 512 may in response to determining that the first mismatch value 962 has the second value (e.g., a negative value), determine whether the amended mismatch value 540 has a first value (e.g., a positive value) indicating that the second audio signal 132 is delayed in time with respect to the first audio signal 130. The method 1020 includes, in response to determining that the amended mismatch value 540 is greater than 0, at 1006, proceeding to 1008. The method 1020 includes, in response to determining that the amended mismatch value 540 is less than or equal to 0, at 1006, proceeding to 1010.

The method 1020 includes setting the final mismatch value 116 to 0, at 1008. For example, the shift change analyzer 512 may set the final mismatch value 116 to a particular value (e.g., 0) that indicates no time shift.

The method 1020 includes determining whether the first mismatch value 962 is equal to the amended mismatch value 540, at 1010. For example, the shift change analyzer 512 may determine whether the first mismatch value 962 and the amended mismatch value 540 indicate the same time delay between the first audio signal 130 and the second audio signal 132.

The method 1020 includes, in response to determining that the first mismatch value 962 is equal to the amended mismatch value 540, at 1010, setting the final mismatch value 116 to the amended mismatch value 540, at 1012. For example, the shift change analyzer 512 may set the final mismatch value 116 to the amended mismatch value 540.

The method 1020 includes, in response to determining that the first mismatch value 962 is not equal to the amended mismatch value 540, at 1010, generating an estimated mismatch value 1072, at 1014. For example, the shift change analyzer 512 may determine the estimated mismatch value 1072 by refining the amended mismatch value 540, as further described with reference to FIG. 11.

The method 1020 includes setting the final mismatch value 116 to the estimated mismatch value 1072, at 1016.

For example, the shift change analyzer 512 may set the final mismatch value 116 to the estimated mismatch value 1072.

In some implementations, the shift change analyzer 512 may set the non-causal mismatch value 162 to indicate the second estimated mismatch value in response to determining that the delay between the first audio signal 130 and the second audio signal 132 did not switch. For example, the shift change analyzer 512 may set the non-causal mismatch value 162 to indicate the amended mismatch value 540 in response to determining that the first mismatch value 962 is equal to 0, 1001, that the amended mismatch value 540 is greater than or equal to 0, at 1004, or that the amended mismatch value 540 is less than or equal to 0, at 1006.

The shift change analyzer 512 may thus set the non-causal mismatch value 162 to indicate no time shift in response to determining that delay between the first audio signal 130 and the second audio signal 132 switched between the frame 302 and the frame 304 of FIG. 3. Preventing the non-causal mismatch value 162 from switching directions (e.g., positive to negative or negative to positive) between consecutive frames may reduce distortion in down mix signal generation at the encoder 114, avoid use of additional delay for up-mix synthesis at a decoder, or both.

Figure 10B:
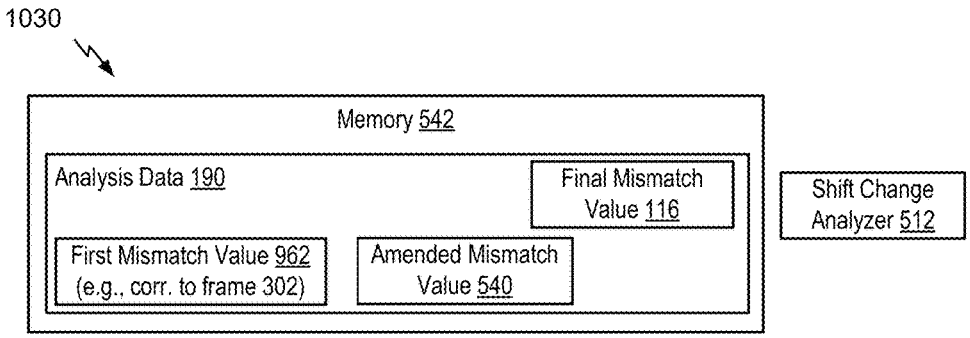
FIG. 10B is a diagram illustrating another example of a system operable to encode multiple channels.
Figure 10B:
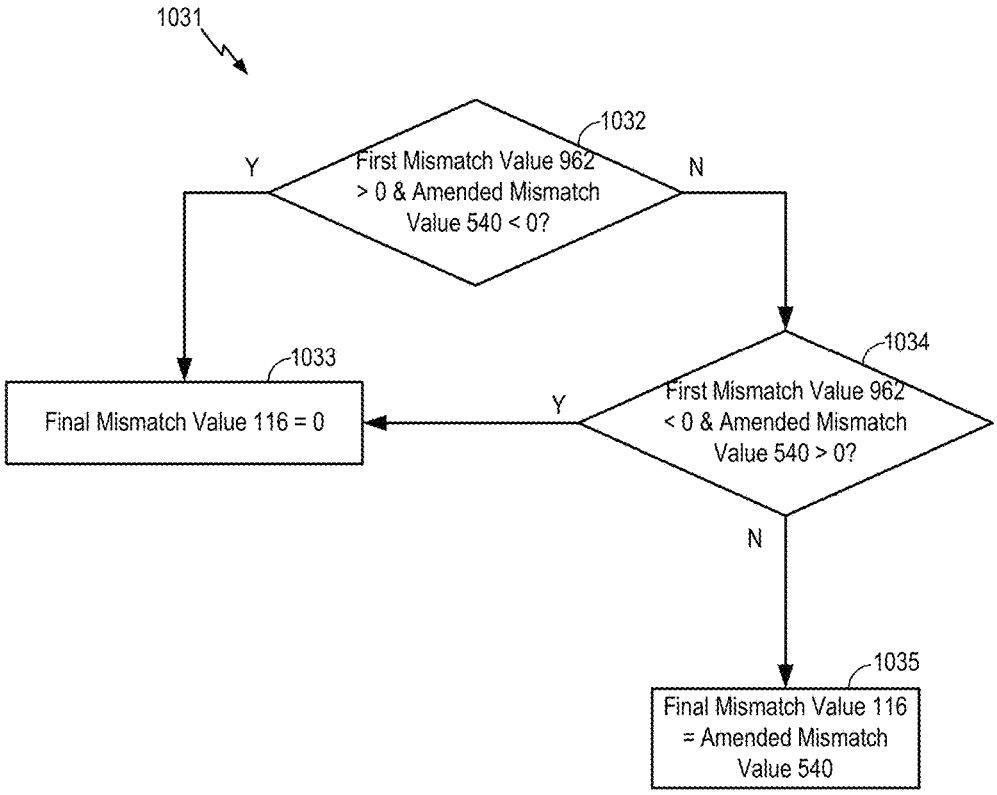

Referring to FIG. 10B, an illustrative example of a system is shown and generally designated 1030. The system 1030 may correspond to the system 100 of FIG. 1. For example, the system 100, the first device 104 of FIG. 1, or both, may include one or more components of the system 1030.

FIG. 10B also includes a flow chart of an illustrative method of operation generally designated 1031. The method 1031 may be performed by the shift change analyzer 512, the temporal equalizer 108, the encoder 114, the first device 104, or a combination thereof.

The method 1031 includes determining whether the first mismatch value 962 is greater than zero and the amended mismatch value 540 is less than zero, at 1032. For example, the shift change analyzer 512 may determine whether the first mismatch value 962 is greater than zero and whether the amended mismatch value 540 is less than zero.

The method 1031 includes, in response to determining that the first mismatch value 962 is greater than zero and that the amended mismatch value 540 is less than zero, at 1032, setting the final mismatch value 116 to zero, at 1033. For example, the shift change analyzer 512 may, in response to determining that the first mismatch value 962 is greater than zero and that the amended mismatch value 540 is less than zero, set the final mismatch value 116 to a first value (e.g., 0) that indicates no time shift.

The method 1031 includes, in response to determining that the first mismatch value 962 is less than or equal to zero or that the amended mismatch value 540 is greater than or equal to zero, at 1032, determining whether the first mismatch value 962 is less than zero and whether the amended mismatch value 540 is greater than zero, at 1034. For example, the shift change analyzer 512 may, in response to determining that the first mismatch value 962 is less than or equal to zero or that the amended mismatch value 540 is greater than or equal to zero, determine whether the first mismatch value 962 is less than zero and whether the amended mismatch value 540 is greater than zero.

The method 1031 includes, in response to determining that the first mismatch value 962 is less than zero and that the amended mismatch value 540 is greater than zero, proceeding to 1033. The method 1031 includes, in response to determining that the first mismatch value 962 is greater than or equal to zero or that the amended mismatch value 540 is less than or equal to zero, setting the final mismatch value 116 to the amended mismatch value 540, at 1035. For example, the shift change analyzer 512 may, in response to determining that the first mismatch value 962 is greater than or equal to zero or that the amended mismatch value 540 is less than or equal to zero, set the final mismatch value 116 to the amended mismatch value 540.

Figure 11:
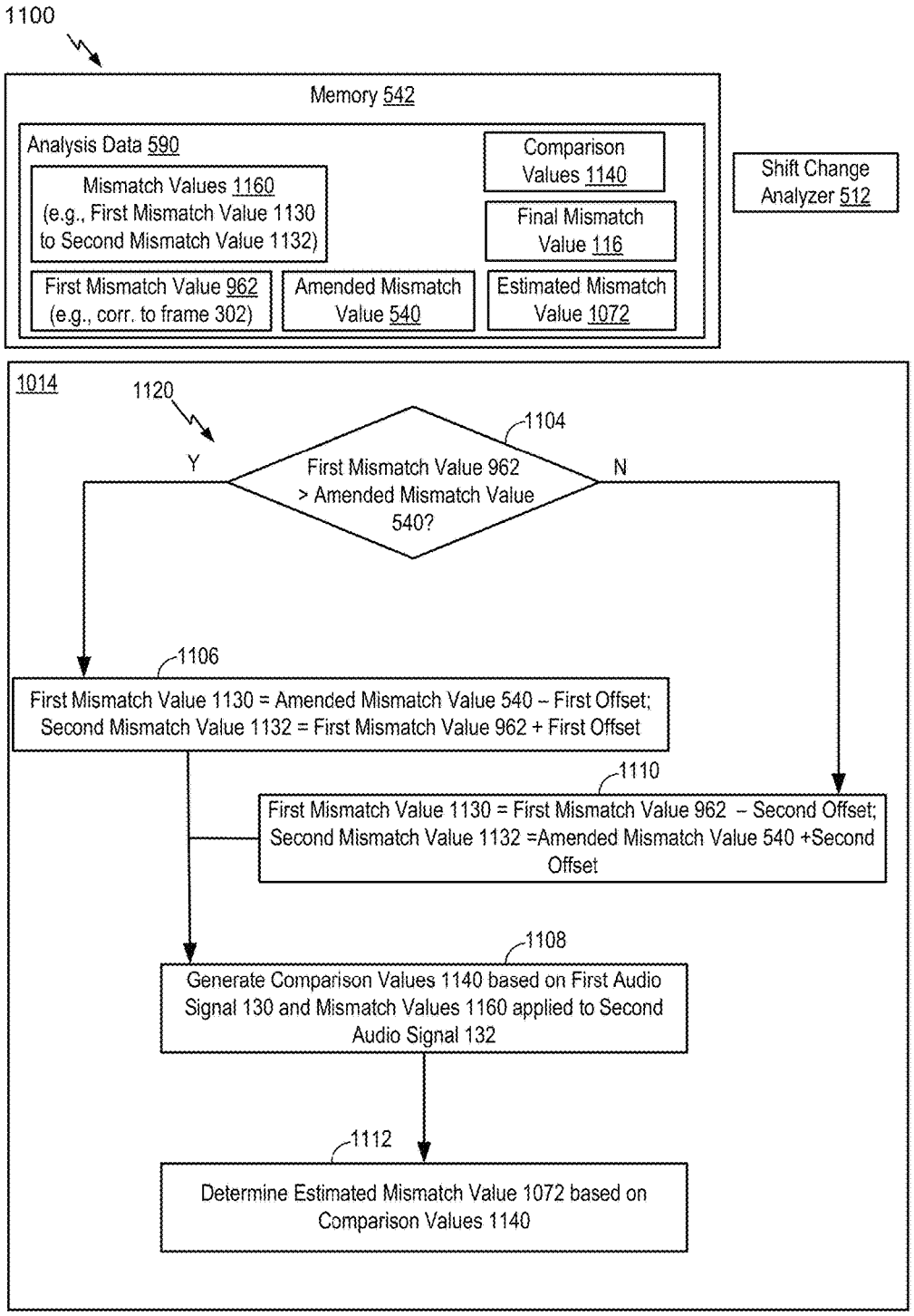
FIG. 11 is a diagram illustrating another example of a system operable to encode multiple channels.

Referring to FIG. 11, an illustrative example of a system is shown and generally designated 1100. The system 1100 may correspond to the system 100 of FIG. 1. For example, the system 100, the first device 104 of FIG. 1, or both, may include one or more components of the system 1100. FIG. 11 also includes a flow chart illustrating a method of operation that is generally designated 1120. The method 1120 may be performed by the shift change analyzer 512, the temporal equalizer 108, the encoder 114, the first device 104, or a combination thereof. The method 1120 may correspond to the step 1014 of FIG. 10A.

The method 1120 includes determining whether the first mismatch value 962 is greater than the amended mismatch value 540, at 1104. For example, the shift change analyzer 512 may determine whether the first mismatch value 962 is greater than the amended mismatch value 540.

The method 1120 also includes, in response to determining that the first mismatch value 962 is greater than the amended mismatch value 540, at 1104, setting a first mismatch value 1130 to a difference between the amended mismatch value 540 and a first offset, and setting a second mismatch value 1132 to a sum of the first mismatch value 962 and the first offset, at 1106. For example, the shift change analyzer 512 may, in response to determining that the first mismatch value 962 (e.g., 20) is greater than the amended mismatch value 540 (e.g., 18), determine the first mismatch value 1130 (e.g., 17) based on the amended mismatch value 540 (e.g., amended mismatch value 540—a first offset). Alternatively, or in addition, the shift change analyzer 512 may determine the second mismatch value 1132 (e.g., 21) based on the first mismatch value 962 (e.g., the first mismatch value 962+the first offset). The method 1120 may proceed to 1108.

The method 1120 further includes, in response to determining that the first mismatch value 962 is less than or equal to the amended mismatch value 540, at 1104, setting the first mismatch value 1130 to a difference between the first mismatch value 962 and a second offset, and setting the second mismatch value 1132 to a sum of the amended mismatch value 540 and the second offset. For example, the shift change analyzer 512 may, in response to determining that the first mismatch value 962 (e.g., 10) is less than or equal to the amended mismatch value 540 (e.g., 12), determine the first mismatch value 1130 (e.g., 9) based on the first mismatch value 962 (e.g., first mismatch value 962—a second offset). Alternatively, or in addition, the shift change analyzer 512 may determine the second mismatch value 1132 (e.g., 13) based on the amended mismatch value 540 (e.g., the amended mismatch value 540+the second offset). The first offset (e.g., 2) may be distinct from the second offset (e.g., 3). In some implementations, the first offset may be the same as the second offset. A higher value of the first offset, the second offset, or both, may improve a search range.

The method 1120 also includes generating comparison values 1140 based on the first audio signal 130 and mismatch values 1160 applied to the second audio signal 132, at 1108. For example, the shift change analyzer 512 may generate the comparison values 1140, as described with reference to FIG. 7, based on the first audio signal 130 and the mismatch values 1160 applied to the second audio signal 132. To illustrate, the mismatch values 1160 may range from the first mismatch value 1130 (e.g., 17) to the second mismatch value 1132 (e.g., 21). The shift change analyzer 512 may generate a particular comparison value of the comparison values 1140 based on the samples 326-332 and a particular subset of the second samples 350. The particular subset of the second samples 350 may correspond to a particular mismatch value (e.g., 17) of the mismatch values 1160. The particular comparison value may indicate a difference (or a correlation) between the samples 326-332 and the particular subset of the second samples 350.

The method 1120 further includes determining the estimated mismatch value 1072 based on the comparison values 1140, at 1112. For example, the shift change analyzer 512 may, when the comparison values 1140 correspond to cross-correlation values, select a highest comparison value of the comparison values 1140 as the estimated mismatch value 1072. Alternatively, the shift change analyzer 512 may, when the comparison values 1140 correspond to difference values, select a lowest comparison value of the comparison values 1140 as the estimated mismatch value 1072.

The method 1120 may thus enable the shift change analyzer 512 to generate the estimated mismatch value 1072 by refining the amended mismatch value 540. For example, the shift change analyzer 512 may determine the comparison values 1140 based on original samples and may select the estimated mismatch value 1072 corresponding to a comparison value of the comparison values 1140 that indicates a highest correlation (or lowest difference).

Figure 12:
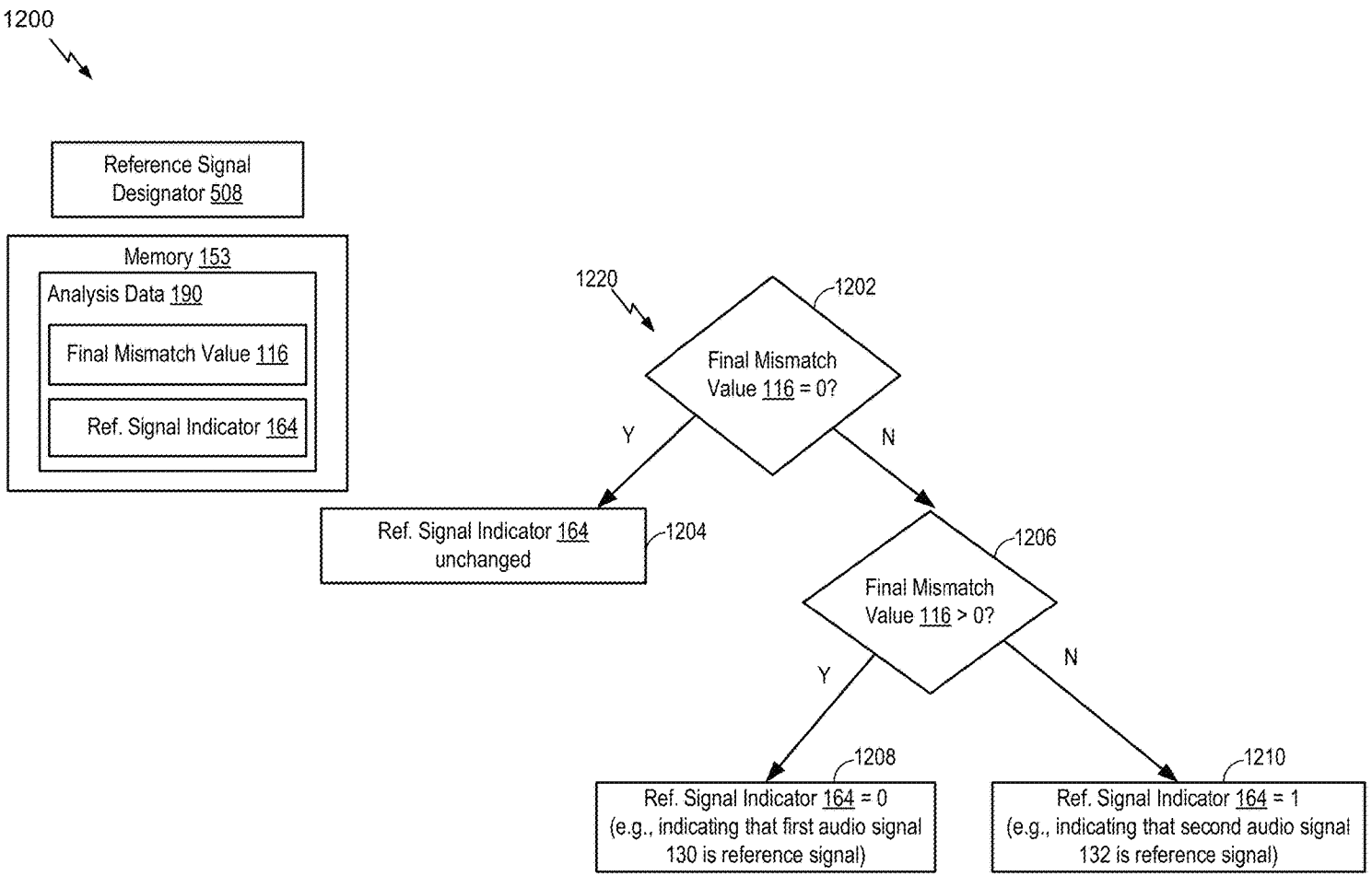
FIG. 12 is a diagram illustrating another example of a system operable to encode multiple channels.

Referring to FIG. 12, an illustrative example of a system is shown and generally designated 1200. The system 1200 may correspond to the system 100 of FIG. 1. For example, the system 100, the first device 104 of FIG. 1, or both, may include one or more components of the system 1200. FIG. 12 also includes a flow chart illustrating a method of operation that is generally designated 1220. The method 1220 may be performed by the reference signal designator 508, the temporal equalizer 108, the encoder 114, the first device 104, or a combination thereof.

The method 1220 includes determining whether the final mismatch value 116 is equal to 0, at 1202. For example, the reference signal designator 508 may determine whether the final mismatch value 116 has a particular value (e.g., 0) indicating no time shift.

The method 1220 includes, in response to determining that the final mismatch value 116 is equal to 0, at 1202, leaving the reference signal indicator 164 unchanged, at 1204. For example, the reference signal designator 508 may, in response to determining that the final mismatch value 116 has the particular value (e.g., 0) indicating no time shift, leave the reference signal indicator 164 unchanged. To illustrate, the reference signal indicator 164 may indicate that the same audio signal (e.g., the first audio signal 130 or the second audio signal 132) is a reference signal associated with the frame 304 as with the frame 302.

The method 1220 includes, in response to determining that the final mismatch value 116 is non-zero, at 1202, determining whether the final mismatch value 116 is greater than 0, at 1206. For example, the reference signal designator 508 may, in response to determining that the final mismatch value 116 has a particular value (e.g., a non-zero value) indicating a time shift, determine whether the final mismatch value 116 has a first value (e.g., a positive value) indicating that the second audio signal 132 is delayed relative to the first audio signal 130 or a second value (e.g., a negative value) indicating that the first audio signal 130 is delayed relative to the second audio signal 132.

The method 1220 includes, in response to determining that the final mismatch value 116 has the first value (e.g., a positive value), set the reference signal indicator 164 to have a first value (e.g., 0) indicating that the first audio signal 130 is a reference signal, at 1208. For example, the reference signal designator 508 may, in response to determining that the final mismatch value 116 has the first value (e.g., a positive value), set the reference signal indicator 164 to a first value (e.g., 0) indicating that the first audio signal 130 is a reference signal. The reference signal designator 508 may, in response to determining that the final mismatch value 116 has the first value (e.g., the positive value), determine that the second audio signal 132 corresponds to a target signal.

The method 1220 includes, in response to determining that the final mismatch value 116 has the second value (e.g., a negative value), set the reference signal indicator 164 to have a second value (e.g., 1) indicating that the second audio signal 132 is a reference signal, at 1210. For example, the reference signal designator 508 may, in response to determining that the final mismatch value 116 has the second value (e.g., a negative value) indicating that the first audio signal 130 is delayed relative to the second audio signal 132, set the reference signal indicator 164 to a second value (e.g., 1) indicating that the second audio signal 132 is a reference signal. The reference signal designator 508 may, in response to determining that the final mismatch value 116 has the second value (e.g., the negative value), determine that the first audio signal 130 corresponds to a target signal.

The reference signal designator 508 may provide the reference signal indicator 164 to the gain parameter generator 514. The gain parameter generator 514 may determine a gain parameter (e.g., a gain parameter 160) of a target signal based on a reference signal, as described with reference to FIG. 5.

A target signal may be delayed in time relative to a reference signal. The reference signal indicator 164 may indicate whether the first audio signal 130 or the second audio signal 132 corresponds to the reference signal. The reference signal indicator 164 may indicate whether the gain parameter 160 corresponds to the first audio signal 130 or the second audio signal 132.

Figure 13:
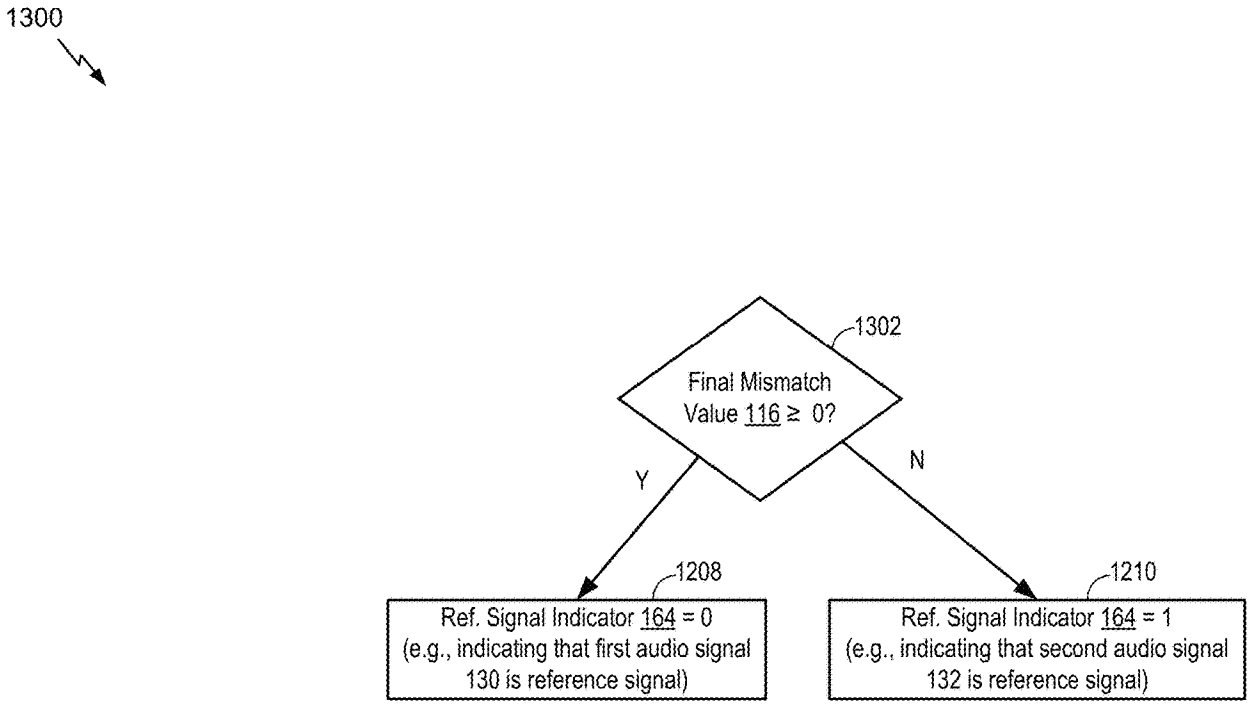
FIG. 13 is a flow chart illustrating a particular method of encoding multiple channels.

Referring to FIG. 13, a flow chart illustrating a particular method of operation is shown and generally designated 1300. The method 1300 may be performed by the reference signal designator 508, the temporal equalizer 108, the encoder 114, the first device 104, or a combination thereof.

The method 1300 includes determining whether the final mismatch value 116 is greater than or equal to zero, at 1302. For example, the reference signal designator 508 may determine whether the final mismatch value 116 is greater than or equal to zero. The method 1300 also includes, in response to determining that the final mismatch value 116 is greater than or equal to zero, at 1302, proceeding to 1208. The method 1300 further includes, in response to determining that the final mismatch value 116 is less than zero, at 1302, proceeding to 1210. The method 1300 differs from the method 1220 of FIG. 12 in that, in response to determining that the final mismatch value 116 has a particular value (e.g., 0) indicating no time shift, the reference signal indicator 164 is set to a first value (e.g., 0) indicating that the first audio signal 130 corresponds to a reference signal. In some implementations, the reference signal designator 508 may perform the method 1220. In other implementations, the reference signal designator 508 may perform the method 1300.

The method 1300 may thus enable setting the reference signal indicator 164 to a particular value (e.g., 0) indicating that the first audio signal 130 corresponds to a reference signal when the first mismatch value 116 indicates no time shift independently of whether the first audio signal 130 corresponds to the reference signal for the frame 302.

Figure 14:
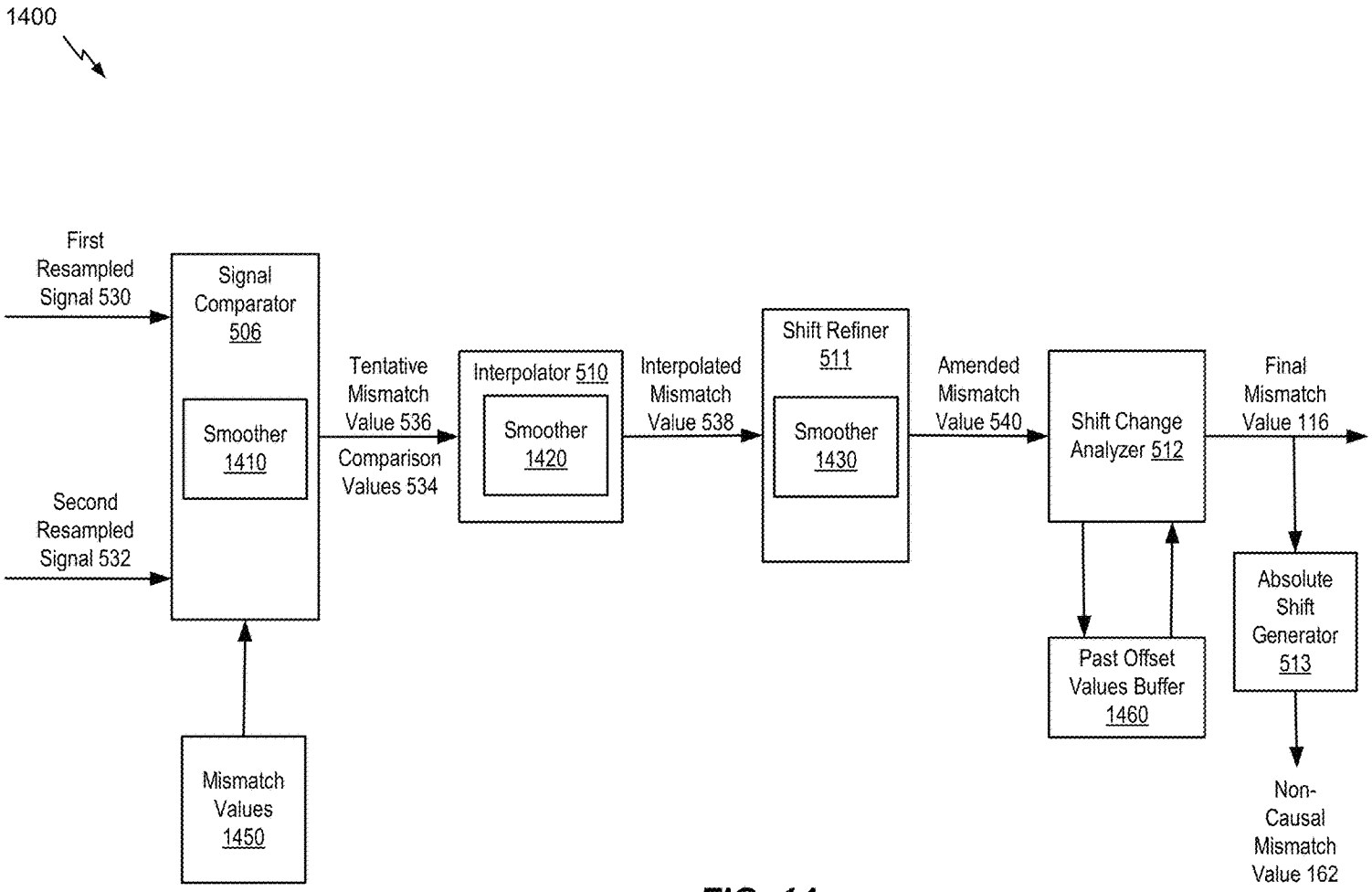
FIG. 14 is a diagram illustrating another example of a system operable to encode multiple channels.

Referring to FIG. 14, an illustrative example of a system is shown and generally designated 1400. The system 1400 includes the signal comparator 506 of FIG. 5, the interpolator 510 of FIG. 5, the shift refiner 511 of FIG. 5, and the shift change analyzer 512 of FIG. 5.

The signal comparator 506 may generate the comparison values 534 (e.g., difference values, similarity values, coherence values, or cross-correlation values), the tentative mismatch value 536, or both. For example, the signal comparator 506 may generate the comparison values 534 based on the first resampled signal 530 and a plurality of mismatch values 1450 applied to the second resampled signal 532. The signal comparator 506 may determine the tentative mismatch value 536 based on the comparison values 534. The signal comparator 506 includes a smoother 1410 configured to retrieve comparison values for previous frames of the resampled signals 530, 532 and may modify the comparison values 534 based on a long-term smoothing operation using the comparison values for previous frames. For example, the comparison values 534 may include the long-term comparison value $CompVal_{LT_N}(k)$ for a current frame (N) and may be represented by $CompVal_{LT_N}(k)=(1-\alpha)*CompVal_N(k), +(\alpha)*CompVal_{LT_{N-1}}(k)$, where $\alpha\in(0, 1.0)$. Thus, the long-term comparison value $CompVal_{LT_N}(k)$ may be based on a weighted mixture of the instantaneous comparison value $CompVal_N(k)$ at frame N and the long-term comparison values $CompVal_{LT_{N-1}}(k)$ for one or more previous frames. As the value of a increases, the amount of smoothing in the long-term comparison value increases.

The smoothing parameter (e.g., the value of $\alpha$) may be controlled/adapted to limit the smoothing of comparison values during silence portions (or during background noise which may cause drift in the shift estimation), the comparison values may be smoothed based on a higher smoothing factor (e.g., $\alpha=0.995$); otherwise the smoothing can be based on $\alpha=0.9$. The control of the smoothing parameter (e.g., $\alpha$) may be based on whether the background energy or long-term energy is below a threshold, based on a coder type, or based on comparison value statistics.

In a particular implementation, the value of the smoothing parameter (e.g., $\alpha$) may be based on the short term signal level ($E_{ST}$) and the long term signal level ($E_{LT}$) of the channels. As an example the short term signal level may be calculated for the frame (N) being processed ($E_{ST}(N)$) as the sum of the sum of the absolute values of the downsampled reference samples and the sum of the absolute values of the downsampled target samples. The long term signal level may be a smoothed version of the short term signal levels. For example, $E_{LT}(N)=0.6*E_{LT}(N-1)+0.4*E_{ST}(N)$. Further, the value of the smoothing parameters (e.g., $\alpha$) may be controlled according to a pseudo-code.

In a particular implementation, the value of the smoothing parameter (e.g., $\alpha$) may be controlled based on the correlation of the short term and the long term comparison values. For example, when the comparison values of the current frame are very similar to the long term smoothed comparison values, it is an indication of a stationary talker and this could be used to control the smoothing parameters to further increase the smoothing (e.g., increase the value of $\alpha$). Other hand, when the comparison values as a function of the various shift values does not resemble the long term comparison values, the smoothing parameter can be adjusted to reduce smoothing (e.g., decrease the value of $\alpha$). The signal comparator 506 may provide the comparison values 534, the tentative mismatch value 536, or both, to the interpolator 510.

The interpolator 510 may extend the tentative mismatch value 536 to generate the interpolated mismatch value 538. For example, the interpolator 510 may generate interpolated comparison values corresponding to mismatch values that are proximate to the tentative mismatch value 536 by interpolating the comparison values 534. The interpolator 510 may determine the interpolated mismatch value 538 based on the interpolated comparison values and the comparison values 534. The comparison values 534 may be based on a coarser granularity of the mismatch values. The interpolated comparison values may be based on a finer granularity of mismatch values that are proximate to the resampled tentative mismatch value 536. Determining the comparison values 534 based on the coarser granularity (e.g., the first subset) of the set of mismatch values may use fewer resources (e.g., time, operations, or both) than determining the comparison values 534 based on a finer granularity (e.g., all) of the set of mismatch values. Determining the interpolated comparison values corresponding to the second subset of mismatch values may extend the tentative mismatch value 536 based on a finer granularity of a smaller set of mismatch values that are proximate to the tentative mismatch value 536 without determining comparison values corresponding to each mismatch value of the set of mismatch values. Thus, determining the tentative mismatch value 536 based on the first subset of mismatch values and determining the interpolated mismatch value 538 based on the interpolated comparison values may balance resource usage and refinement of the estimated mismatch value. The interpolator 510 may provide the interpolated mismatch value 538 to the shift refiner 511.

The interpolator 510 includes a smoother 1420 configured to retrieve interpolated mismatch values for previous frames and may modify the interpolated mismatch value 538 based on a long-term smoothing operation using the interpolated mismatch values for previous frames. For example, the interpolated mismatch value 538 may include a long-term interpolated mismatch value $InterVal_{LT_N}(k)$ for a current frame (N) and may be represented by $InterVal_{LT_N}(k)=(1-\alpha)*InterVal_N(k), +(\alpha)*InterVal_{LT_{N-1}}(k)$, where $\alpha\in(0, 1.0)$. Thus, the long-term interpolated mismatch value $InterVal_{LT_N}(k)$ may be based on a weighted mixture of the instantaneous interpolated mismatch value $InterVal_N(k)$ at frame N and the long-term interpolated mismatch values $InterVal_{LT_{N-1}}(k)$ for one or more previous frames. As the value of a increases, the amount of smoothing in the long-term comparison value increases.

The shift refiner 511 may generate the amended mismatch value 540 by refining the interpolated mismatch value 538. For example, the shift refiner 511 may determine whether the interpolated mismatch value 538 indicates that a change in a shift between the first audio signal 130 and the second audio signal 132 is greater than a shift change threshold. The change in the shift may be indicated by a difference between the interpolated mismatch value 538 and a first mismatch value associated with the frame 302 of FIG. 3. The shift refiner 511 may, in response to determining that the difference is less than or equal to the threshold, set the amended mismatch value 540 to the interpolated mismatch value 538. Alternatively, the shift refiner 511 may, in response to determining that the difference is greater than the threshold, determine a plurality of mismatch values that correspond to a difference that is less than or equal to the shift change threshold. The shift refiner 511 may determine comparison values based on the first audio signal 130 and the plurality of mismatch values applied to the second audio signal 132. The shift refiner 511 may determine the amended mismatch value 540 based on the comparison values. For example, the shift refiner 511 may select a mismatch value of the plurality of mismatch values based on the comparison values and the interpolated mismatch value 538. The shift refiner 511 may set the amended mismatch value 540 to indicate the selected mismatch value. A non-zero difference between the first mismatch value corresponding to the frame 302 and the interpolated mismatch value 538 may indicate that some samples of the second audio signal 132 correspond to both frames (e.g., the frame 302 and the frame 304). For example, some samples of the second audio signal 132 may be duplicated during encoding. Alternatively, the non-zero difference may indicate that some samples of the second audio signal 132 correspond to neither the frame 302 nor the frame 304. For example, some samples of the second audio signal 132 may be lost during encoding. Setting the amended mismatch value 540 to one of the plurality of mismatch values may prevent a large change in shifts between consecutive (or adjacent) frames, thereby reducing an amount of sample loss or sample duplication during encoding. The shift refiner 511 may provide the amended mismatch value 540 to the shift change analyzer 512.

The shift refiner 511 includes a smoother 1430 configured to retrieve amended mismatch values for previous frames and may modify the amended mismatch value 540 based on a long-term smoothing operation using the amended mismatch values for previous frames. For example, the amended mismatch value 540 may include a long-term amended mismatch value $AmendVal_{LT_N}(k)$ for a current frame (N) and may be represented by $AmendVal_{LT_N}(k)=(1-\alpha)*AmendVal_N(k), +(\alpha)*AmendVal_{LT_{N-1}}(k)$, where $\alpha\in(0, 1.0)$. Thus, the long-term amended mismatch value $AmendVal_{LT_N}(k)$ may be based on a weighted mixture of the instantaneous amended mismatch value $AmendVal_N(k)$ at frame N and the long-term amended mismatch values $AmendVal_{LT_{N-1}}(k)$ for one or more previous frames. As the value of a increases, the amount of smoothing in the long-term comparison value increases.

The shift change analyzer 512 may determine whether the amended mismatch value 540 indicates a switch or reverse in timing between the first audio signal 130 and the second audio signal 132. The shift change analyzer 512 may determine whether the delay between the first audio signal 130 and the second audio signal 132 has switched sign based on the amended mismatch value 540 and the first mismatch value associated with the frame 302. The shift change analyzer 512 may, in response to determining that the delay between the first audio signal 130 and the second audio signal 132 has switched sign, set the final mismatch value 116 to a value (e.g., 0) indicating no time shift. Alternatively, the shift change analyzer 512 may set the final mismatch value 116 to the amended mismatch value 540 in response to determining that the delay between the first audio signal 130 and the second audio signal 132 has not switched sign.

The shift change analyzer 512 may generate an estimated mismatch value by refining the amended mismatch value 540. The shift change analyzer 512 may set the final mismatch value 116 to the estimated mismatch value. Setting the final mismatch value 116 to indicate no time shift may reduce distortion at a decoder by refraining from time shifting the first audio signal 130 and the second audio signal 132 in opposite directions for consecutive (or adjacent) frames of the first audio signal 130. The shift change analyzer 512 may provide the final mismatch value 116 to the absolute shift generator 513. The absolute shift generator 513 may generate the non-causal mismatch value 162 by applying an absolute function to the final mismatch value 116.

The smoothing techniques described above may substantially normalize the shift estimate between voiced frames, unvoiced frames, and transition frames. Normalized shift estimates may reduce sample repetition and artifact skipping at frame boundaries. Additionally, normalized shift estimates may result in reduced side channel energies, which may improve coding efficiency.

As described with respect to FIG. 14, smoothing may be performed at the signal comparator 506, the interpolator 510, the shift refiner 511, or a combination thereof. If the interpolated shift is consistently different from the tentative shift at an input sampling rate (FSin), smoothing of the interpolated mismatch value 538 may be performed in addition to smoothing of the comparison values 534 or in alternative to smoothing of the comparison values 534. During estimation of the interpolated mismatch value 538, the interpolation process may be performed on smoothed long-term comparison values generated at the signal comparator 506, on un-smoothed comparison values generated at the signal comparator 506, or on a weighted mixture of interpolated smoothed comparison values and interpolated un-smoothed comparison values. If smoothing is performed at the interpolator 510, the interpolation may be extended to be performed at the proximity of multiple samples in addition to the tentative shift estimated in a current frame. For example, interpolation may be performed in proximity to a previous frame's shift (e.g., one or more of the previous tentative shift, the previous interpolated shift, the previous amended shift, or the previous final shift) and in proximity to the current frame's tentative shift. As a result, smoothing may be performed on additional samples for the interpolated mismatch values, which may improve the interpolated shift estimate.

Figure 15:
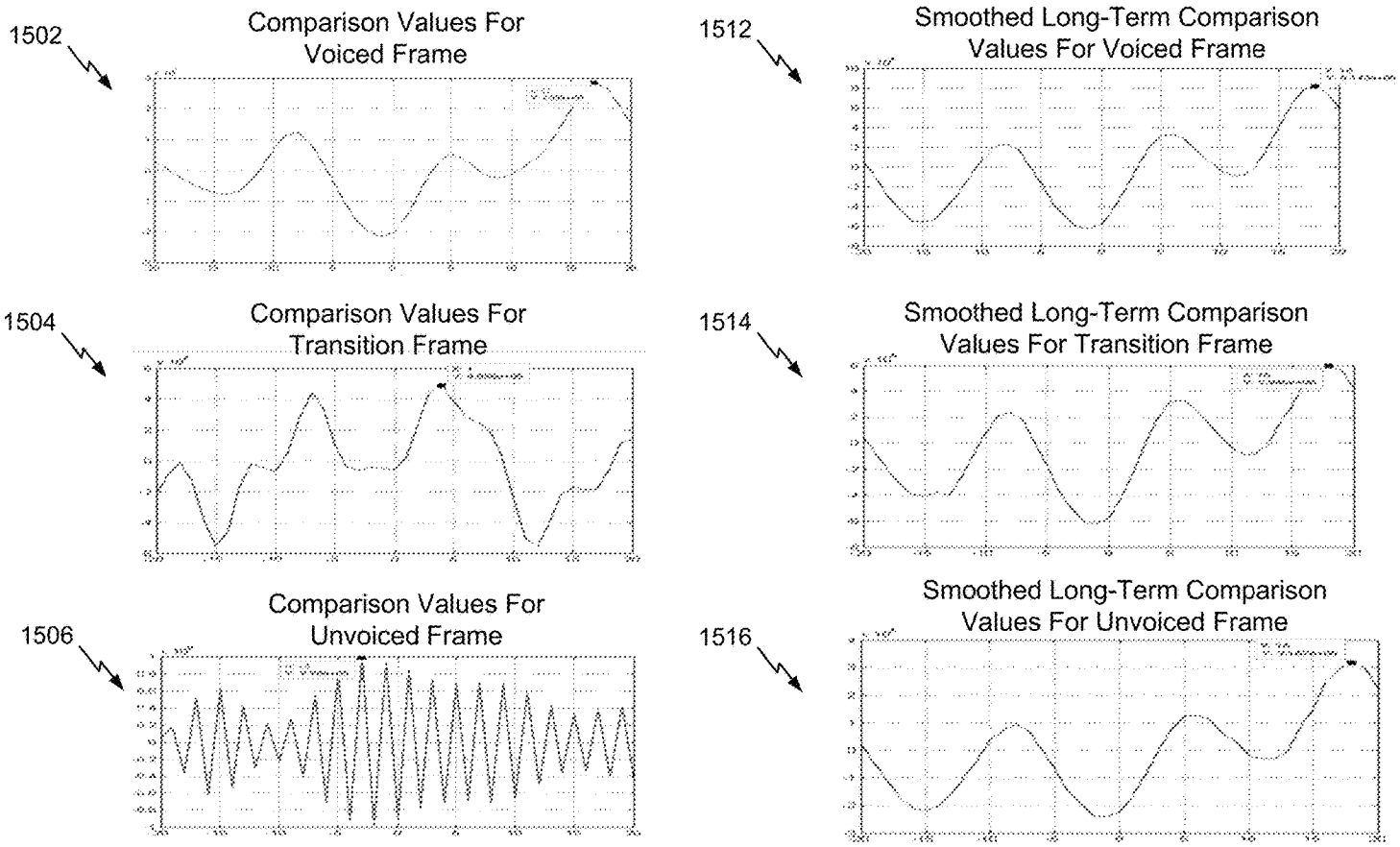
FIG. 15 depicts graphs illustrating comparison values for voiced frames, transition frames, and unvoiced frames.

Referring to FIG. 15, graphs illustrating comparison values for voiced frames, transition frames, and unvoiced frames are shown. According to FIG. 15, the graph 1502 illustrates comparison values (e.g., cross-correlation values) for a voiced frame processed without using the long-term smoothing techniques described, the graph 1504 illustrates comparison values for a transition frame processed without using the long-term smoothing techniques described, and the graph 1506 illustrates comparison values for an unvoiced frame processed without using the long-term smoothing techniques described.

The cross-correlation represented in each graph 1502, 1504, 1506 may be substantially different. For example, the graph 1502 illustrates that a peak cross-correlation between a voiced frame captured by the first microphone 146 of FIG. 1 and a corresponding voiced frame captured by the second microphone 148 of FIG. 1 occurs at approximately a 17 sample shift. However, the graph 1504 illustrates that a peak cross-correlation between a transition frame captured by the first microphone 146 and a corresponding transition frame captured by the second microphone 148 occurs at approximately a 4 sample shift. Moreover, the graph 1506 illustrates that a peak cross-correlation between an unvoiced frame captured by the first microphone 146 and a corresponding unvoiced frame captured by the second microphone 148 occurs at approximately a −3 sample shift. Thus, the shift estimate may be inaccurate for transition frames and unvoiced frames due to a relatively high level of noise.

According to FIG. 15, the graph 1512 illustrates comparison values (e.g., cross-correlation values) for a voiced frame processed using the long-term smoothing techniques described, the graph 1514 illustrates comparison values for a transition frame processed using the long-term smoothing techniques described, and the graph 1516 illustrates comparison values for an unvoiced frame processed using the long-term smoothing techniques described. The cross-correlation values in each graph 1512, 1514, 1516 may be substantially similar. For example, each graph 1512, 1514, 1516 illustrates that a peak cross-correlation between a frame captured by the first microphone 146 of FIG. 1 and a corresponding frame captured by the second microphone 148 of FIG. 1 occurs at approximately a 17 sample shift. Thus, the shift estimate for transition frames (illustrated by the graph 1514) and unvoiced frames (illustrated by the graph 1516) may be relatively accurate (or similar) to the shift estimate of the voiced frame in spite of noise.

The comparison value long-term smoothing process described with respect to FIG. 15 may be applied when the comparison values are estimated on the same shift ranges in each frame. The smoothing logic (e.g., the smoothers 1410, 1420, 1430) may be performed prior to estimation of a shift between the channels based on generated comparison values. For example, the smoothing may be performed prior to estimation of either the tentative shift, the estimation of interpolated shift, or the amended shift. To reduce adaptation of comparison values during silent portions (or background noise which may cause drift in the shift estimation), the comparison values may be smoothed based on a higher time-constant (e.g., $\alpha$=0.995); otherwise the smoothing may be based on $\alpha$=0.9. The determination whether to adjust the comparison values may be based on whether the background energy or long-term energy is below a threshold.

Figure 16:
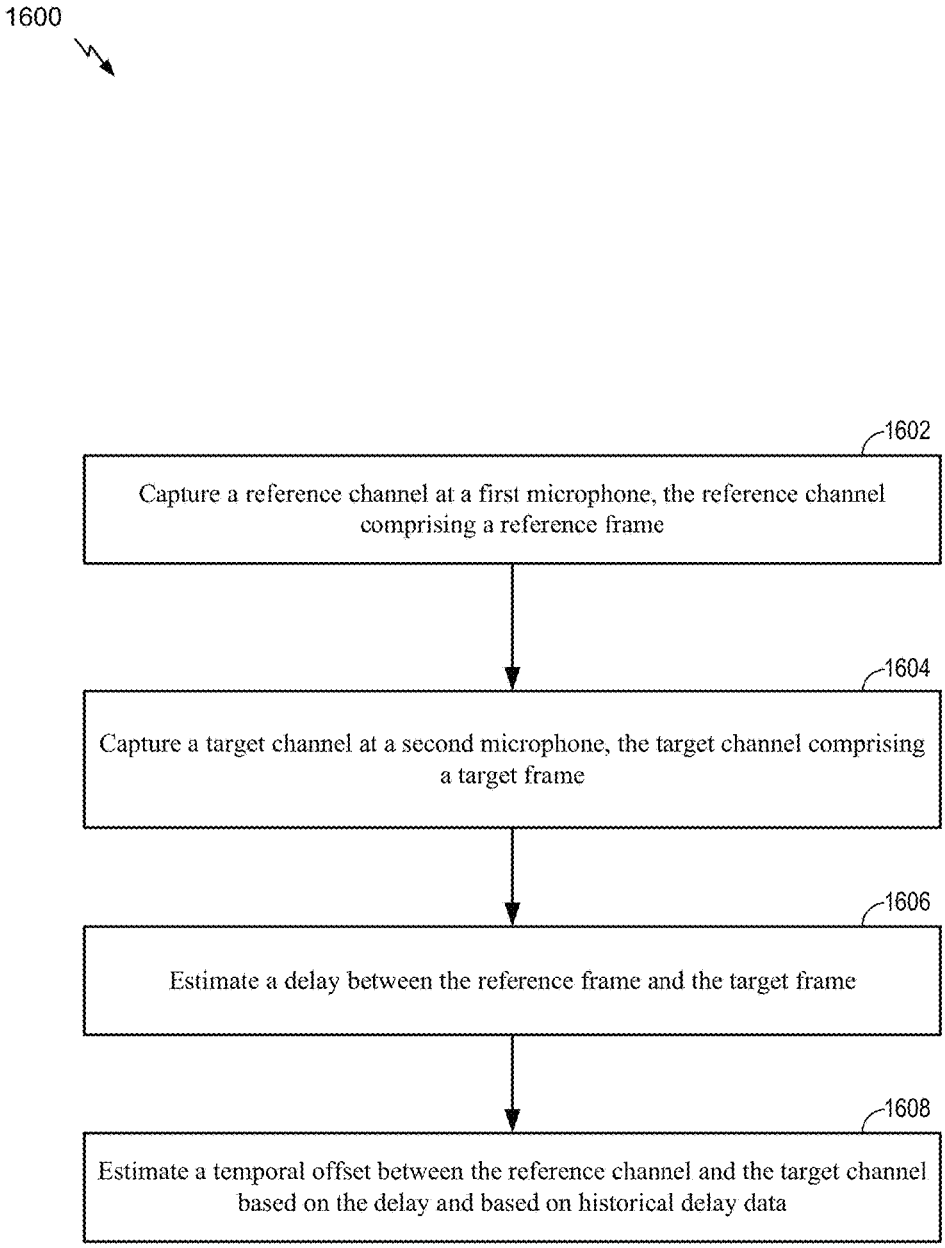
FIG. 16 is a flow chart illustrating a method of estimating a temporal offset between audio captured at multiple microphones.

Referring to FIG. 16, a flow chart illustrating a particular method of operation is shown and generally designated 1600. The method 1600 may be performed by the temporal equalizer 108, the encoder 114, the first device 104 of FIG. 1, or a combination thereof.

The method 1600 includes capturing a reference channel at a first microphone, at 1602. The reference channel may include a reference frame. For example, referring to FIG. 1, the first microphone 146 may capture the first audio signal 130 (e.g., the "reference channel" according to the method 1600). The first audio signal 130 may include a reference frame (e.g., the first frame 131).

A target channel may be captured at a second microphone, at 1604. The target channel may include a target frame. For example, referring to FIG. 1, the second microphone 148 may capture the second audio signal 132 (e.g., the "target channel" according to the method 1600). The second audio signal 132 may include a target frame (e.g., the second frame 133). The reference frame and the target frames may be one of voiced frames, transition frames, or unvoiced frames.

A delay between the reference frame and the target frame may be estimated, at 1606. For example, referring to FIG. 1, the temporal equalizer 108 may determine a cross-correlation between the reference frame and the target frame. A temporal offset between the reference channel and the target channel may be estimated based on the delay based on historical delay data, at 1608. For example, referring to FIG. 1, the temporal equalizer 108 may estimate a temporal offset between audio captured at the microphones 146, 148 (e.g., between the reference and target channels). The temporal offset may be estimated based on a delay between the first frame 131 (e.g., the reference frame) of the first audio signal 130 and the second frame 133 (e.g., the target frame) of the second audio signal 132. For example, the temporal equalizer 108 may use a cross-correlation function to estimate the delay between the reference frame and the target frame. The cross-correlation function may be used to measure the similarity of the two frames as a function of the lag of one frame relative to the other. Based on the cross-correlation function, the temporal equalizer 108 may determine the delay (e.g., lag) between the reference frame and the target frame. The temporal equalizer 108 may estimate the temporal offset between the first audio signal 130 (e.g., the reference channel) and the second audio signal 132 (e.g., the target channel) based on the delay and historical delay data.

The historical data may include delays between frames captured from the first microphone 146 and corresponding frames captured from the second microphone 148. For example, the temporal equalizer 108 may determine a cross-correlation (e.g., a lag) between previous frames associated with the first audio signal 130 and corresponding frames associated with the second audio signal 132. Each lag may be represented by a "comparison value". That is, a comparison value may indicate a time shift (k) between a frame of the first audio signal 130 and a corresponding frame of the second audio signal 132. According to one implementation, the comparison values for previous frames may be stored at the memory 153. A smoother 190 of the temporal equalizer 108 may "smooth" (or average) comparison values over a long-term set of frames and used the long-term smoothed comparison values for estimating a temporal offset (e.g., "shift") between the first audio signal 130 and the second audio signal 132.

Thus, the historical delay data may be generated based on smoothed comparison values associated with the first audio signal 130 and the second audio signal 132. For example, the method 1600 may include smoothing comparison values associated with the first audio signal 130 and the second audio signal 132 to generate the historical delay data. The smoothed comparison values may be based on frames of the first audio signal 130 generated earlier in time than the first frame and based on frames of the second audio signal 132 generated earlier in time than the second frame. According to one implementation, the method 1600 may include temporally shifting the second frame by the temporal offset.

To illustrate, if $CompVal_N(k)$ represents the comparison value at a shift of k for the frame N, the frame N may have comparison values from k=T_MIN (a minimum shift) to k=T_MAX (a maximum shift). The smoothing may be performed such that a long-term comparison value $CompVal_{LT_N}(k)$ is represented by $CompVal_{LT_N}(k)=f(CompVal_N(k), CompVal_{N-1}(k), CompVal_{LT_{N-2}}(k), \ldots)$. The function f in the above equation may be a function of all (or a subset) of past comparison values at the shift (k). An alternative representation of the may be $CompVal_{LT_N}(k)=g(CompVal_N(k), CompVal_{N-1}(k), CompVal_{N-2}(k), \ldots)$. The functions f or g may be simple finite impulse response (FIR) filters or infinite impulse response (IIR) filters, respectively. For example, the function g may be a single tap IIR filter such that the long-term comparison value $CompVal_{LT_N}(k)$ is represented by $CompVal_{LT_N}(k)=(1-\alpha)*CompVal_N(k), +(\alpha)*CompVal_{LT_{N-1}}(k)$, where $\alpha\in(0, 1.0)$. Thus, the long-term comparison value $CompVal_{LT_N}(k)$ may be based on a weighted mixture of the instantaneous comparison value $CompVal_N(k)$ at frame N and the long-term comparison values $CompVal_{LT_{N-1}}(k)$ for one or more previous frames. As the value of a increases, the amount of smoothing in the long-term comparison value increases.

Figure 17:
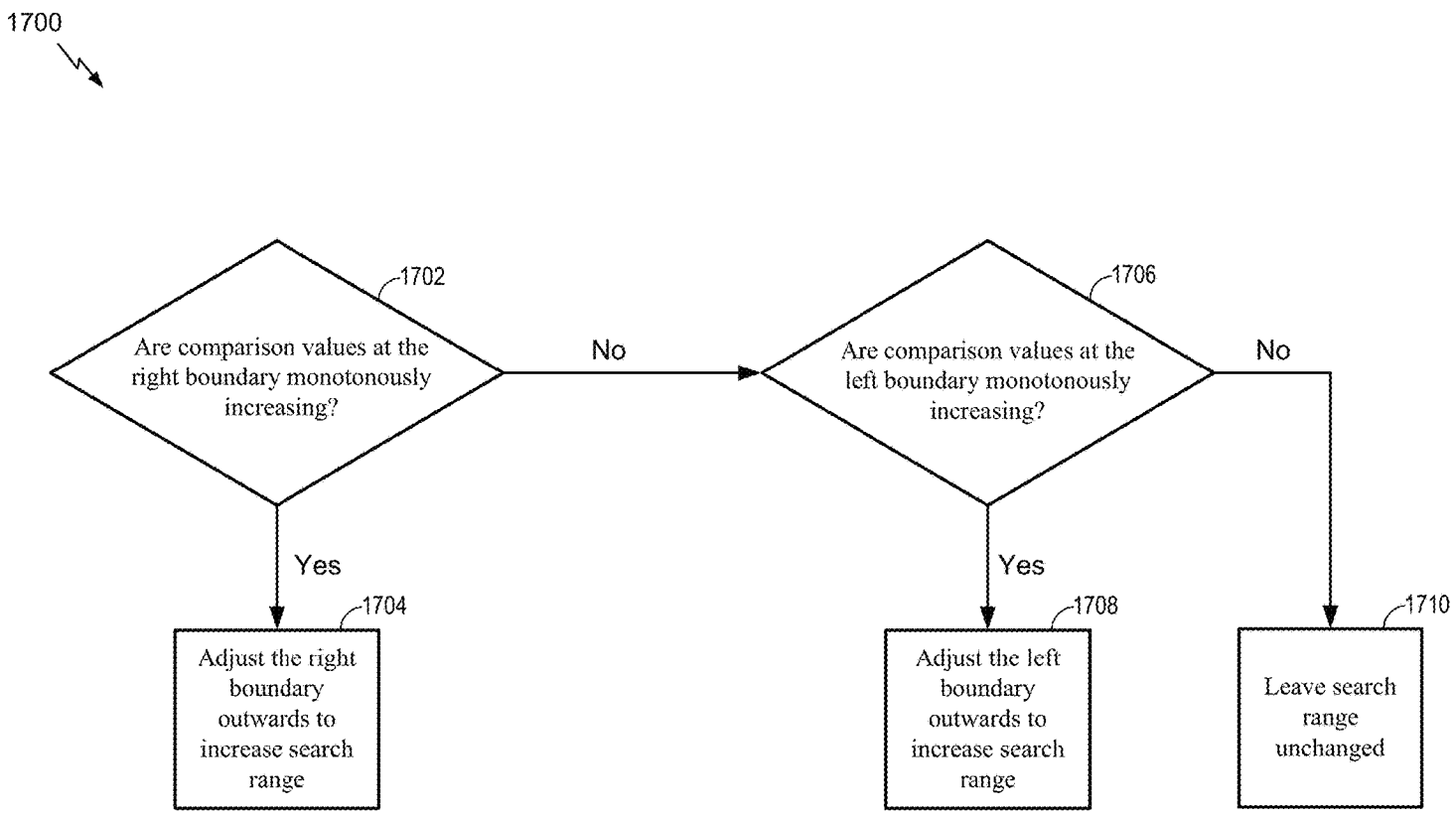
FIG. 17 is a diagram for selectively expanding a search range for comparison values used for shift estimation.
Figure 18:
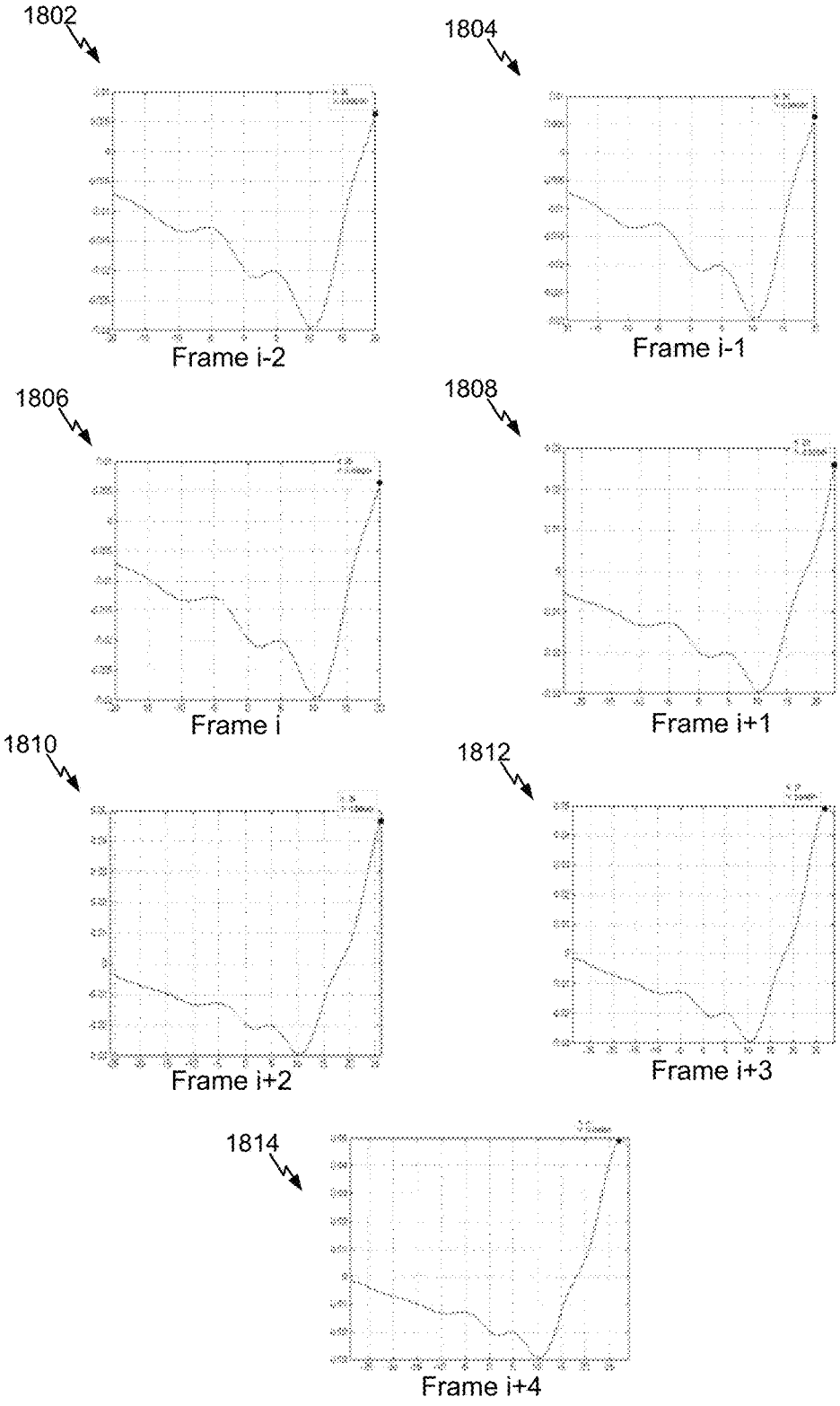
FIG. 18 is depicts graphs illustrating selective expansion of a search range for comparison values used for shift estimation.

According to one implementation, the method 1600 may include adjusting a range of comparison values that are used to estimate the delay between the first frame and the second frame, as described in greater detail with respect to FIGS. 17-18. The delay may be associated with a comparison value in the range of comparison values having a highest cross-correlation. Adjusting the range may include determining whether comparison values at a boundary of the range are monotonously increasing and expanding the boundary in response to a determination that the comparison values at the boundary are monotonously increasing. The boundary may include a left boundary or a right boundary.

The method 1600 of FIG. 16 may substantially normalize the shift estimate between voiced frames, unvoiced frames, and transition frames. Normalized shift estimates may reduce sample repetition and artifact skipping at frame boundaries. Additionally, normalized shift estimates may result in reduced side channel energies, which may improve coding efficiency.

Referring to FIG. 17, a process diagram 1700 for selectively expanding a search range for comparison values used for shift estimation is shown. For example, the process diagram 1700 may be used to expand the search range for comparison values based on comparison values generated for a current frame, comparison values generated for past frames, or a combination thereof.

According to the process diagram 1700, a detector may be configured to determine whether the comparison values in the vicinity of a right boundary or left boundary is increasing or decreasing. The search range boundaries for future comparison value generation may be pushed outward to accommodate more mismatch values based on the determination. For example, the search range boundaries may be pushed outward for comparison values in subsequent frames or comparison values in a same frame when comparison values are regenerated. The detector may initiate search boundary extension based on the comparison values generated for a current frame or based on comparison values generated for one or more previous frames.

At 1702, the detector may determine whether comparison values at the right boundary are monotonously increasing. As a non-limiting example, the search range may extend from −20 to 20 (e.g., from 20 sample shifts in the negative direction to 20 samples shifts in the positive direction). As used herein, a shift in the negative direction corresponds to a first signal, such as the first audio signal 130 of FIG. 1, being a reference signal and a second signal, such as the second audio signal 132 of FIG. 1, being a target signal. A shift in the positive direction corresponds to the first signal being the target signal and the second signal being the reference signal.

If the comparison values at the right boundary are monotonously increasing, at 1702, the detector may adjust the right boundary outwards to increase the search range, at 1704. To illustrate, if comparison value at sample shift 19 has a particular value and the comparison value at sample shift 20 has a higher value, the detector may extend the search range in the positive direction. As a non-limiting example, the detector may extend the search range from −20 to 25. The detector may extend the search range in increments of one sample, two samples, three samples, etc. According to one implementation, the determination at 1702 may be performed by detecting comparison values at a plurality of samples towards the right boundary to reduce the likelihood of expanding the search range based on a spurious jump at the right boundary.

If the comparison values at the right boundary are not monotonously increasing, at 1702, the detector may determine whether the comparison values at the left boundary are monotonously increasing, at 1706. If the comparison values at the left boundary are monotonously increasing, at 1706, the detector may adjust the left boundary outwards to increase the search range, at 1708. To illustrate, if comparison value at sample shift −19 has a particular value and the comparison value at sample shift −20 has a higher value, the detector may extend the search range in the negative direction. As a non-limiting example, the detector may extend the search range from −25 to 20. The detector may extend the search range in increments of one sample, two samples, three samples, etc. According to one implementation, the determination at 1702 may be performed by detecting comparison values at a plurality of samples towards the left boundary to reduce the likelihood of expanding the search range based on a spurious jump at the left boundary. If the comparison values at the left boundary are not monotonously increasing, at 1706, the detector may leave the search range unchanged, at 1710.

Thus, the process diagram 1700 of FIG. 17 may initiate search range modification for future frames. For example, the if the past three consecutive frames are detected to be monotonously increasing in the comparison values over the last ten mismatch values before the threshold (e.g., increasing from sample shift 10 to sample shift 20 or increasing from sample shift −10 to sample shift −20), the search range may be increased outwards by a particular number of samples. This outward increase of the search range may be continuously implemented for future frames until the comparison value at the boundary is no longer monotonously increasing. Increasing the search range based on comparison values for previous frames may reduce the likelihood that the "true shift" might lay very close to the search range's boundary but just outside the search range. Reducing this likelihood may result in improved side channel energy minimization and channel coding.

Referring to FIG. 18, graphs illustrating selective expansion of a search range for comparison values used for shift estimation is shown. The graphs may operate in conjunction with the data in Table 1.

TABLE 1

Selective Search Range Expansion Data

| Frame | Is current frame's correlation monotonously increasing at left boundary? | No. of consecutive frames with monotonously increasing left boundary | Is current frame's correlation monotonously increasing at right boundary? | No. of consecutive frames with monotonously increasing right boundary | Action to take | Boundary range | Best Estimated shift |
|---|---|---|---|---|---|---|---|
| i − 2 | No | 0 | Yes | 1 | Leave future search range unchanged | [−20, 20] | −12 |
| i − 1 | No | 0 | Yes | 2 | Leave future search range unchanged | [−20, 20] | −12 |
| i | No | 0 | Yes | 3 | Push the future right boundary outward | [−20, 20] | −12 |

TABLE 1-continued

Selective Search Range Expansion Data

| Frame | Is current frame's correlation monotonously increasing at left boundary? | No. of consecutive frames with monotonously increasing left boundary | Is current frame's correlation monotonously increasing at right boundary? | No. of consecutive frames with monotonously increasing right boundary | Action to take | Boundary range | Best Estimated shift |
|---|---|---|---|---|---|---|---|
| i + 1 | No | 0 | Yes | 4 | Push the future right boundary outward | [−23, 23] | −12 |
| i + 2 | No | 0 | Yes | 5 | Push the future right boundary outward | [−26, 26] | 26 |
| i + 3 | No | 0 | No | 0 | Leave future search range unchanged | [−29, 29] | 27 |
| i + 4 | No | 1 | No | 1 | Leave future search range unchanged | [−29, 29] | 27 |

According to Table 1, the detector may expand the search range if a particular boundary increases at three or more consecutive frames. The first graph 1802 illustrates comparison values for frame i−2. According to the first graph 1802, the left boundary is not monotonously increasing and the right boundary is monotonously increasing for one consecutive frame. As a result, the search range remains unchanged for the next frame (e.g., frame i−1) and the boundary may range from −20 to 20. The second graph 1804 illustrates comparison values for frame i−1. According to the second graph 1804, the left boundary is not monotonously increasing and the right boundary is monotonously increasing for two consecutive frames. As a result, the search range remains unchanged for the next frame (e.g., frame i) and the boundary may range from −20 to 20.

The third graph 1806 illustrates comparison values for frame i. According to the third graph 1806, the left boundary is not monotonously increasing and the right boundary is monotonously increasing for three consecutive frames. Because the right boundary in monotonously increasing for three or more consecutive frame, the search range for the next frame (e.g., frame i+1) may be expanded and the boundary for the next frame may range from −23 to 23. The fourth graph 1808 illustrates comparison values for frame i+1. According to the fourth graph 1808, the left boundary is not monotonously increasing and the right boundary is monotonously increasing for four consecutive frames. Because the right boundary in monotonously increasing for three or more consecutive frame, the search range for the next frame (e.g., frame i+2) may be expanded and the boundary for the next frame may range from −26 to 26. The fifth graph 1810 illustrates comparison values for frame i+2. According to the fifth graph 1810, the left boundary is not monotonously increasing and the right boundary is monotonously increasing for five consecutive frames. Because the right boundary in monotonously increasing for three or more consecutive frame, the search range for the next frame (e.g., frame i+3) may be expanded and the boundary for the next frame may range from −29 to 29.

The sixth graph 1812 illustrates comparison values for frame i+3. According to the sixth graph 1812, the left boundary is not monotonously increasing and the right boundary is not monotonously increasing. As a result, the search range remains unchanged for the next frame (e.g., frame i+4) and the boundary may range from −29 to 29. The seventh graph 1814 illustrates comparison values for frame i+4. According to the seventh graph 1814, the left boundary is not monotonously increasing and the right boundary is monotonously increasing for one consecutive frame. As a result, the search range remains unchanged for the next frame and the boundary may range from −29 to 29.

According to FIG. 18, the left boundary is expanded along with the right boundary. In alternative implementations, the left boundary may be pushed inwards to compensate for the outward push of the right boundary to maintain a constant number of mismatch values on which the comparison values are estimated for each frame. In another implementation, the left boundary may remain constant when the detector indicates that the right boundary is to be expanded outwards.

According to one implementation, when the detector indicates a particular boundary is to be expanded outwards, the amount of samples that the particular boundary is expanded outward may be determined based on the comparison values. For example, when the detector determines that the right boundary is to be expanded outwards based on the comparison values, a new set of comparison values may be generated on a wider shift search range and the detector may use the newly generated comparison values and the existing comparison values to determine the final search range. To illustrate, for frame i+1, a set of comparison values on a wider range of shifts ranging from −30 to 30 may be generated. The final search range may be limited based on the comparison values generated in the wider search range.

Although the examples in FIG. 18 indicate that the right boundary may be extended outwards, similar analogous functions may be performed to extend the left boundary outwards if the detector determines that the left boundary is to be extended. According to some implementations, absolute limitations on the search range may be utilized to prevent the search range for indefinitely increasing or decreasing. As a non-limiting example, the absolute value of the search range may not be permitted to increase above 8.75 milliseconds (e.g., the look-ahead of the CODEC).

Figure 19:
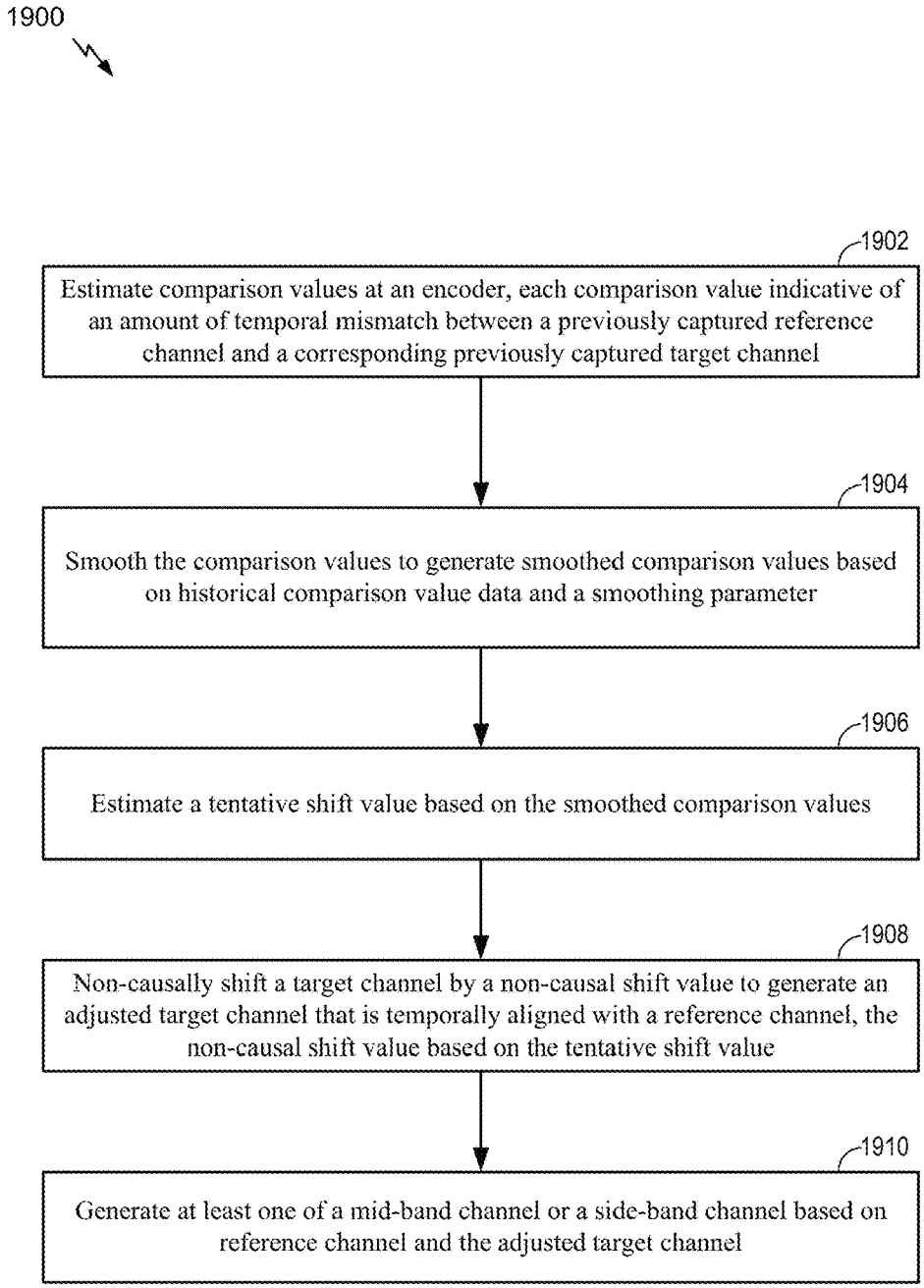
FIG. 19 is a flow chart illustrating a method of non-causally shifting a channel.

Referring to FIG. 19, a method 1900 for non-causally shifting a channel is shown. The method 1900 may be performed by the temporal equalizer 108, the encoder 114, the first device 104 of FIG. 1, or a combination thereof.

The method 1900 includes estimating comparison values at an encoder, at 1902. Each comparison value may be indicative of an amount of temporal mismatch between a previously captured reference channel and a corresponding previously captured target channel. For example, referring to FIG. 1, the encoder 114 may estimate comparison values indicative of reference frames (captured earlier in time) and corresponding target frames (captured earlier in time). The reference frames and the target frames may be captured by the microphones 146, 148.

The method 1900 also includes smoothing the comparison values to generate smoothed comparison values based on historical comparison value data and a smoothing parameter, at 1904. For example, referring to FIG. 1, the encoder 114 may smooth the comparison values to generate smoothed comparison values based on historical comparison value data and a smoothing parameter. According to one implementation, the smoothing parameter may be adaptive. For example, the method 1900 may include adapting the smoothing parameter based on a correlation of short-term comparison values to long-term comparison values. According to one implementation, the comparison values ($CompVal_{LT_N}(k)$) are equal to $(1-\alpha)*CompVal_N(k)$, $+(\alpha)*CompVal_{LT_{N-1}}(k)$. A value of the smoothing parameter ($\alpha$) may be adjusted based on short-term energy indicators of input channels and long-term energy indicators of the input channels. Additionally, the value of the smoothing parameter ($\alpha$) may be reduced if the short-term energy indicators are greater than the long-term energy indicators. According to another implementation, a value of the smoothing parameter ($\alpha$) is adjusted based on a correlation of short-term smoothed comparison values to long-term smoothed comparison values. Additionally, the value of the smoothing parameter ($\alpha$) may be increased if the correlation exceeds a threshold. According to another implementation, the comparison values may be cross-correlation values of down-sampled reference channels and corresponding down-sampled target channel.

The method 1900 also includes estimating a tentative shift value based on the smoothed comparison values, at 1906. For example, referring to FIG. 1, the encoder 114 may estimate a tentative shift value based on the smoothed comparison values. The method 1900 also includes non-causally shifting a target channel by a non-causal shift value to generate an adjusted target channel that is temporally aligned with a reference channel, the non-causal shift value based on the tentative shift value, at 1908. For example, temporal equalizer 108 may non-causally shift the target channel by the non-causal shift value (e.g., the non-causal mismatch value 162) to generate an adjusted target channel that is temporally aligned with the reference channel.

The method 1900 also includes generating at least one of a mid-band channel or a side-band channel based on the reference channel and the adjusted target channel, at 1910. For example, referring to FIG. 19, the encoder 114 may generate at least a mid-band channel and a side-band channel based on the reference channel and the adjusted target channel.

Figure 20:
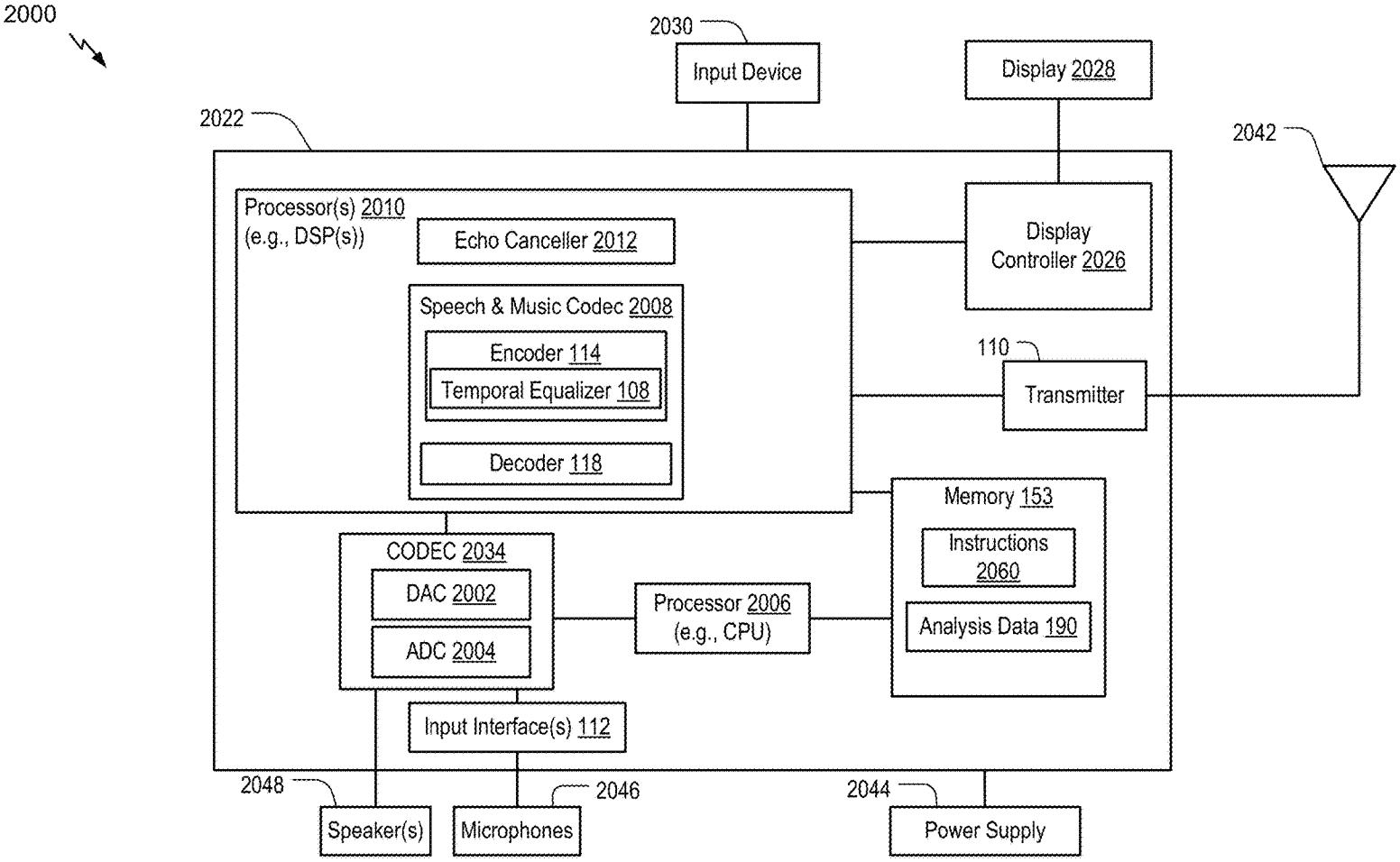
FIG. 20 is a block diagram of a particular illustrative example of a device that is operable to encode multiple channels.

Referring to FIG. 20, a block diagram of a particular illustrative example of a device (e.g., a wireless communication device) is depicted and generally designated 2000. In various embodiments, the device 2000 may have fewer or more components than illustrated in FIG. 20. In an illustrative embodiment, the device 2000 may correspond to the first device 104 or the second device 106 of FIG. 1. In an illustrative embodiment, the device 2000 may perform one or more operations described with reference to systems and methods of FIGS. 1-19.

In a particular embodiment, the device 2000 includes a processor 2006 (e.g., a central processing unit (CPU)). The device 2000 may include one or more additional processors 2010 (e.g., one or more digital signal processors (DSPs)). The processors 2010 may include a media (e.g., speech and music) coder-decoder (CODEC) 2008, and an echo canceller 2012. The media CODEC 2008 may include the decoder 118, the encoder 114, or both, of FIG. 1. The encoder 114 may include the temporal equalizer 108.

The device 2000 may include a memory 153 and a CODEC 2034. Although the media CODEC 2008 is illustrated as a component of the processors 2010 (e.g., dedicated circuitry and/or executable programming code), in other embodiments one or more components of the media CODEC 2008, such as the decoder 118, the encoder 114, or both, may be included in the processor 2006, the CODEC 2034, another processing component, or a combination thereof.

The device 2000 may include the transmitter 110 coupled to an antenna 2042. The device 2000 may include a display 2028 coupled to a display controller 2026. One or more speakers 2048 may be coupled to the CODEC 2034. One or more microphones 2046 may be coupled, via the input interface(s) 112, to the CODEC 2034. In a particular implementation, the speakers 2048 may include the first loudspeaker 142, the second loudspeaker 144 of FIG. 1, the Yth loudspeaker 244 of FIG. 2, or a combination thereof. In a particular implementation, the microphones 2046 may include the first microphone 146, the second microphone 148 of FIG. 1, the Nth microphone 248 of FIG. 2, the third microphone 1146, the fourth microphone 1148 of FIG. 11, or a combination thereof. The CODEC 2034 may include a digital-to-analog converter (DAC) 2002 and an analog-to-digital converter (ADC) 2004.

The memory 153 may include instructions 2060 executable by the processor 2006, the processors 2010, the CODEC 2034, another processing unit of the device 2000, or a combination thereof, to perform one or more operations described with reference to FIGS. 1-19. The memory 153 may store the analysis data 190.

One or more components of the device 2000 may be implemented via dedicated hardware (e.g., circuitry), by a processor executing instructions to perform one or more tasks, or a combination thereof. As an example, the memory 153 or one or more components of the processor 2006, the processors 2010, and/or the CODEC 2034 may be a memory device, such as a random access memory (RAM), magneto-resistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 2060) that, when executed by a computer (e.g., a processor in the CODEC 2034, the processor 2006, and/or the processors 2010), may cause the computer to perform one or more operations described with reference to FIGS. 1-18. As an example, the memory 153 or the one or more components of the processor 2006, the processors 2010, and/or the CODEC 2034 may be a non-transitory computer-readable medium that includes instructions (e.g., the instructions 2060) that, when executed by a computer (e.g., a processor in the CODEC 2034, the processor 2006, and/or the processors 2010), cause the computer perform one or more operations described with reference to FIGS. 1-19.

In a particular embodiment, the device 2000 may be included in a system-in-package or system-on-chip device (e.g., a mobile station modem (MSM)) 2022. In a particular embodiment, the processor 2006, the processors 2010, the display controller 2026, the memory 153, the CODEC 2034, and the transmitter 110 are included in a system-in-package or the system-on-chip device 2022. In a particular embodiment, an input device 2030, such as a touchscreen and/or keypad, and a power supply 2044 are coupled to the system-on-chip device 2022. Moreover, in a particular embodiment, as illustrated in FIG. 20, the display 2028, the input device 2030, the speakers 2048, the microphones 2046, the antenna 2042, and the power supply 2044 are external to the system-on-chip device 2022. However, each of the display 2028, the input device 2030, the speakers 2048, the microphones 2046, the antenna 2042, and the power supply 2044 can be coupled to a component of the system-on-chip device 2022, such as an interface or a controller.

The device 2000 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In a particular implementation, one or more components of the systems described herein and the device 2000 may be integrated into a decoding system or apparatus (e.g., an electronic device, a CODEC, or a processor therein), into an encoding system or apparatus, or both. In other implementations, one or more components of the systems described herein and the device 2000 may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

It should be noted that various functions performed by the one or more components of the systems described herein and the device 2000 are described as being performed by certain components or modules. This division of components and modules is for illustration only. In an alternate implementation, a function performed by a particular component or module may be divided amongst multiple components or modules. Moreover, in an alternate implementation, two or more components or modules of the systems described herein may be integrated into a single component or module. Each component or module illustrated in systems described herein may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described implementations, an apparatus includes means for capturing a reference channel. The reference channel may include a reference frame. For example, the means for capturing the first audio signal may include the first microphone 146 of FIGS. 1-2, the microphone(s) 2046 of FIG. 20, one or more devices/sensors configured to capture the reference channel (e.g., a processor executing instructions that are stored at a computer-readable storage device), or a combination thereof.

The apparatus may also include means for capturing a target channel. The target channel may include a target frame. For example, the means for capturing the second audio signal may include the second microphone 148 of FIGS. 1-2, the microphone(s) 2046 of FIG. 20, one or more devices/sensors configured to capture the target channel (e.g., a processor executing instructions that are stored at a computer-readable storage device), or a combination thereof.

The apparatus may also include means for estimating a delay between the reference frame and the target frame. For example, the means for determining the delay may include the temporal equalizer 108, the encoder 114, the first device 104 of FIG. 1, the media CODEC 2008, the processors 2010, the device 2000, one or more devices configured to determine the delay (e.g., a processor executing instructions that are stored at a computer-readable storage device), or a combination thereof.

The apparatus may also include means for estimating a temporal offset between the reference channel and the target channel based on the delay and based on historical delay data. For example, the means for estimating the temporal offset may include the temporal equalizer 108, the encoder 114, the first device 104 of FIG. 1, the media CODEC 2008, the processors 2010, the device 2000, one or more devices configured to estimate the temporal offset (e.g., a processor executing instructions that are stored at a computer-readable storage device), or a combination thereof.

Figure 21:
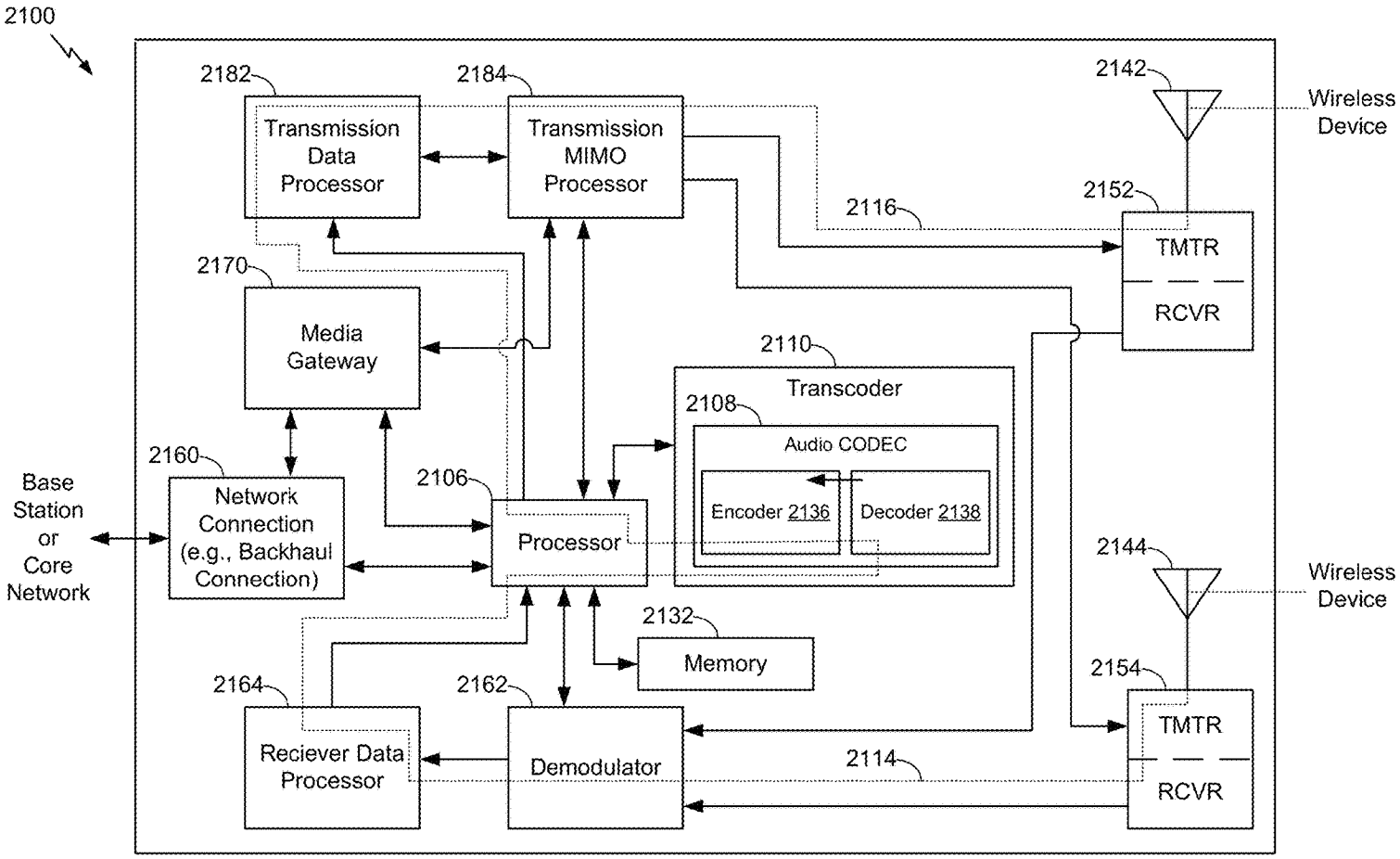
FIG. 21 is a block diagram of a base station that is operable to encode multiple channels.

Referring to FIG. 21, a block diagram of a particular illustrative example of a base station 2100 is depicted. In various implementations, the base station 2100 may have more components or fewer components than illustrated in FIG. 21. In an illustrative example, the base station 2100 may include the first device 104, the second device 106 of FIG. 1, the first device 204 of FIG. 2, or a combination thereof. In an illustrative example, the base station 2100 may operate according to one or more of the methods or systems described with reference to FIGS. 1-19.

The base station 2100 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 2100 of FIG. 21.

Various functions may be performed by one or more components of the base station 2100 (and/or in other components not shown), such as sending and receiving messages and data (e.g., audio data). In a particular example, the base station 2100 includes a processor 2106 (e.g., a CPU). The base station 2100 may include a transcoder 2110. The transcoder 2110 may include an audio CODEC 2108. For example, the transcoder 2110 may include one or more components (e.g., circuitry) configured to perform operations of the audio CODEC 2108. As another example, the transcoder 2110 may be configured to execute one or more computer-readable instructions to perform the operations of the audio CODEC 2108. Although the audio CODEC 2108 is illustrated as a component of the transcoder 2110, in other examples one or more components of the audio CODEC 2108 may be included in the processor 2106, another processing component, or a combination thereof. For example, a decoder 2138 (e.g., a vocoder decoder) may be included in a receiver data processor 2164. As another example, an encoder 2136 (e.g., a vocoder encoder) may be included in a transmission data processor 2182.

The transcoder 2110 may function to transcode messages and data between two or more networks. The transcoder 2110 may be configured to convert message and audio data from a first format (e.g., a digital format) to a second format. To illustrate, the decoder 2138 may decode encoded signals having a first format and the encoder 2136 may encode the decoded signals into encoded signals having a second format. Additionally or alternatively, the transcoder 2110 may be configured to perform data rate adaptation. For example, the transcoder 2110 may down-convert a data rate or up-convert the data rate without changing a format the audio data. To illustrate, the transcoder 2110 may down-convert 64 kbit/s signals into 16 kbit/s signals.

The audio CODEC 2108 may include the encoder 2136 and the decoder 2138. The encoder 2136 may include the encoder 114 of FIG. 1, the encoder 214 of FIG. 2, or both. The decoder 2138 may include the decoder 118 of FIG. 1.

The base station 2100 may include a memory 2132. The memory 2132, such as a computer-readable storage device, may include instructions. The instructions may include one or more instructions that are executable by the processor 2106, the transcoder 2110, or a combination thereof, to perform one or more operations described with reference to the methods and systems of FIGS. 1-20. The base station 2100 may include multiple transmitters and receivers (e.g., transceivers), such as a first transceiver 2152 and a second transceiver 2154, coupled to an array of antennas. The array of antennas may include a first antenna 2142 and a second antenna 2144. The array of antennas may be configured to wirelessly communicate with one or more wireless devices, such as the device 2100 of FIG. 21. For example, the second antenna 2144 may receive a data stream 2114 (e.g., a bit stream) from a wireless device. The data stream 2114 may include messages, data (e.g., encoded speech data), or a combination thereof.

The base station 2100 may include a network connection 2160, such as backhaul connection. The network connection 2160 may be configured to communicate with a core network or one or more base stations of the wireless communication network. For example, the base station 2100 may receive a second data stream (e.g., messages or audio data) from a core network via the network connection 2160. The base station 2100 may process the second data stream to generate messages or audio data and provide the messages or the audio data to one or more wireless device via one or more antennas of the array of antennas or to another base station via the network connection 2160. In a particular implementation, the network connection 2160 may be a wide area network (WAN) connection, as an illustrative, non-limiting example. In some implementations, the core network may include or correspond to a Public Switched Telephone Network (PSTN), a packet backbone network, or both.

The base station 2100 may include a media gateway 2170 that is coupled to the network connection 2160 and the processor 2106. The media gateway 2170 may be configured to convert between media streams of different telecommunications technologies. For example, the media gateway 2170 may convert between different transmission protocols, different coding schemes, or both. To illustrate, the media gateway 2170 may convert from PCM signals to Real-Time Transport Protocol (RTP) signals, as an illustrative, non-limiting example. The media gateway 2170 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 2170 may include a transcode and may be configured to transcode data when codecs are incompatible. For example, the media gateway 2170 may transcode between an Adaptive Multi-Rate (AMR) codec and a G.711 codec, as an illustrative, non-limiting example. The media gateway 2170 may include a router and a plurality of physical interfaces. In some implementations, the media gateway 2170 may also include a controller (not shown). In a particular implementation, the media gateway controller may be external to the media gateway 2170, external to the base station 2100, or both. The media gateway controller may control and coordinate operations of multiple media gateways. The media gateway 2170 may receive control signals from the media gateway controller and may function to bridge between different transmission technologies and may add service to end-user capabilities and connections.

The base station 2100 may include a demodulator 2162 that is coupled to the transceivers 2152, 2154, the receiver data processor 2164, and the processor 2106, and the receiver data processor 2164 may be coupled to the processor 2106. The demodulator 2162 may be configured to demodulate modulated signals received from the transceivers 2152, 2154 and to provide demodulated data to the receiver data processor 2164. The receiver data processor 2164 may be configured to extract a message or audio data from the demodulated data and send the message or the audio data to the processor 2106.

The base station 2100 may include a transmission data processor 2182 and a transmission multiple input-multiple output (MIMO) processor 2184. The transmission data processor 2182 may be coupled to the processor 2106 and the transmission MIMO processor 2184. The transmission MIMO processor 2184 may be coupled to the transceivers 2152, 2154 and the processor 2106. In some implementations, the transmission MIMO processor 2184 may be coupled to the media gateway 2170. The transmission data processor 2182 may be configured to receive the messages or the audio data from the processor 2106 and to code the messages or the audio data based on a coding scheme, such as CDMA or orthogonal frequency-division multiplexing (OFDM), as an illustrative, non-limiting examples. The transmission data processor 2182 may provide the coded data to the transmission MIMO processor 2184.

The coded data may be multiplexed with other data, such as pilot data, using CDMA or OFDM techniques to generate multiplexed data. The multiplexed data may then be modulated (i.e., symbol mapped) by the transmission data processor 2182 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 2106.

The transmission MIMO processor 2184 may be configured to receive the modulation symbols from the transmission data processor 2182 and may further process the modulation symbols and may perform beamforming on the data. For example, the transmission MIMO processor 2184 may apply beamforming weights to the modulation symbols.

The beamforming weights may correspond to one or more antennas of the array of antennas from which the modulation symbols are transmitted.

During operation, the second antenna 2144 of the base station 2100 may receive a data stream 2114. The second transceiver 2154 may receive the data stream 2114 from the second antenna 2144 and may provide the data stream 2114 to the demodulator 2162. The demodulator 2162 may demodulate modulated signals of the data stream 2114 and provide demodulated data to the receiver data processor 2164. The receiver data processor 2164 may extract audio data from the demodulated data and provide the extracted audio data to the processor 2106.

The processor 2106 may provide the audio data to the transcoder 2110 for transcoding. The decoder 2138 of the transcoder 2110 may decode the audio data from a first format into decoded audio data and the encoder 2136 may encode the decoded audio data into a second format. In some implementations, the encoder 2136 may encode the audio data using a higher data rate (e.g., up-convert) or a lower data rate (e.g., down-convert) than received from the wireless device. In other implementations, the audio data may not be transcoded. Although transcoding (e.g., decoding and encoding) is illustrated as being performed by a transcoder 2110, the transcoding operations (e.g., decoding and encoding) may be performed by multiple components of the base station 2100. For example, decoding may be performed by the receiver data processor 2164 and encoding may be performed by the transmission data processor 2182. In other implementations, the processor 2106 may provide the audio data to the media gateway 2170 for conversion to another transmission protocol, coding scheme, or both. The media gateway 2170 may provide the converted data to another base station or core network via the network connection 2160.

The encoder 2136 may estimate a delay between the reference frame (e.g., the first frame 131) and the target frame (e.g., the second frame 133). The encoder 2136 may also estimate a temporal offset between the reference channel (e.g., the first audio signal 130) and the target channel (e.g., the second audio signal 132) based on the delay and based on historical delay data. The encoder 2136 may quantize and encode the temporal offset (or the final shift) value at a different resolution based on the CODEC sample rate to reduce (or minimize) the impact on the overall delay of the system. In one example implementation, the encoder may estimate and use the temporal offset with a higher resolution for multi-channel downmix purposes at the encoder, however, the encoder may quantize and transmit at a lower resolution for use at the decoder. The decoder 118 may generate the first output signal 126 and the second output signal 128 by decoding encoded signals based on the reference signal indicator 164, the non-causal shift value 162, the gain parameter 160, or a combination thereof. Encoded audio data generated at the encoder 2136, such as transcoded data, may be provided to the transmission data processor 2182 or the network connection 2160 via the processor 2106.

The transcoded audio data from the transcoder 2110 may be provided to the transmission data processor 2182 for coding according to a modulation scheme, such as OFDM, to generate the modulation symbols. The transmission data processor 2182 may provide the modulation symbols to the transmission MIMO processor 2184 for further processing and beamforming. The transmission MIMO processor 2184 may apply beamforming weights and may provide the modulation symbols to one or more antennas of the array of antennas, such as the first antenna 2142 via the first transceiver 2152. Thus, the base station 2100 may provide a transcoded data stream 2116, that corresponds to the data stream 2114 received from the wireless device, to another wireless device. The transcoded data stream 2116 may have a different encoding format, data rate, or both, than the data stream 2114. In other implementations, the transcoded data stream 2116 may be provided to the network connection 2160 for transmission to another base station or a core network.

The base station 2100 may therefore include a computer-readable storage device (e.g., the memory 2132) storing instructions that, when executed by a processor (e.g., the processor 2106 or the transcoder 2110), cause the processor to perform operations including estimating a delay between the reference frame and the target frame. The operations also include estimating a temporal offset between the reference channel and the target channel based on the delay and based on historical delay data.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magneto-resistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A method comprising:

estimating comparison values at an encoder, each comparison value indicative of an amount of temporal mismatch between a previously captured reference channel and a corresponding previously captured target channel;

smoothing the comparison values to generate smoothed comparison values based on historical comparison value data and a smoothing parameter, the smoothing parameter having a value that is based on at least one short-term signal level indicator of input channels and at least one long-term signal level indicator of the input channels;

estimating a tentative shift value based on the smoothed comparison values;

non-causally shifting a particular target channel by a non-causal shift value to generate an adjusted particular target channel that is temporally aligned with a particular reference channel, the non-causal shift value based on the tentative shift value; and generating at least one of a mid-band channel or a side-band channel based on the particular reference channel and the adjusted particular target channel.

2. The method of claim 1, wherein the smoothing parameter is adaptive.

3. The method of claim 1, further comprising adapting the smoothing parameter based on a variation in short-term comparison values relative to long-term comparison values.

4. The method of claim 1, wherein the value of the smoothing parameter is reduced if the short-term signal level indicators are greater than the long-term signal level indicators.

5. The method of claim 1, wherein the value of the smoothing parameter is adjusted based on a variation in short-term smoothed comparison values relative to long-term smoothed comparison values.

6. The method of claim 5, wherein the value of the smoothing parameter is increased if the variation exceeds a threshold.

7. The method of claim 1, wherein the comparison values comprise cross-correlation values of down-sampled reference channels and corresponding down-sampled target channels.

8. The method of claim 1, further comprising adjusting a range of the comparison values, wherein the tentative shift value is associated with a comparison value in the range of the comparison values having a highest cross-correlation.

9. The method of claim 8, wherein adjusting the range comprises:

determining whether particular comparison values at a boundary of the range are monotonously increasing; and expanding the boundary in response to a determination that the particular comparison values at the boundary are monotonously increasing.

10. The method of claim 9, wherein the boundary includes a left boundary or a right boundary.

11. The method of claim 1, wherein a reference frame of the particular reference channel and a target frame of the particular target channel are one of voiced frames, transition frames, or unvoiced frames.

12. The method of claim 1, wherein estimating the comparison values, smoothing the comparison values, estimating the tentative shift value, and non-causally shifting the target channel are performed at a mobile device.

13. The method of claim 1, wherein estimating the comparison values, smoothing the comparison values, estimating the tentative shift value, and non-causally shifting the target channel are performed at a base station.

14. The method of claim 1, wherein the input channels correspond to previously captured reference channels and corresponding previously captured target channels.

15. The method of claim 1, wherein the short-term signal level indicator is based on a sum of absolute values of the input channels.

16. The method of claim 1, wherein the short-term signal level indicator is based on a sum of squares of the input channels.

17. The method of claim 1, wherein the short-term signal level indicator is based on a sum of absolute values of down-sampled channels associated with the input channels.

18. An apparatus comprising:

a first microphone configured to capture a particular reference channel;

a second microphone configured to capture a particular target channel; and an encoder configured to:

estimate comparison values, each comparison value indicative of an amount of temporal mismatch between a previously captured reference channel and a corresponding previously captured target channel;

smooth the comparison values to generate smoothed comparison values based on historical comparison value data and a smoothing parameter, the smoothing parameter having a value that is based on at least one short-term signal level indicator of input channels and at least one long-term signal level indicator of the input channels;

estimate a tentative shift value based on the smoothed comparison values;

non-causally shift the particular target channel by a non-causal shift value to generate an adjusted particular target channel that is temporally aligned with the particular reference channel, the non-causal shift value based on the tentative shift value; and generate at least one of a mid-band channel or a side-band channel based on the particular reference channel and the adjusted particular target channel.

19. The apparatus of claim 18, wherein the smoothing parameter is adaptive.

20. The apparatus of claim 18, wherein the encoder is further configured to adapt the smoothing parameter based on a correlation of short-term comparison values to long-term comparison values.

21. The apparatus of claim 18, wherein the encoder is further configured to reduce the value of the smoothing parameter if the short-term signal level indicators are greater than the long-term signal level indicators.

22. The apparatus of claim 18, wherein the encoder is further configured to adjust the value of the smoothing parameter based on a correlation of short-term smoothed comparison values to long-term smoothed comparison values.

23. The apparatus of claim 22, wherein the encoder is further configured to increase the value of the smoothing parameter if the correlation exceeds a threshold.

24. The apparatus of claim 18, wherein the comparison values are cross-correlation values of down-sampled reference channels and corresponding down-sampled target channels.

25. The apparatus of claim 18, wherein the encoder is further configured to adjust adjusting a range of the comparison values, wherein the tentative shift value is associated with a comparison value in the range of the comparison values having a highest cross-correlation.

26. The apparatus of claim 18, wherein the encoder is integrated into a mobile device.

27. The apparatus of claim 18, wherein the encoder is integrated into a base station.

28. A non-transitory computer-readable medium comprising instructions that, when executed by an encoder, cause the encoder to perform operations comprising:

estimating comparison values, each comparison value indicative of an amount of temporal mismatch between a previously captured reference channel and a corresponding previously captured target channel;

smoothing the comparison values to generate smoothed comparison values based on historical comparison value data and a smoothing parameter, the smoothing parameter having a value that is based on at least one short-term signal level indicator of input channels and at least one long-term signal level indicator of the input channels;

estimating a tentative shift value based on the smoothed comparison values;

non-causally shifting a particular target channel by a non-causal shift value to generate an adjusted particular target channel that is temporally aligned with a particular reference channel, the non-causal shift value based on the tentative shift value; and generating at least one of a mid-band channel or a side-band channel based on the particular reference channel and the adjusted particular target channel.

29. The non-transitory computer-readable medium of claim 28, wherein the smoothing parameter is adaptive.

30. The non-transitory computer-readable medium of claim 28, wherein the operations further comprise adapting the smoothing parameter based on a correlation of short-term comparison values to long-term comparison values.

31. An apparatus comprising:

means for estimating comparison values, each comparison value indicative of an amount of temporal mismatch between a previously captured reference channel and a corresponding previously captured target channel;

means for smoothing the comparison values to generate smoothed comparison values based on historical comparison value data and a smoothing parameter, the smoothing parameter having a value that is based on at least one short-term signal level indicator of input channels and at least one long-term signal level indicator of the input channels;

means for estimating a tentative shift value based on the smoothed comparison values;

means for non-causally shifting a particular target channel by a non-causal shift value to generate an adjusted particular target channel that is temporally aligned with a particular reference channel, the non-causal shift value based on the tentative shift value; and means for generating at least one of a mid-band channel or a side-band channel based on the particular reference channel and the adjusted particular target channel.

32. The apparatus of claim 31, wherein the smoothing parameter is adaptive.

33. The apparatus of claim 31, wherein the means for estimating the comparison values, the means for smoothing the comparison values, the means for estimating the tentative shift value, and the means for non-causally shifting the target channel are integrated into a mobile device.

34. The apparatus of claim 31, wherein the means for estimating the comparison values, the means for smoothing the comparison values, the means for estimating the tentative shift value, and the means for non-causally shifting the target channel are integrated into a base station.

* * * * *